US008333452B2

(12) United States Patent
Takagi et al.

(10) Patent No.: US 8,333,452 B2
(45) Date of Patent: Dec. 18, 2012

(54) IMAGE FORMING APPARATUS, IMAGE FORMING METHOD AND COMPUTER-READABLE STORAGE MEDIUM

(75) Inventors: Yasunobu Takagi, Kanagawa (JP); Takashi Kimura, Kanagawa (JP); Taku Satoh, Kanagawa (JP); Masakazu Yoshida, Kanagawa (JP); Toshihito Kamei, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 327 days.

(21) Appl. No.: 12/686,548

(22) Filed: Jan. 13, 2010

(65) Prior Publication Data

US 2010/0182367 A1 Jul. 22, 2010

(30) Foreign Application Priority Data

Jan. 16, 2009 (JP) ..... 2009-008050
Nov. 2, 2009 (JP) ..... 2009-252186
Jan. 13, 2010 (JP) ..... 2010-004552

(51) Int. Cl.
*B41J 29/38* (2006.01)

(52) U.S. Cl. ..... 347/14

(58) Field of Classification Search ..... 347/14, 347/19

See application file for complete search history.

(56) References Cited

U.S. PATENT DOCUMENTS 6,247,788 B1 6/2001 Kamei
6,439,908 B1 * 8/2002 Silverbrook et al. ..... 439/212
6,578,944 B1 6/2003 Kamei et al.
6,742,884 B2 * 6/2004 Wong et al. ..... 347/99
6,923,520 B2 8/2005 Oikawa et al.
7,083,247 B2 8/2006 Yoshida et al.
7,407,248 B2 8/2008 Hirano et al.
7,527,351 B2 5/2009 Hirano et al.
7,533,961 B2 5/2009 Kikuchi et al.
7,540,578 B2 6/2009 Suzuki et al.
7,576,886 B2 8/2009 Kimura
7,591,521 B2 9/2009 Aruga
7,600,842 B2 10/2009 Hirano et al.
2006/0092206 A1 5/2006 Kimura et al.
2006/0098232 A1 5/2006 Nakano et al.
2007/0058201 A1 3/2007 Ike et al.
2007/0064031 A1 3/2007 Nakano et al.
2007/0091135 A1 4/2007 Hosaka et al.
2007/0106962 A1 5/2007 Sakakibara et al.
2007/0165068 A1 * 7/2007 Tsuboi ..... 347/41
2007/0211092 A1 9/2007 Shingyohuchi et al.
2007/0216953 A1 9/2007 Kikuchi et al.
2007/0242098 A1 * 10/2007 Sudo et al. ..... 347/40
2008/0049057 A1 * 2/2008 Ochiai et al. ..... 347/12

(Continued)

FOREIGN PATENT DOCUMENTS

JP 60-107975 6/1985

(Continued)

*Primary Examiner* — Laura Martin
(74) *Attorney, Agent, or Firm* — IPUSA, PLLC

(57) ABSTRACT

An image forming apparatus performs a 1-pass recording by a single main scan with respect to a recording medium by a nozzle group including different overlapping nozzles that scan the same overlapping region on the recording medium to record dots. Alternatively, a multi-pass recording is performed by a plurality of main scans with respect to the overlapping region by the same nozzle group or by different nozzle groups. The recording in a central portion of the overlapping region is performed by placing emphasis on the succession or continuity of the dots, while the recording in boundary portions of the overlapping region is performed by placing emphasis on the scattering of the dots.

20 Claims, 37 Drawing Sheets

U.S. PATENT DOCUMENTS

| | | | | |
|---|---|---|---|---|
| 2008/0117467 | A1 | 5/2008 | Hosaka et al. | |
| 2008/0123146 | A1 | 5/2008 | Ike et al. | |
| 2008/0137147 | A1 | 6/2008 | Nakano et al. | |
| 2008/0158278 | A1* | 7/2008 | Inoue | 347/12 |
| 2008/0231904 | A1 | 9/2008 | Suzuki et al. | |
| 2009/0018881 | A1 | 1/2009 | Ito et al. | |
| 2009/0051734 | A1 | 2/2009 | Ike et al. | |
| 2009/0058910 | A1 | 3/2009 | Hatanaka et al. | |
| 2009/0167800 | A1 | 7/2009 | Hatanaka et al. | |
| 2009/0167804 | A1 | 7/2009 | Kikuchi et al. | |
| 2009/0195585 | A1 | 8/2009 | Satoh et al. | |

FOREIGN PATENT DOCUMENTS

| | | |
|---|---|---|
| JP | 2001-232783 | 8/2001 |
| JP | 2006-150593 | 6/2006 |
| JP | 2006-168241 | 6/2006 |
| JP | 2006-205490 | 8/2006 |
| JP | 2006-240043 | 9/2006 |
| JP | 2007-015180 | 1/2007 |
| JP | 2007-030503 | 2/2007 |
| JP | 2008-143065 | 6/2008 |

* cited by examiner

| | (A) | (B) | (C) | (D) | (E) |
|---|---|---|---|---|---|
| i | 12 | 18 | 24 | 30 | 48 |
| ii | 4 | 3 | 4 | 5 | 8 |
| iii | 12 | 25 | 21 | 16 | 0 |
| iv | 4 | 4 | 4 | 3 | 0 |
| v | 4 | 3 | 4 | 3 | 1 |

FIG.31A

POSITIONAL ERROR OF ±20 μm

| RECORDING MODE | TEMPERATURE & HUMIDITY | | |
|---|---|---|---|
| | LOW TEMPERATURE & HUMIDITY | ROOM TEMPERATURE & HUMIDITY | HIGH TEMPERATURE & HUMIDITY |
| 1-PASS 300×300 dpi | RP3 | RP3 | RP3 |
| 1-PASS 600×300 dpi | RP3 | RP3 | RP3 |
| 1-PASS 600×600 dpi | RP3 | RP3 | RP3 |
| 2-PASS 600×600 dpi | RP4 | RP4 | RP4 |

POSITIONAL ERROR OF ±15 μm

| RECORDING MODE | TEMPERATURE & HUMIDITY | | |
|---|---|---|---|
| | LOW TEMPERATURE & HUMIDITY | ROOM TEMPERATURE & HUMIDITY | HIGH TEMPERATURE & HUMIDITY |
| 1-PASS 300×300 dpi | RP3 | RP3 | RP2 |
| 1-PASS 600×300 dpi | RP3 | RP3 | RP2 |
| 1-PASS 600×600 dpi | RP3 | RP3 | RP2 |
| 2-PASS 600×600 dpi | RP4 | RP4 | RP4 |

POSITIONAL ERROR OF ±10 μm

| RECORDING MODE | TEMPERATURE & HUMIDITY | | |
|---|---|---|---|
| | LOW TEMPERATURE & HUMIDITY | ROOM TEMPERATURE & HUMIDITY | HIGH TEMPERATURE & HUMIDITY |
| 1-PASS 300×300 dpi | RP3 | RP3 | RP1 |
| 1-PASS 600×300 dpi | RP3 | RP3 | RP1 |
| 1-PASS 600×600 dpi | RP3 | RP3 | RP1 |
| 2-PASS 600×600 dpi | RP4 | RP4 | RP3 |

FIG.31B

POSITIONAL ERROR OF −10 TO −30 μm

| RECORDING MODE | TEMPERATURE & HUMIDITY | | |
|---|---|---|---|
| | LOW TEMPERATURE & HUMIDITY | ROOM TEMPERATURE & HUMIDITY | HIGH TEMPERATURE & HUMIDITY |
| 1-PASS 300×300 dpi | RP4 | RP4 | RP3 |
| 1-PASS 600×300 dpi | RP4 | RP4 | RP3 |
| 1-PASS 600×600 dpi | RP4 | RP4 | RP3 |
| 2-PASS 600×600 dpi | RP4 | RP4 | RP4 |

POSITIONAL ERROR OF ±10 μm

| RECORDING MODE | TEMPERATURE & HUMIDITY | | |
|---|---|---|---|
| | LOW TEMPERATURE & HUMIDITY | ROOM TEMPERATURE & HUMIDITY | HIGH TEMPERATURE & HUMIDITY |
| 1-PASS 300×300 dpi | RP3 | RP3 | RP1 |
| 1-PASS 600×300 dpi | RP3 | RP3 | RP1 |
| 1-PASS 600×600 dpi | RP3 | RP3 | RP1 |
| 2-PASS 600×600 dpi | RP4 | RP4 | RP3 |

POSITIONAL ERROR OF +10 TO +30 μm

| RECORDING MODE | TEMPERATURE & HUMIDITY | | |
|---|---|---|---|
| | LOW TEMPERATURE & HUMIDITY | ROOM TEMPERATURE & HUMIDITY | HIGH TEMPERATURE & HUMIDITY |
| 1-PASS 300×300 dpi | RP2 | RP2 | RP1 |
| 1-PASS 600×300 dpi | RP2 | RP2 | RP1 |
| 1-PASS 600×600 dpi | RP2 | RP2 | RP1 |
| 2-PASS 600×600 dpi | RP4 | RP4 | RP3 |

IMAGE FORMING APPARATUS, IMAGE FORMING METHOD AND COMPUTER-READABLE STORAGE MEDIUM

CROSS REFERENCE TO RELATED APPLICATIONS

This application claims the benefit of Japanese Patent Applications No. 2009-008050 filed on Jan. 16, 2009, No. 2009-252186 filed on Nov. 2, 2009, and No. 2010-004552 filed on Jan. 13, 2010, in the Japanese Patent Office, the disclosures of which are hereby incorporated by reference.

BACKGROUND OF THE INVENTION

1. Field of the Invention

The present invention relates to image forming apparatuses, image forming methods and computer-readable storage media for forming images according to the ink-jet recording technique.

2. Description of the Related Art

The ink-jet recording technique enables a high-speed recording on the so-called plain paper without requiring a special fixing process, and the noise generated during the recording is negligibly low. Hence, the ink-jet recording technique is suited for office use. In addition, various systems employing the ink-jet recording technique have been proposed and reduced to practice. The ink-jet recording technique typically uses an ink chamber and a recording head having a nozzle communicating with the ink chamber. By applying pressure on the ink within the ink chamber depending on image information, ink drops are jetted from the nozzle onto a recording medium such as paper and film, to form an image of the image information on the recording medium.

An image forming apparatus employing the ink-jet recording technique, such as an ink-jet printer, can record images on various kinds of recording media because the image is formed by jetting the ink from the recording head onto the recording medium without requiring the recording head to make contact with the recording medium. The ink-jet printers in general can be categorized into a serial type and a line type.

The serial type ink-jet printer forms the image by causing a recording head to reciprocate in a main scan direction which is perpendicular to a sub scan direction or a medium transport direction in which the recording medium is transported. On the other hand, the line type ink-jet printer has recording heads that are fixedly arranged along approximately the entire width of the recording medium. However, both the serial type ink-jet printer and the line type ink-jet printer have a common problem to be solved, namely, lines, unevenness or blur that may appear in the image that is formed on the recording medium.

Because the serial type ink-jet printer forms the image on the recording medium while transporting the recording medium, lines, unevenness or blur may be generated in the image at a joint of the scans due to causes such as an error in the transport of the recording medium and a tilt in the recording head. In addition, the serial ink-jet printer may have an elongated recording head structure in which a plurality of recording heads are connected in order to increase the printing speed. In the serial ink-jet printer having the elongated recording head structure, the lines, unevenness or blur may be generated in the image at a joint of the recording heads due to a positional error caused by a mounting or assembling error. The positional error at the joint of the recording heads is fixedly determined by the precision with which the recording heads are mounted or assembled, and the lines, unevenness or blur generated in the image cause a serious problem because it is difficult to adjust and minimize the positional error after the recording heads are mounted or assembled.

The line type ink-jet printer has the recording heads that are connected and fixedly arranged along approximately the entire width of the recording medium. Because the recording heads are fixed, the image formation on the recording medium is completed in one head scan, and the so-called 1-pass (or 1-scan) recording is performed. For this reason, the lines, unevenness or blur generated in the image cause an even more serious problem in the case of the line type ink-jet printer since the lines, unevenness or blur generated in the image cannot be reduced by a measure such as performing the head scan a plurality of times.

The lines, unevenness or blur generated in the image at the joint of the scans and the lines, unevenness or blur generated in the image at the joint of the recording heads are basically the same. For this reason, the lines, unevenness or blur generated in the image at the joint of the scans and at the joint of the recording heads will hereinafter simply referred to as the lines, unevenness or blur generated in the image at the "joint". There is a proposed technique that reduces the lines, unevenness or blur generated in the image at the joint by overlapping the nozzles. More particularly, this proposed technique overlaps the nozzles at ends of the recording head structure and forms overlapping dots (or pixels) by a plurality of recording heads, in order to reduce the lines, unevenness or blur generated in the image by increasing or decreasing the dot recording density.

For example, a Japanese Laid-Open Patent Publication No. 2006-240043 proposes a method of determining the nozzles from which the ink is to be jetted in an overlapping region of the nozzles, based on a random number.

According to the proposed method described above, it is possible to reduce the lines, unevenness or blur generated in the image within the overlapping region. However, because the nozzles from which the ink is to be jetted in the overlapping region is determined based on the random number, a state where the dots are continuously formed by the nozzles and a state where the dots are not continuously formed by the nozzles coexist. For this reason, a driving frequency of a signal driving a driving part of the nozzles in a non-overlapping region where the dots are continuously formed becomes different from that in the overlapping region where the dots are not continuously formed. For example, in the case of a solid printing that prints the dots at all pixel positions of the image to be printed, the driving frequency may be 20 kHz in the non-overlapping region where the dots are continuously formed, while the driving frequency may be 10 kHz in the overlapping region where the dots are not continuously formed.

But the state of the ink surface within the recording head at each of the nozzles, that is, the meniscus surface of the nozzles, is affected by the driving frequency, and the amount of ink drops jetted from the nozzles and the landing positions of the ink drops on the recording medium deviate depending on the driving frequency due to the vibration state of the ink surface that differs depending on the driving frequency. In this specification, such deviations in the amount of ink drops jetted and the landing positions of the ink drops will be referred to as "deviations in the ink drops". Furthermore, characteristics of the recording head having the meniscus surface of the nozzles affected by the driving frequency, that cause the deviations in the ink drops, will be referred to as "frequency characteristics of the recording head". Consequently, a banding may occur in the overlapping region due to the deviations in the ink drops jetted in the overlapping region caused by the driving frequency which differs between the non-overlapping region and the overlapping region, that is, caused by the frequency characteristics of the recording head.

SUMMARY OF THE INVENTION

Accordingly, it is a general object of the present invention to provide a novel and useful image forming apparatus, image forming method and computer-readable storage medium, in which the problems described above are suppressed.

Another and more specific object of the present invention is to provide an image forming apparatus, an image forming method and a computer-readable storage medium, which suppresses a banding, including a banding that occurs in an overlapping region. The banding may be suppressed by reducing a difference of the head driving frequencies between the overlapping region in which each dot is recorded by a single scan of multiple nozzles or by multiple scans of one or more nozzles and a non-overlapping region in which each dot is recorded by a single scan of a single nozzle, in order to reduce the deviations in the ink drops jetted in the overlapping region caused by the frequency characteristic of the recording head.

According to one aspect of the present invention, there is provided an image forming apparatus comprising a recording head, including a first group of nozzles arranged in a first direction and a second group of nozzles arranged in the first direction and provided adjacent to the first group of nozzles in a second direction that is perpendicular to the first direction, and configured to record dots on a recording medium by jetting ink drops thereon from the nozzles; and a print control unit configured to control a relative scan of the recording head with respect to the recording medium in the second direction so that a first non-overlapping region on the recording medium is scanned by at least one first nozzle of the first nozzle group, an overlapping region on the recording medium is scanned by at least one second nozzle of the first nozzle group, other than the first nozzle, and at least one third nozzle of the second nozzle group, and a second non-overlapping region on the recording medium is scanned by at least one fourth nozzle of the second nozzle group, other than the third nozzle, wherein a recording density of the dots and a number of consecutive dots recorded by the at least one second nozzle in the second direction within the overlapping region in a vicinity of a first boundary between the overlapping region and the first non-overlapping region, and a recording density of the dots and a number of consecutive dots recorded by the at least one third nozzle in the second direction within the overlapping region in a vicinity of a second boundary between the overlapping region and the second non-overlapping region are smaller than those at other portions within the overlapping region.

According to one aspect of the present invention, there is provided an image forming method for recording dots on a recording medium using a recording head, including a first group of nozzles arranged in a first direction and a second group of nozzles arranged in the first direction and provided adjacent to the first group of nozzles in a second direction that is perpendicular to the first direction, and configured to record dots on a recording medium by jetting ink drops thereon from the nozzles, the image forming method comprising controlling a relative scan of the recording head with respect to the recording medium in the second direction so that a first non-overlapping region on the recording medium is scanned by at least one first nozzle of the first nozzle group, an overlapping region on the recording medium is scanned by at least one second nozzle of the first nozzle group, other than the first nozzle, and at least one third nozzle of the second nozzle group, and a second non-overlapping region on the recording medium is scanned by at least one fourth nozzle of the second nozzle group, other than the third nozzle; and determining a recording density of the dots and a number of consecutive dots recorded by the at least one second nozzle in the second direction within the overlapping region in a vicinity of a first boundary between the overlapping region and the first non-overlapping region, and a recording density of the dots and a number of consecutive dots recorded by the at least one third nozzle in the second direction within the overlapping region in a vicinity of a second boundary between the overlapping region and the second non-overlapping region to be smaller than those at other portions within the overlapping region.

According to one aspect of the present invention, there is provided a computer-readable storage medium that stores a program which, when executed by a computer, causes the computer to record dots on a recording medium using a recording head, including a first group of nozzles arranged in a first direction and a second group of nozzles arranged in the first direction and provided adjacent to the first group of nozzles in a second direction that is perpendicular to the first direction, and configured to record dots on a recording medium by jetting ink drops thereon from the nozzles, the program comprising a controlling procedure causing the computer to control a relative scan of the recording head with respect to the recording medium in the second direction so that a first non-overlapping region on the recording medium is scanned by at least one first nozzle of the first nozzle group, an overlapping region on the recording medium is scanned by at least one second nozzle of the first nozzle group, other than the first nozzle, and at least one third nozzle of the second nozzle group, and a second non-overlapping region on the recording medium is scanned by at least one fourth nozzle of the second nozzle group, other than the third nozzle; and a determining procedure causing the computer to determine a recording density of the dots and a number of consecutive dots recorded by the at least one second nozzle in the second direction within the overlapping region in a vicinity of a first boundary between the overlapping region and the first non-overlapping region, and a recording density of the dots and a number of consecutive dots recorded by the at least one third nozzle in the second direction within the overlapping region in a vicinity of a second boundary between the overlapping region and the second non-overlapping region to be smaller than those at other portions within the overlapping region.

Other objects and further features of the present invention will be apparent from the following detailed description when read in conjunction with the accompanying drawings.

BRIEF DESCRIPTION OF THE DRAWINGS

FIGS. 31A through 31C are diagrams illustrating examples of the switching of the overlap process depending on various conditions;

DESCRIPTION OF THE PREFERRED EMBODIMENTS

Figure 1:
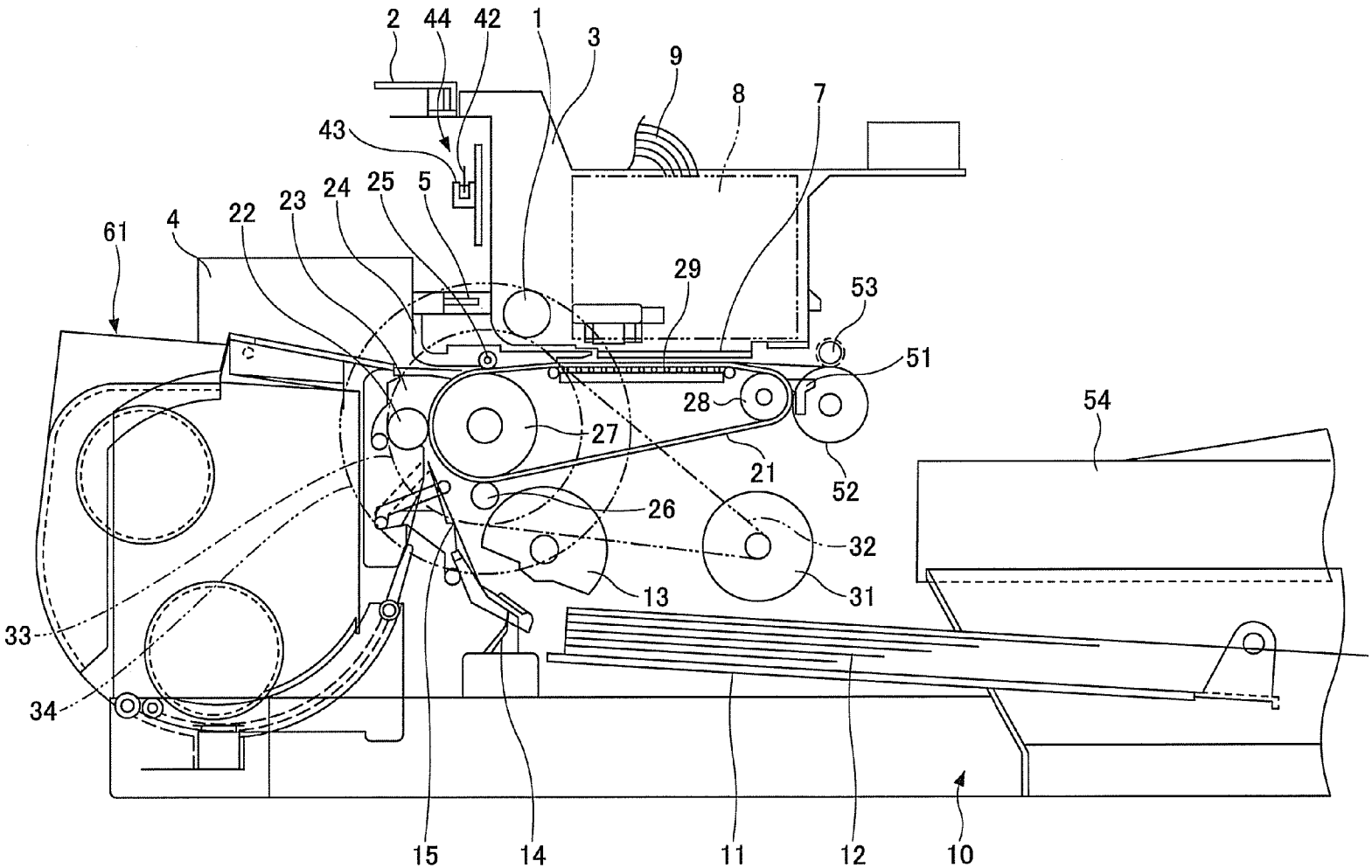
FIG. 1 is a side view illustrating a structure of an image forming apparatus in a first embodiment of the present invention.

A description will be given of embodiments of an image forming apparatus, an image forming method and a computer-readable storage medium according to the present invention, by referring to the drawings.

The image forming apparatus is not limited to a printer, and may be selected from various apparatus that form images on a recording medium by the ink-jet recording, such as a copying machine, a facsimile machine, and a Multi-Function Peripheral (MFP) which includes at least two functions of a group of functions including a printing function, a copying function, and a facsimile function.

First Embodiment

Figure 2:
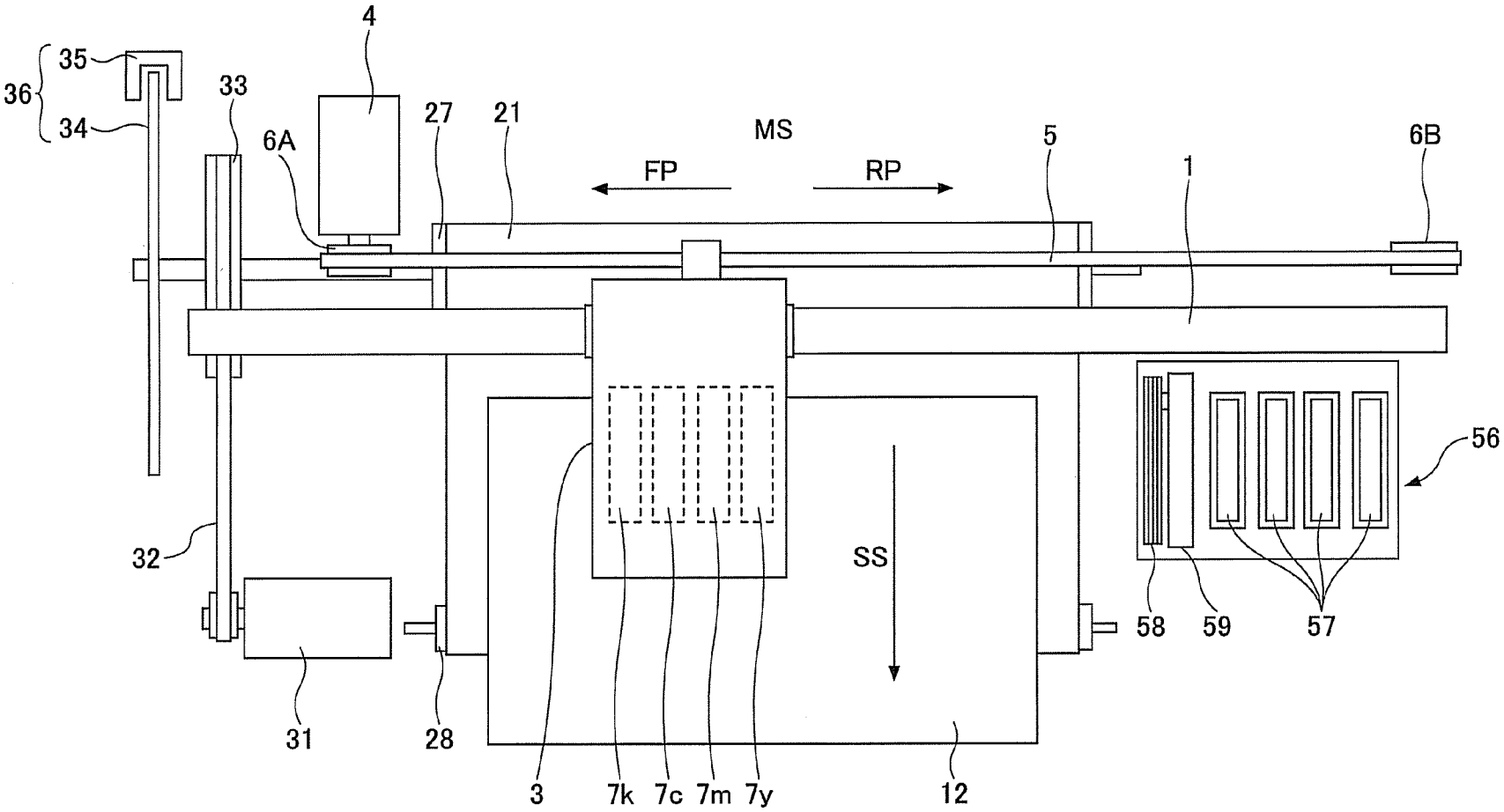
FIG. 2 is a plan view illustrating a structure of the image forming apparatus in the first embodiment of the present invention.

FIG. 1 is a side view illustrating a structure of an image forming apparatus in a first embodiment of the present invention, and FIG. 2 is a plan view illustrating a structure of the image forming apparatus. The image forming apparatus includes a guide rod 1 and a guide rail 2, which form guide members, and are provided across right and left side plates (not illustrated). A carriage 3 is slidably supported by the guide rod 1 and the guide rail 2, and is free to slide in a main scan direction MS. The carriage 3 is driven by a main scan motor 4 via a timing belt 5 that is provided across a driving pulley 6A and a following pulley 6B, and moves and scans in the main scan direction MS in a forward path FP or a reverse path RP. The main scan motor 4, the timing belt 5, and the pulleys 6A and 6B form a recording head scan part (or recording head scan means).

Four recording heads 7*y*, 7*c*, 7*m* and 7*k*, respectively formed by ink-jet heads having nozzles for jetting yellow (Y), cyan (C), magenta (M) and black (K) ink drops, are provided on the carriage 3 so that the nozzles face downwards in FIG. 1 and the nozzles of each of the recording heads 7*y*, 7*c*, 7*m* and 7*k* are arranged in a direction perpendicular to the main scan direction MS in FIG. 2. When not referring to the jetting of the ink of a specific color, each of the recording heads 7*y*, 7*c*, 7*m* and 7*k* will simply be referred to as a recording head 7. A sub-tank 8 is provided on the carriage 3 with respect to each of the Y, C, M and K inks. The ink of a corresponding color is supplied from a main tank (or ink cartridge, not illustrated) to the sub-tank 8 via an ink supply tube 9.

The ink-jet head forming the recording head 7 includes a pressure generating part (or pressure generating means) that generates a pressure for causing the ink to be jetted from the nozzles. For example, the pressure generating part may be selected from a piezoelectric actuator, a thermal actuator, a shape memory alloy actuator, and an electrostatic actuator. The piezoelectric actuator includes a piezoelectric element or the like. The thermal actuator includes an electro-thermal element, such as a heating resistor, that uses a phase change caused by film boiling of a liquid. The shape memory alloy actuator uses a metal phase change caused by a temperature change. The electrostatic actuator uses electrostatic force. The recording head 7 does not necessarily require a recording head structure that is separate for each color. For example, the recording head 7 may be formed by one or a plurality of ink-jet heads having a row or column of nozzles for jetting inks of a plurality of colors.

In the image forming apparatus and the image forming method of the embodiment described in this specification, "distributing dot pattern", which will be described later, refers to the distribution of dots to be recorded by each of the nozzles onto a recording medium such as paper, based on the print data. In a case of a printing method that performs the scan a plurality of times to print the image on the recording medium, "distributing dot pattern" includes segmenting (or dividing) the print data for each scan and distributing the dots to be recorded by each of the nozzles for each scan.

A medium supply part supplies recording media 12, such as paper, stacked on a medium stacking part 11 of a medium supply cassette 10. The medium supply part includes a semi-circular roller (or medium supply roller) 13 for separating each recording medium 12, one by one, from the recording media 12 stacked on the medium stacking part 11, and a separation pad 14 that is made of a material having a relatively large coefficient of friction and is arranged to confront the medium supply roller 13. The separation pad 14 is urged towards the medium supply roller 13 by a spring mechanism (not illustrated) or the like.

The recording medium 12 supplied from the medium supply part is transported under the recording head 7 by a transport part (or transport means). The transport part includes a transport belt 21, a counter roller 22, a transport guide 23, and a roller 25. The transport belt 21 transports the recording medium 12 that is electrostatically adhered thereon, and the counter roller 22 transports the recording medium 12 that is supplied from the medium supply part via a guide 15 between the counter roller 22 and the transport belt 21. The transport guide 23 guides the recording medium 12 that is supplied upwards approximately in a vertical direction in FIG. 1 towards a horizontal path of the transport belt 21 by turning the recording medium 12 approximately 90 degrees. The roller 25 is urged towards the transport belt 21 by a pushing member 24. A charging roller 26 forms a charging unit (or charging means) for charging the surface of the transport belt 21.

The transport belt 21 is formed by an endless belt that revolves around a transport roller 27 and a tension roller 28. A sub scan motor 31 turns the transport roller 27 via a timing belt 32 and a timing roller 33, so that the transport belt 21 revolves in a belt transport direction or a sub scan direction SS in FIG. 2. A guide member 29 is provided on a back side (or back surface) of the transport belt 21 in correspondence with an image forming region of the recording head 7. In addition, the charging roller 26 makes contact with the front side (or front surface) of the transport belt 21 and is rotated as the transport belt 21 revolves.

As illustrated in FIG. 2, a multi-slit disk 34 having slits is mounted on a shaft of the transport roller 27, and a sensor 35 detects the slits of the multi-slit disk 34. A rotary encoder 36 is formed by the multi-slit disk 34 and the sensor 35.

A medium eject part ejects the recording medium 12 that has been recorded by the recording head 7. The medium eject part includes a separation claw 51 for separating the recording medium 12 from the transport belt 21, eject rollers 52 and 53, and an eject tray 54 on which the ejected recording media 12 are stacked.

A duplex unit 61 may be detachably provided on a rear side of the carriage 3. The duplex unit 61 may turn over the side of the recording medium 12 that is supplied thereto when the transport belt 21 revolves in a reverse direction, and supply the reversed recording medium 12 between the counter roller 22 and the transport belt 21.

As illustrated in FIG. 2, a recovery mechanism 56 is provided in a non-printing region on one side of the carriage 3 along the main scan direction MS. The recovery mechanism 56 performs a recovery operation to maintain the printing state of the nozzles of the recording head 7.

The recovery mechanism 56 includes caps 57 for capping the nozzle surfaces of the recording head 7, a wiper blade (or blade member) 58 for wiping the nozzle surfaces, and a receiving part 59 for receiving the ink drops jetted from the nozzles when a blank or dummy jetting operation that does not contribute to the actual printing is performed to jet the ink drops in order to clear the passages of the nozzles which may be clogged by the ink with an increased viscosity.

According to the image forming apparatus having the above described structure, the recording medium 12 is supplied upwards, one by one, approximately in a vertical direction in FIG. 1 from the medium supply part, and is guided by the guide 15. The recording medium 12 is then transported between the transport belt 21 and the counter roller 22, and the leading (or tip) end of the recording medium 12 is guided by the transport guide 23. Further, the recording medium 21 is pushed against the transport belt 21 by the roller 25 and the transport direction of the recording medium 12 is turned approximately 90 degrees. In this state, a controller (not illustrated) performs a control to apply an AC voltage, that is a repetition of positive and negative voltages that alternately appear, to the charging roller 26 from an AC bias supply part (not illustrated). Hence, the front surface of the transport belt 21 is charged to a repetition pattern in which positive and negative charges alternately appear with a predetermined width in the sub scan direction SS. When the recording medium 12 is supplied onto the charged transport belt 21, the recording medium 12 is adhered on the transport belt 21 by electrostatic force. As a result, the recording medium 12 on the transport belt 21 is transported in the sub scan direction SS as the transport belt 21 revolves.

By driving the recording head 7 depending on the print data while moving the carriage in the forward path FP and the reverse path RP along the main scan direction MS, one line is recorded on the stationary recording medium 12 by the ink drops jetted from the nozzles of the recording head 7. The next line is recorded on the recording medium 12 after transporting the recording medium 12 a predetermined amount in the sub scan direction SS. When a recording end signal or, a signal indicating that a trailing end of the recording medium 12 has reached the recording region is received, the recording operation is ended and the recording medium 12 is ejected onto the eject tray 54.

In the case of the duplex printing, the revolving direction of the transport belt 21 is reversed after the recording of the first side of the recording medium 12 ends, in order to supply this recording medium 12 to the duplex unit 61. The duplex unit 61 turns over the side of the recording medium 12 that is supplied thereto, and supplies the reversed recording medium 12 between the counter roller 22 and the transport belt 21. The reversed recording medium 12 is transported on the transport belt 21, the recording is made on the second side (opposite to the first side) of the recording medium 12, and the recording medium 12 is ejected onto the eject tray 54, at suitably controlled timings.

In a print (or recording) standby state, for example, the carriage 3 is moved to the position of the recovery mechanism 55, so that the nozzle surfaces of the recording head 7 are capped by the cap 57. Hence, the nozzles of the recording head 7 can be maintained in a wet state so that the nozzles will not be clogged by dried ink. A recovery operation sucks the ink from the nozzles of the recording head 7 in the state where the nozzles are capped by the cap 57, in order to remove the ink with the increased viscosity or air bubbles in the ink. The ink that adheres on the nozzle surface as a result of this recovery operation is removed by the wiper blade 58 which cleans the nozzle surface. In addition, the blank or dummy jetting operation that does not contribute to the actual printing may be performed before the start of the recording or during the recording, in order to jet the ink drops and clear the passages of the nozzles which may be clogged by the ink with the increased viscosity. Therefore, the ink jetting performance of the recording head 7 can be maintained by the operation of the recovery operation and the blank or dummy jetting operation.

Figure 3:
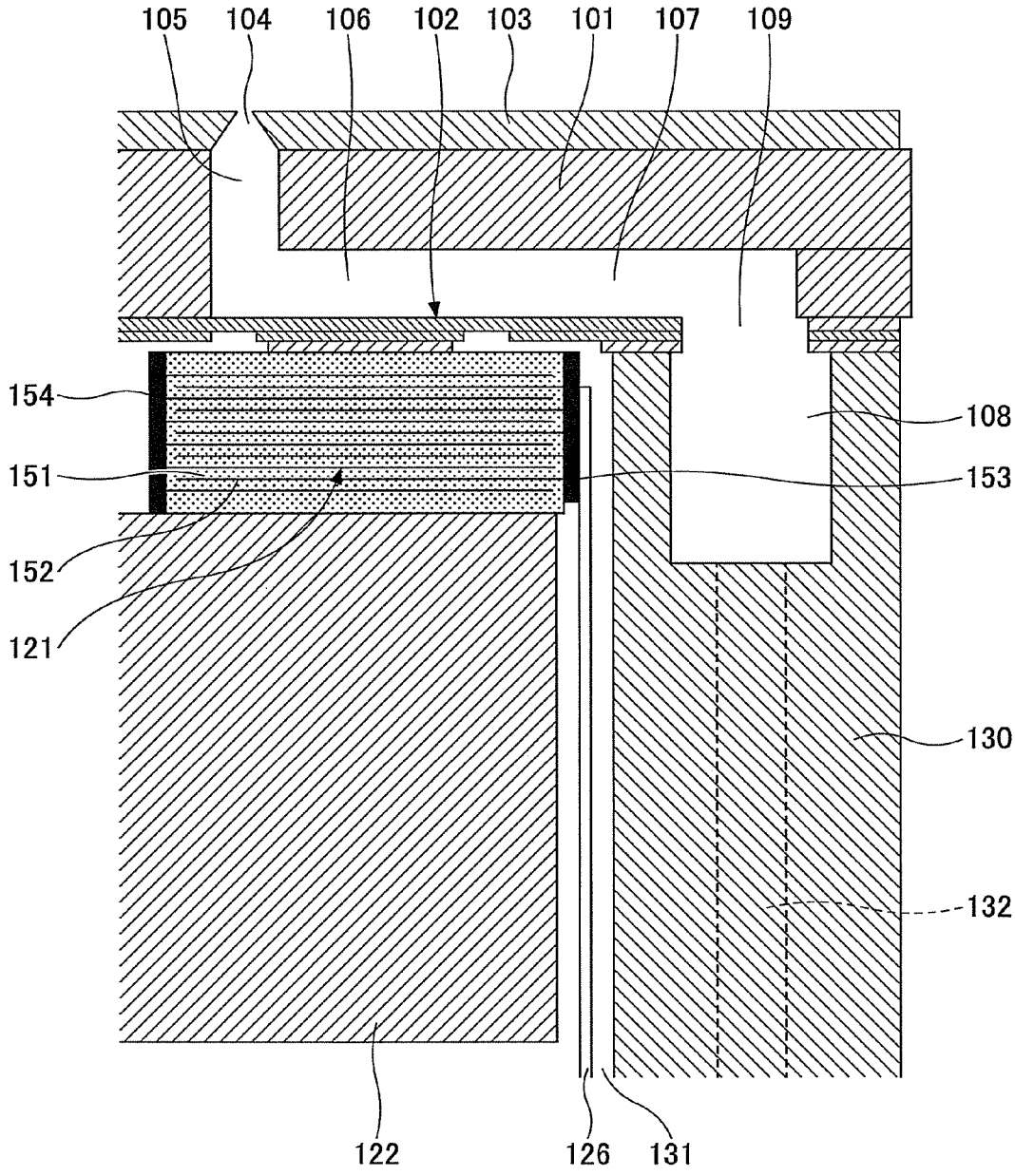
FIG. 3 is a cross sectional view illustrating an example of a recording head of the image forming apparatus along a longitudinal direction of an ink chamber.
Figure 4:
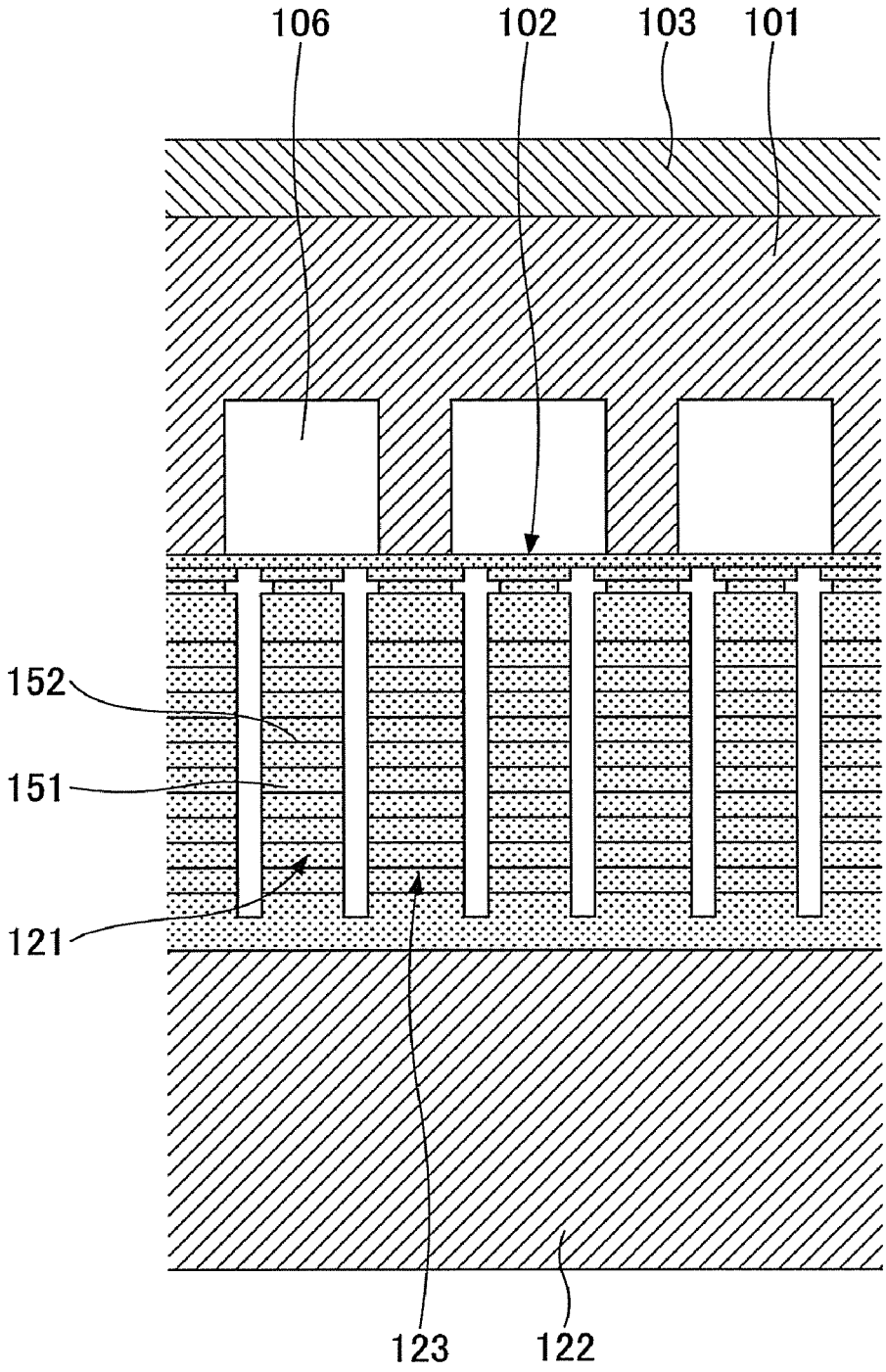
FIG. 4 is a cross sectional view illustrating the example of the recording head of the image forming apparatus along a direction perpendicular to the longitudinal direction of the ink chamber.

Next, a description will be given of an example of the ink-jet head forming the recording head 7, by referring to FIGS. 3 and 4. FIG. 3 is a cross sectional view illustrating an example of the ink-jet head along a longitudinal direction of an ink chamber, and FIG. 4 is a cross sectional view illustrating this ink-jet head along a direction perpendicular to the longitudinal direction of the ink chamber, that is, in a direction in which the nozzles of the recording head 7 are arranged.

The ink-jet head includes a flow passage plate 101 that is formed by subjecting a single-crystal silicon substrate to an anisotropic etching, for example. A vibration plate 102 that is formed by nickel electroforming, for example, is bonded to a lower surface of the flow passage plate 101. A nozzle plate 103 is bonded to an upper surface of the flow passage plate 101. The ink-jet head further includes a nozzle 104 for jetting ink drops, a nozzle communicating passage 105 that communicates to the nozzle 104, an ink chamber 106, a fluid resistance part (or supply path) 107, a common ink chamber 108, and an ink supply port 109. The ink chamber 106 forms a pressure generating chamber, and communicates to the nozzle 104 via the nozzle communication passage 105. The ink supply port 109 communicates to the common ink chamber 108 that supplies the ink to the ink chamber 106 via the fluid resistance part 107.

Two columns of stacked piezoelectric elements 121 are provided as electromechanical transducer elements forming the pressure generating part (or actuator) for applying pressure on the ink within the ink chamber 106 by deforming the vibration plate 102. The piezoelectric elements 121 are fixedly bonded on a base substrate 122. A column part 123 is provided between the two columns of piezoelectric elements 121. The column part 123 is formed simultaneously as the piezoelectric elements 121 by processing the piezoelectric element member in segments or division, but no driving voltage is applied to the column part 123.

A Flexible Printed Circuit (FPC) cable 126 mounted with a driving circuit (or integrated circuit (IC), not illustrated) is connected to the piezoelectric elements 121.

A peripheral edge part of the vibration plate 102 is connected to a frame member 130. A penetration part 131 for accommodating the actuator unit formed by the piezoelectric elements 121 and the base substrate 122, a recess which forms the common ink chamber 108, and an ink supply hole 132 for supplying the ink to the common ink chamber 108 from the outside are formed in the frame member 130. For example, the frame member 130 is formed by injection molding from a thermosetting resin such as epoxy resins or, polyphenylene sulfide (PPS).

For example, recess and hole parts that form the nozzle communicating passage 105 and the ink chamber 106 may be formed in the flow passage plate 101 by subjecting a single-crystal silicon substrate with a (110) crystal orientation to an anisotropic etching using an alkaline etchant such as potassium hydroxide (KOH) solution. Of course, the flow passage plate 101 is not limited to the single-crystal silicon substrate, and other materials such as stainless and photosensitive resin may be used for the substrate forming the flow passage plate 101.

The vibration plate 102 may be formed by a metal plate made of nickel, for example. The vibration plate 102 may be formed by electroforming. Of course, the vibration plate 102 may be formed by other metal plates or a bonded member made up of metal and resin plates. The piezoelectric elements 121 and the column part 123 are bonded to the vibration plate 102 using an adhesive, and the frame member 130 is bonded to the vibration plate 102 using an adhesive.

The nozzle 104 is formed in the nozzle plate 103 to a diameter of 10 μm to 30 μm depending on each ink chamber 106, and the nozzle plate 103 is bonded to the flow passage plate 101 using an adhesive. The nozzle plate 103 may be formed by a nozzle forming metal member having a water-repellant top layer (uppermost layer) formed thereon via a suitable layer.

The piezoelectric element 121 in this example is formed by a lead zirconate titanate (PZT) stacked piezoelectric element having piezoelectric layers 151 and internal electrodes 152 that are alternately stacked. The internal electrodes 152 that are alternately drawn out from opposite end surfaces of the piezoelectric element 121 are respectively connected to an independent electrode 153 and a common electrode 154. In this example, the piezoelectric element 121 is displaced in a vertical direction in FIG. 3 in order to apply the pressure to the ink within the ink chamber 106. However, the piezoelectric element 121 may be displaced in a direction other than the vertical direction in FIG. 3 as long as the pressure can be applied to the ink within the ink chamber 106. Further, it is possible to provide only one column of piezoelectric elements 121 on a single base substrate 122.

In the ink-jet head having the structure described above, the piezoelectric elements 121 contract when the voltage applied thereto is decreased from a reference potential. As a result, the vibration plate 102 is displaced downwards to expand the volume of the ink chamber 106 and allow the ink into the ink chamber 106. When the voltage applied to the piezoelectric elements 121 is increased thereafter to expand the piezoelectric elements 121 in the direction in which the piezoelectric elements 121 are stacked, the vibration plate 102 is displaced upwards towards the nozzle 104 and contract the volume of the ink chamber 106. Consequently, a pressure is applied to the ink within the ink chamber 106, and the ink drop is jetted from the nozzle 104.

By returning the voltage applied to the piezoelectric elements 121 back to the reference potential, the vibration plate 102 is restored to its initial position, and the ink chamber 106 expands to generate a negative pressure therein. In this state, the ink is supplied to the ink chamber 106 from the common ink chamber 108. The next ink-jet operation is started after the vibration of a meniscus surface of the nozzle 104 stabilizes through damping.

The method of driving the ink-jet head is of course not limited to the contract-and-expand (or pull-and-push) method based on the potential of the voltage applied to the piezoelectric elements 121. For example, the ink-jet head may be driven by the contract-and-expand method based on waveforms of the voltage applied to the piezoelectric elements 121.

Figure 5:
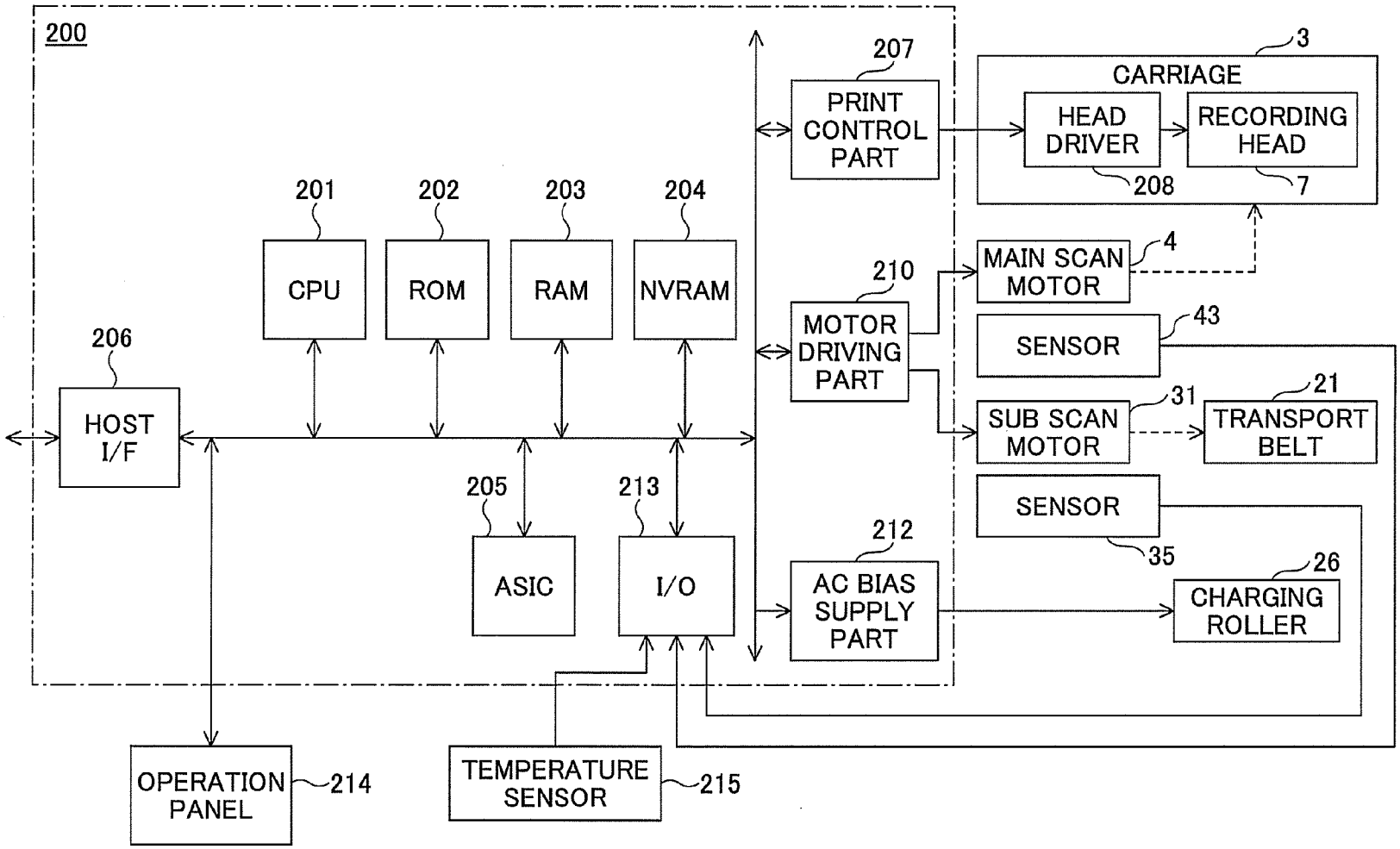
FIG. 5 is a block diagram illustrating a print control unit of the image forming apparatus.

Next, a description will be given of a print control unit (or print control means) of the image forming apparatus, by referring to FIG. 5. FIG. 5 is a block diagram illustrating the print control unit of the image forming apparatus.

A print control unit 200 includes a Central Processing Unit (CPU) 201, a Read Only Memory (ROM) 202, a Random Access Memory (RAM) 203, a Non-Volatile RAM (NVRAM) 204, an Application Specific Integrated Circuit (ASIC) 205, a host interface (I/F) 206, a print control part 207, a motor driving part 210, an AC bias supply part 212, and an input and output (I/O) part 213 that are connected as illustrated in FIG. 5. Of course, the CPU 201 may be replaced by any suitable processor or processing unit forming a computer, such as a Micro Processing Unit (MPU).

The CPU 201 controls the operation of the entire image forming apparatus. The ROM 202 stores programs to be executed by the CPU 201 and various data including fixed data. The RAM 203 temporarily stores various data including print data. The NVRAM 204 is a rewritable memory that can store various data even while the power of the image forming apparatus is turned OFF. The ASIC 205 is configured to perform various processes or functions, including various signal processing with respect to the print data, image processing to rearrange print data, and input and output signal processing to control the entire image forming apparatus.

The host I/F 206 exchanges various data and signals between the print control unit 200 and a host unit (not illustrated). The print control part 207 includes a data transfer part (or data transfer means) for driving and controlling the recording head 7, and a waveform generating part (or waveform generating means) for generating a driving waveform. The print control part 207 drives the recording head 7 via a head driver 208 of the carriage 3. The motor driving part 210 drives the main scan motor 4 and the sub scan motor 31. The AC bias supply part 212 supplies an AC bias voltage to the charging roller 26. The I/O part 213 receives detection pulses (or detection signals) from the sensor 35, a sensor 43, and a temperature sensor 215 which detects the ambient temperature of the image forming apparatus. The print control unit 200 is connected to an operation panel 214 from which various information may be input to the image forming apparatus by an operator and on which various information of the image forming apparatus may be displayed with respect to the operator.

The host I/F 206 of the print control unit 200 receives the print data and the like from the host unit via a cable or a network. The host unit may be an information processing apparatus such as a personal computer, an image reading apparatus such as an image scanner, an image pickup apparatus such as a digital camera or, an arbitrary combination of such apparatuses.

The CPU 201 of the print control unit 200 reads and analyzes (or interprets) the print data within a reception buffer that is included in the I/F part 206, and controls the ASIC 205 to perform the necessary image processing, the processing to rearrange the data and the like. The processed print data is transferred from the print control part 207 to the head driver 208. As will be described later, the dot pattern based on which the image is recorded on the recording medium may be generated in a printer driver within the host unit.

The print control part 207 transfers the print data to the head driver 208 in the form of serial data, and also outputs to the head driver 208 a transfer clock, a latch signal, a drop control signal (or mask signal) and the like that are required to transfer the print data and to commit the transfer. In addition, the print control part 207 includes a driving waveform generator and a driving waveform selector. The driving waveform generator includes a digital-to-analog converter (DAC) for subjecting pattern data of the driving signal stored in the ROM 202 to a digital-to-analog conversion, a voltage amplifier, a current amplifier and the like. The driving waveform selector selects the driving waveform to be supplied to the head driver 208. The driving waveform generator and the driving waveform selector generate a driving waveform that is formed by a single driving pulse (or driving signal) or, a plurality of driving pulses (or driving signals), and supplies the driving waveform to the head driver 208.

The head driver 208 drives the recording head 7 by selectively applying, to a driving element (for example, the piezoelectric element 121 described above) which generates an energy for jetting the ink drop from the recording head 7, the driving signal forming the driving waveform supplied from the print control part 207 based on the print data amounting to one line of the recording head 7 that is serially input. In this state, it is possible to selectively record dots of different sizes, such as a large dot (or large ink drop), a medium dot (or medium ink drop), and a small dot (or small ink drop) by appropriately selecting the driving pulses forming the driving waveform.

The CPU 201 computes a driving output value (or control value) with respect to the main scan motor 4, based on a velocity detection value and a position detection value that are obtained by sampling the detection pulses from the sensor 43 forming a linear encoder, and a velocity target value and a position target value that are obtained from velocity and position profiles prestored in the ROM 202, for example, and drives the main scan motor 4 via the motor driving part 210 based on the driving output value. Similarly, the CPU 201 computes a driving output value (or control value) with respect to the sub scan motor 31, based on a velocity detection value and a position detection value that are obtained by sampling the detection pulses from the sensor 35 forming the rotary encoder 36, and a velocity target value and a position target value that are obtained from velocity and position profiles prestored in the ROM 202, for example, and drives the sub scan motor 31 via the motor driving part 210 based on the driving output value.

Figure 6:
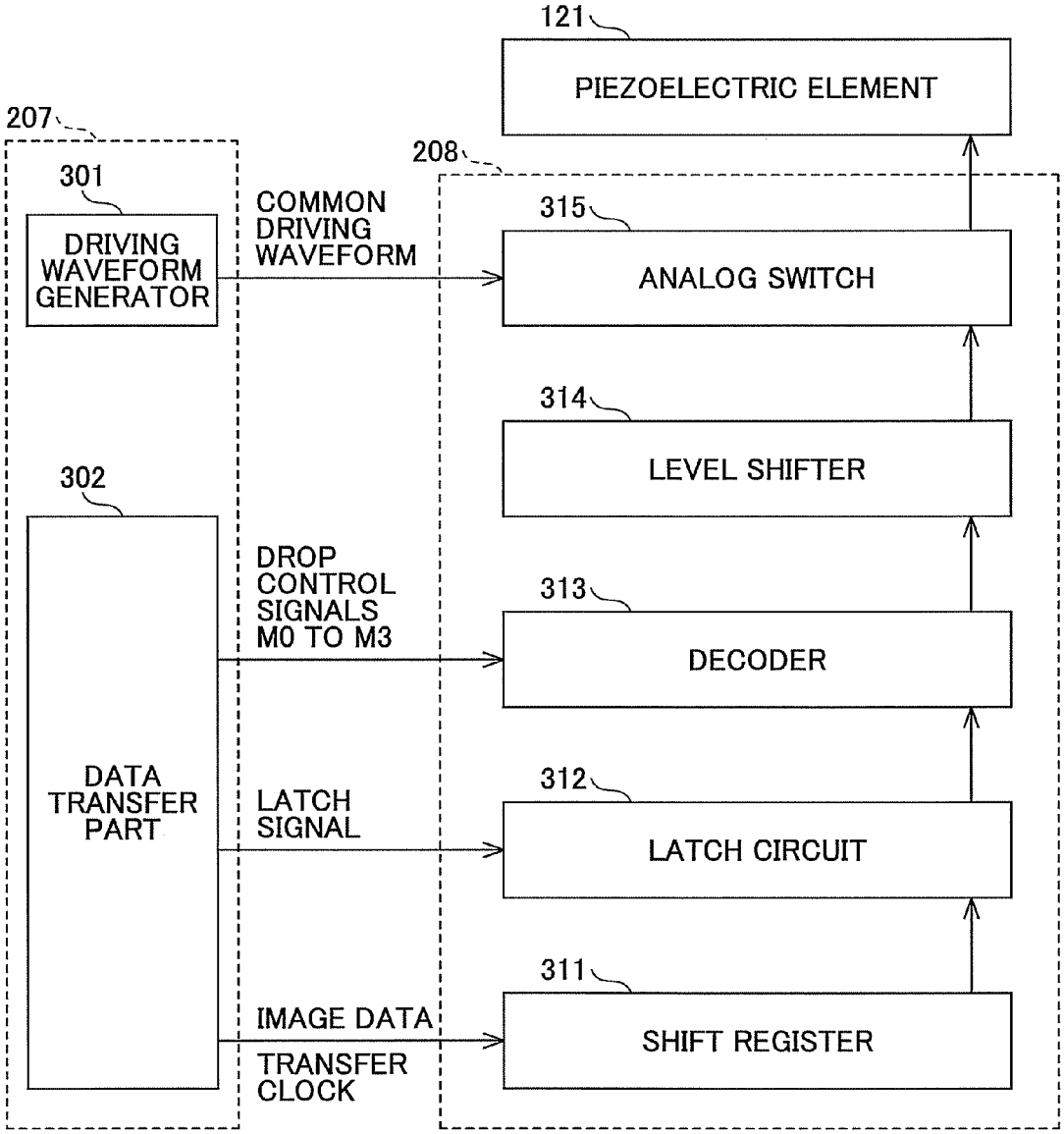
FIG. 6 is a block diagram illustrating an example of a print control part of the print control unit together with a head driver.

Next, a description will be given of the print control part 207 and the head driver 208, by referring to FIG. 6. FIG. 6 is a block diagram illustrating an example of the print control part 207 of the print control unit 200 together with the head driver 208. The print control part 207 includes a driving waveform generator 301 and a data transfer part 302. The driving waveform generator 301 generates and outputs a driving waveform (or common driving waveform) that is formed by a plurality of driving pulses (or driving signals) within one print period. The data transfer part 302 outputs a 2-bit print data (or gradation signals represented by 0 or 1) depending on the image to be recorded (or printed), a transfer clock, a latch signal, and drop control signals M0 through M3.

Each of the drop control signals M0 through M3 is a 2-bit signal that instructs an analog switch (or switch means) 315 of the head driver 208 to turn ON or OFF for every ink drop. Each of the drop control signals M0 through M3 makes a state transition to a high level (or ON state) for the waveform to be selected and a state transition to a low level (or OFF state) for the waveform to be non-selected, in accordance with the print period of the common driving waveform.

The head driver 208 includes a shift register 311, a latch circuit 312, a decoder 313, a level shifter, and the analog switch 315. The shift register 311 receives the transfer clock (or shift clock) and the serial print data (or 2-bit gradation signal) from the data transfer part 302, and shifts the serial print data in response to the transfer clock. The latch circuit 312 latches the output of the shift register 311 in response to the latch signal from the data transfer part 302. The decoder 313 decodes the serial print data (or gradation signal) output from the latch circuit 312 and the drop control signals M0 through M3 output from the data transfer part 302, and outputs a decoded result. The level shifter 314 shifts a logic level voltage signal of the decoder 313 into a level with which the analog switch 315 can operate. The analog switch 315 is tuned ON or OFF depending on the output decoded result of the decoder 313 that is received via the level shifter 314.

The analog switch 315 is connected to the independent electrode 153 of each piezoelectric element 121, and receives the common driving waveform from the driving waveform generator 301. Accordingly, by turning the analog switch 315 ON depending on the decoded result of the decoder 313 that is obtained by decoding the serial print data (gradation signals) and the drop control signals M0 through M3, one of the driving signals forming the common driving waveform is selectively applied to the piezoelectric element 121.

Figure 13:
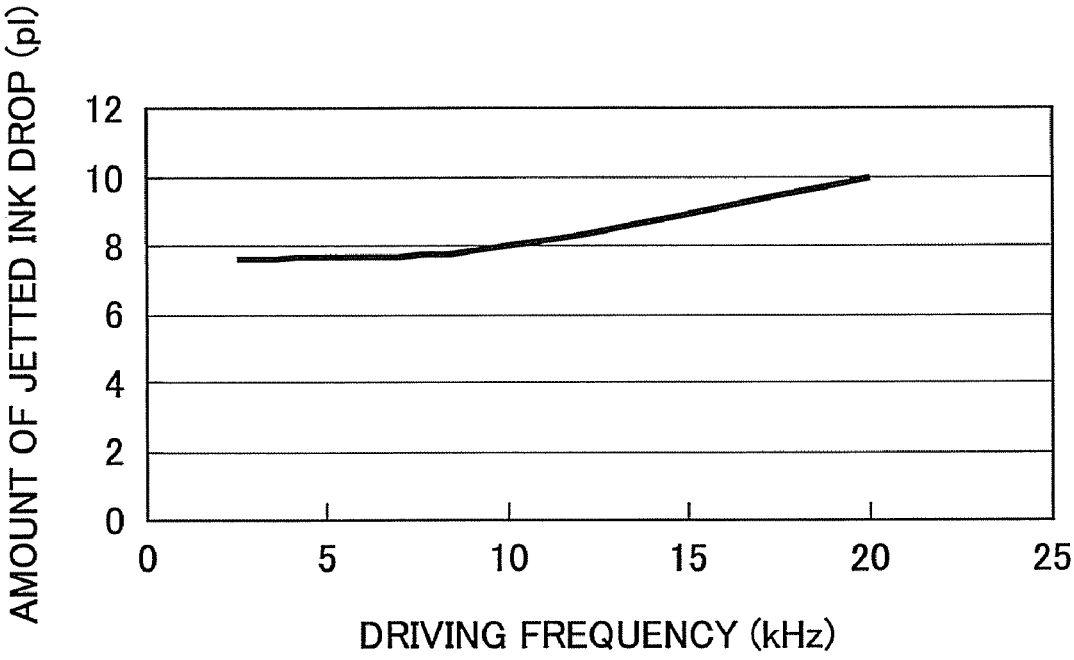
FIG. 13 is a diagram illustrating an amount of jetted ink drop for driving frequencies of 5 kHz to 20 kHz.

Depending on the ink used for the ink-jet recording, the frequency characteristics of the recording head 7 may become as illustrated in FIG. 13 which will be described later. In addition, in the case of quick drying ink, the ink viscosity may vary depending on the amount of moisture evaporation, and thus, the frequency characteristics of the recording head 7 may change depending on the driving frequency of the nozzles.

Figure 7:
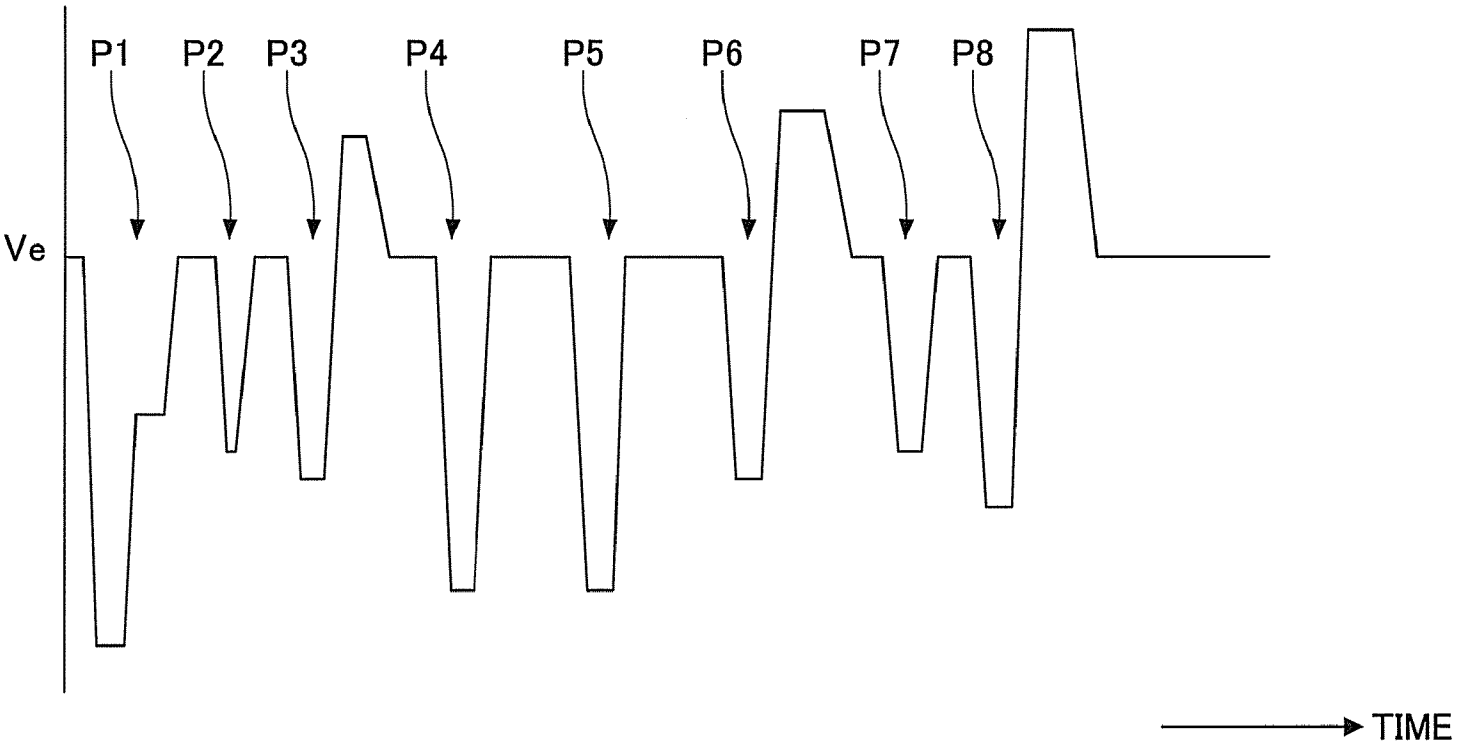
FIG. 7 is a diagram for explaining an example of a driving waveform generated from a driving waveform generator of the print control part.
Figure 8:
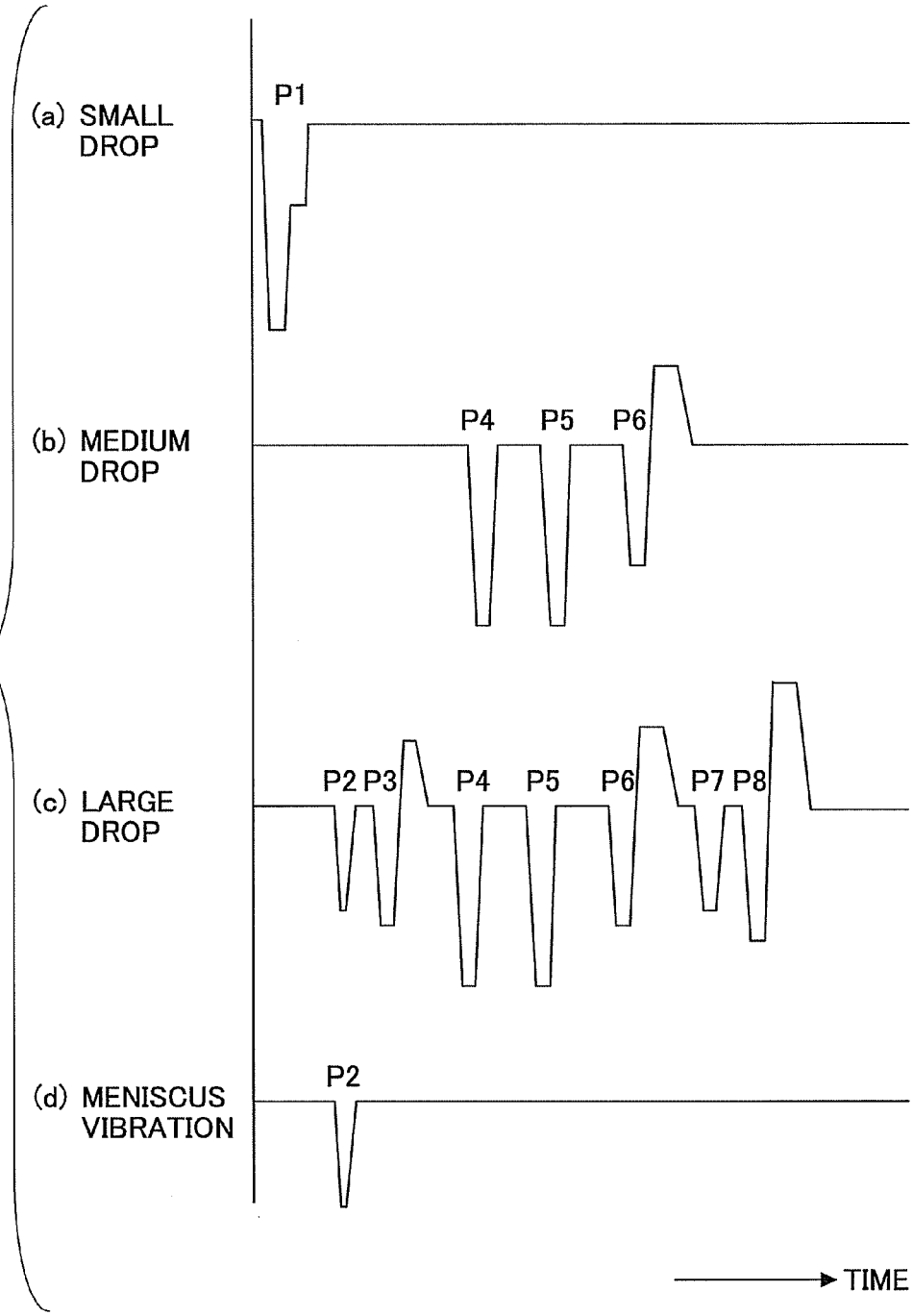
FIGS. 8(*a*) through 8(*d*) are diagrams for explaining driving signals for small, medium and large ink drop drive and an ultra-fine vibration drive selected from the driving waveform.

Next, a description will be given of an example of a preferable driving waveform to be used particularly with the high-viscosity ink, by referring to FIGS. 7 and 8. FIG. 7 is a diagram for explaining an example of the driving waveform generated from the driving waveform generator 301 of the print control part 207. FIGS. 8(*a*) through 8(*d*) are diagrams for explaining driving signals for small, medium and large ink drop drive and an ultra-fine vibration drive selected from the driving waveform.

As illustrated in FIG. 7, the driving waveform generator 301 generates and outputs the driving waveform (or driving signal) formed by 8 driving pulses P1 through P8 in one print period (or one driving period). The driving waveform includes waveform elements that fall from a reference potential Ve, and waveform elements that rise after the fall from the reference potential Ve. On the other hand, the driving pulse to be used is selected depending on the drop control signals M0 through M3 from the data transfer part 302. Since the number of driving pulses within one print period of the driving waveform may vary, the driving frequency does not necessarily depend on the frequency of the driving pulses. In other words, what is required is for one print period of the driving waveform (or driving signal) to include all of the driving pulses to be used to drive the nozzle and record one dot on the recording medium 12 even when the frequency of the driving pulses is at a maximum.

The waveform element of the driving waveform, that falls from the reference potential Ve, forms a pull (or contract) waveform element that causes the piezoelectric element 121 to contract and the volume of the ink chamber 106 to expand. On the other hand, the waveform element of the driving waveform, that rises after the falling from the reference potential Ve, forms a push (or expand) waveform element that causes the piezoelectric element 121 to expand and the volume of the ink chamber 106 to contract.

Based on the drop control signals M0 through M3 from the data transfer part 302, the driving pulse P1 is selected as illustrated in FIG. 8(*a*) when forming the small dot (or small ink drop), the driving pulses 94 through P6 are selected as illustrated in FIG. 8(*b*) when forming the medium dot (or medium ink drop). Further, based on the drop control signals M0 through M3, the driving pulses P2 through P8 are selected as illustrated in FIG. 8(*c*) when forming the large dot (or large ink drop), and the driving pulse P2 is selected as illustrated in FIG. 8(*d*) when not forming a dot (or ink drop) but causing an ultra-fine vibration (or meniscus vibration) that does not cause jetting of the ink. The selected driving pulse or pulses are applied to the piezoelectric element 121 of the recording head 7.

When forming the medium dot, a first ink drop is jetted in response to the driving pulse P4, a second ink drop is jetted in response to the driving pulse P5, and a third ink drop is jetted in response to the driving pulse P6, and the first through third ink drops are combined into a single ink drop during flight. In this state, if a natural vibration period of the ink chamber 106 is denoted by Tc, an interval between the driving pulses P4 and P5 is preferably 2 Tc±0.5 μs. Because the driving pulses P4 and P5 are simple pull (or contract) waveform elements, the ink drop velocity becomes too high if the driving pulse P6 is also formed by a simple pull (or contract) waveform element, and the corresponding third ink drop may not combine with the other first and second ink drops and land at a position deviated from the target position. For this reason, the voltage of the driving pulse P6 is reduced, that is, the potential to which the driving waveform falls is raised, in order to reduce the contraction of the meniscus and suppress the increase of the ink drop velocity of the third ink drop. However, the potential to which the driving waveform rises after the fall is not reduced in order to secure the required ink drop volume.

In other words, amongst the plurality of driving pulses, the voltage of the pull (or expand) waveform element of the last driving pulse is made relatively low, so that the ink drop velocity of the ink drop jetted in response to the last driving pulse is relatively low and the ink drop can appropriately combine with the other ink drops and land at the target position.

The driving pulse P2 causes the ultra-fine vibration (or meniscus vibration) that does not cause jetting of the ink, in order to prevent drying of the meniscus surface of the nozzle 104. The driving pulse P2 is applied to the recording head 7 in the non-printing region. In addition, the driving pulse 92 may be utilized as one of the driving pulses that form the large dot, in order to shorten the driving period.

Furthermore, by setting an interval between the driving pulses P2 and P3 within a range of Tc±0.5 μs, it is possible to efficiently utilize the volume of the ink drop jetted in response to the driving pulse P3. That is, by superimposing the expansion of the ink chamber 106 caused by the driving pulse P3 to the pressure vibration in the ink chamber 106 caused by the driving pulse P2 at the vibration period, it is possible to increase the volume of the ink drop that is jetted in response to the driving pulse P3 as compared to the case where the ink drop is jetted solely in response to the driving pulse P3 and without the driving pulse P2.

Figure 9:
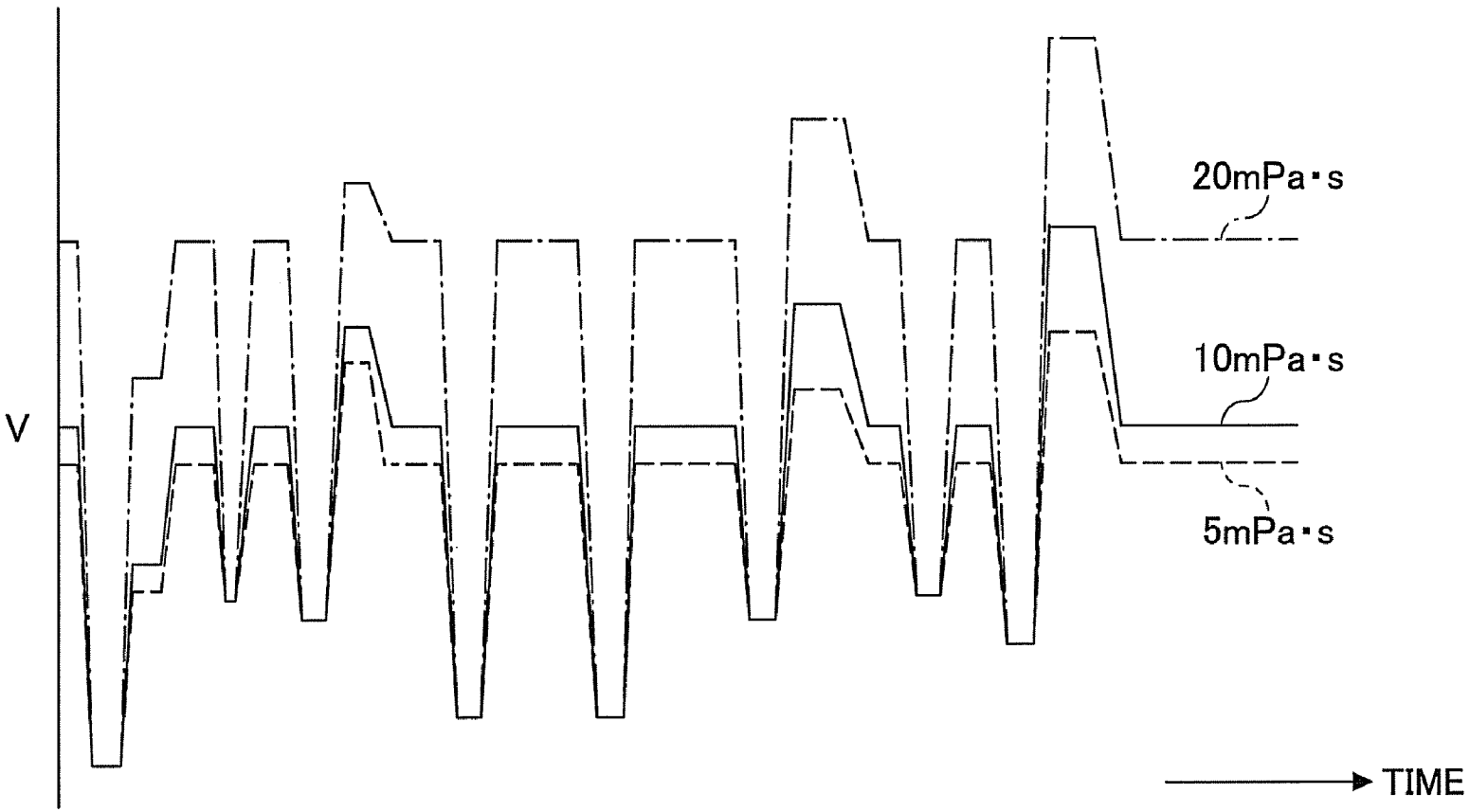
FIG. 9 is a diagram for explaining driving waveforms dependent on ink viscosities.

The required driving waveform may differ depending on the ink viscosity. Hence, the image forming apparatus in this embodiment prepares different driving waveforms for different ink viscosities, and stores the different driving waveforms in the ROM 202, for example. FIG. 9 is a diagram for explaining the driving waveforms dependent on the ink viscosities. In this example, a driving waveform indicated by a dotted line is prepared for the ink viscosity of 5 mPa·s, a driving waveform indicated by a solid line is prepared for the ink viscosity of 10 mPa·s, and a driving waveform indicated by a one-dot chain line is prepared for the ink viscosity of 20 mPa·s. The ink viscosity may be detected from the temperature detected by the temperature sensor 215 illustrated in FIG. 5, and the ink viscosity detection may be performed by the CPU 201, for example. Hence, the driving waveforms for the detected ink viscosity may be read from the ROM 202 depending on the ink viscosity detected by the CPU 201.

Accordingly, by setting the voltage of the driving pulse relatively low when the ink viscosity is relatively low and setting the voltage of the driving pulse relatively high when the ink viscosity is relatively high, the ink drop can be jetted at an approximately constant velocity and an approximately constant volume regardless of the ink viscosity (or temperature). In addition, by selecting the peak value of the driving pulse P2 depending on the ink viscosity, it becomes possible to vibrate the meniscus without jetting the ink drop.

By using the driving waveform formed by the driving pulses described above, it becomes possible to control the time it takes for the large, medium and small ink drops to land on the recording medium 12. Hence, even if the time at which the jetting of the ink drop starts is different among the large, medium and small ink drops, the large, medium and small ink drops can be controlled to land at approximately the same position on the recording medium 12.

Next, a description will be given of an image forming apparatus and an image processing apparatus that is installed with a program for causing the image forming apparatus to output the recorded (or printed) image.

Figure 10:
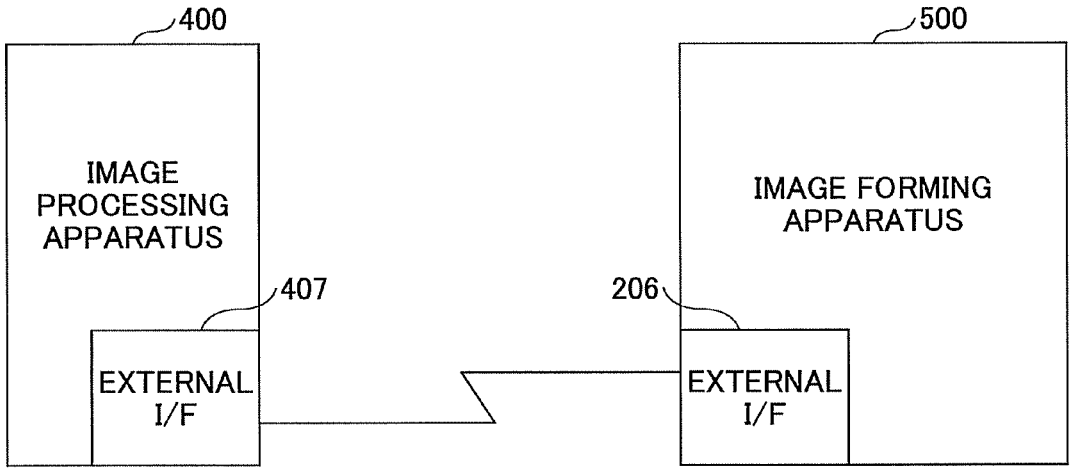
FIG. 10 is a block diagram for explaining an example of an image forming system in the first embodiment of the present invention.

FIG. 10 is a block diagram for explaining an example of an image forming system in this embodiment of the present invention.

The image forming system (or printing system) illustrated in FIG. 10 includes one or a plurality of image processing apparatuses (only one illustrated in FIG. 10) 400 such as personal computers (PCs), and an image forming apparatus 500 such as an ink-jet printer (or ink-jet recording apparatus). The image processing apparatus 400 and the image forming apparatus 500 are connected via a predetermined interface or network. For example, an external I/F 407 of the image processing apparatus 400 is connected to the host I/F (or external I/F) 206 of the image forming apparatus 500.

Figure 11:
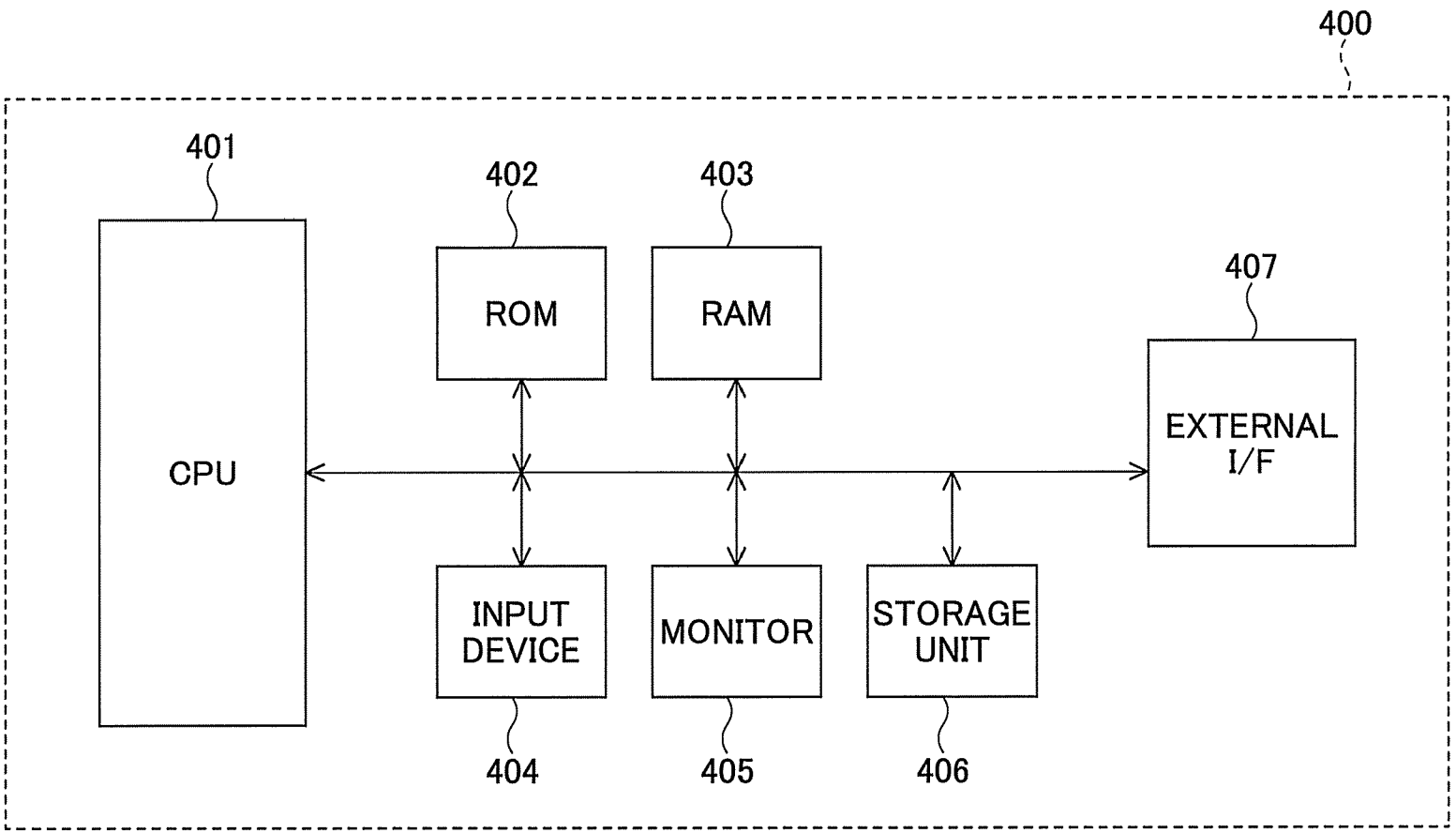
FIG. 11 is a block diagram for explaining an example of an image processing apparatus of the image forming system.

FIG. 11 is a block diagram for explaining an example of the image processing apparatus 400 of the image forming system. As illustrated in FIG. 11, the image processing apparatus 400 includes a CPU 401, a ROM 402, a RAM 403, an input device 404, a monitor 405, a storage unit 406, and the external I/F 407 that are connected via a bus. The ROM 402 and the RAM 403 form a memory unit (or memory means), and the storage unit 406 may be formed by a hard disk drive (HDD) or the like. The input device 404 includes a keyboard, a mouse or the like. The monitor 405 may be formed by a liquid crystal display (LCD), a cathode ray tube (CRT) or the like. A reading unit (not illustrated) capable of reading information from a storage medium, such as an optical disk, may also be connected to the bus of the image processing apparatus 400. The external I/F 407 connects to a network such as the Internet or, an external device such as a universal serial bus (USB), in order to enable communication between the image processing apparatus 400 and the external device.

Programs, including an image processing program, are stored in the storage unit 406 of the image processing apparatus 400. The image processing program may be read from the storage medium by the reading unit or, downloaded from the network such as the Internet, and installed in the storage unit 406. The image processing program installed in the storage unit 406 enables the image processing apparatus 400 to perform the image processing described in the following. The image processing program may run on a predetermined Operating System (OS) or, form a part of a specific application software.

The image processing of this embodiment may be performed in the image forming apparatus 500, but in this example, it is assumed for the sake of convenience that the image forming apparatus 500 does not have the function of generating the dot pattern that is actually recorded on the recording medium 12 in response to a print instruction instructing plotting of an image or printing of characters, for example. In other words, the print instruction issued from an application software that is executed in the image processing apparatus 400 which functions as the host unit is processed by the printer driver (software) embedded in the image processing apparatus 400, and the printer driver generates multi-value dot pattern that can be recorded and output on the image forming apparatus 500. The print data to be recorded may be received together with the print instruction or, prestored in the RAM 203 or the like. The printer driver rasterizes the print data to be recorded into the dot pattern (or bit map data), and transfers the dot pattern to the image forming apparatus 500 to be recorded on the recording medium 12.

The print instruction issued from the application software or the operating system of the host unit is temporarily stored in a plotting data memory which may be formed by the RAM 403. The print instruction instructs plotting of the image or printing of the characters, for example, and may include information written with the position, line width and shape of the lines to be recorded or, information written with the font, size and position of the characters to be recorded. The print instruction may be written in a specific print language.

The print instruction stored in the plotting data memory is interpreted by a raster analyzer which may be formed by the CPU 401. In the case of a line print instruction, the raster analyzer interprets the line print instruction and rasterizes the print data to be recorded into a dot pattern depending on the position, line with and the like specified by the line print instruction. On the other hand, in the case of a character print instruction, the raster analyzer reads corresponding character outline information from font outline data stored in the ROM 402, for example, interprets the character print instruction and rasterizes the font outline data to be recorded into a dot pattern based on the character outline information depending on the position, size and the like specified by the character print instruction. Further, in the case of an image print instruction, the raster analyzer interprets the print data to be recorded, which is specified by the image print instruction, as it is into a dot pattern.

Thereafter, the dot pattern is subjected to the image processing and stored in a raster data memory which may be formed by the RAM 403. In this state, the image processing apparatus 400 rasterizes the dot pattern using orthogonal lattices as basic recording positions. For example, the image processing may include a color management process (CMM) or a γ-correction process for adjusting the colors, a halftone process such as the dither method or the error diffusion method, a background elimination process, a restriction process for restricting the total amount of ink used, and the like. The dot pattern stored in the raster data memory is transferred to the image forming apparatus 500 via the I/Fs 407 and 206.

The image processing of this embodiment, such as the halftone process, may of course be performed in the image forming apparatus 500. In this case, the image processing may be performed in the print control part 207 or, in the CPU 201 and the print control part 207 or, in the CPU 201. Because the image processing may be performed within the image processing apparatus 400 or within the image forming apparatus 500, in this specification, the print data before being subjected to the image processing, and the print data after being subjected to the image processing, are both referred to as "print data" for the sake of convenience.

In this embodiment, the so-called 1-pass (or single-pass or single-scan) recording may be employed to record the image by a single main scan with respect to the recording medium 12 by a nozzle group including different overlapping nozzles that scan the same region on the recording medium 12 or, the so-called multi-pass (or multi-scan) recording may be employed to record the image by a plurality of main scans with respect to the same region of the recording medium 12 by the same nozzle group or by different nozzle groups. Of course, the same region of the recording medium 12 may be scanned by nozzles of different heads by arranging the heads along the main scan direction with an overlap. Moreover, the above described methods using the 1-pass recording and the multi-pass recording may be appropriately combined to suit the performance required of the image forming apparatus 500.

Next, a description will be given of the multi-pass recording. In this example, it is assumed for the sake of convenience that a multi-scan (or multi-pass) recording is performed with respect to one recording region of the recording medium 12 in order to complete the image recorded in this recording region on the recording medium 12.

Figure 12:
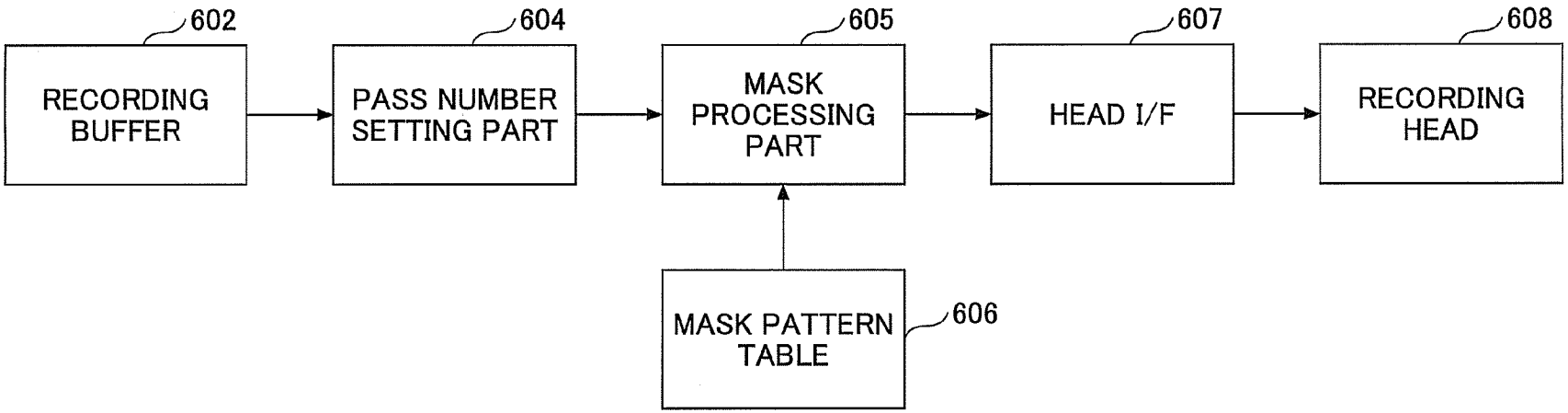
FIG. 12 is a block diagram illustrating an example of functions of the image processing apparatus.

FIG. 12 is a block diagram illustrating an example of functions of the print control part 207 in the image processing apparatus 400. The print control part 207 includes the functions of a pass number setting part 604 and a mask processing part 605. For example, a recording buffer 602 may be formed by the RAM 203 illustrated in FIG. 5, and a mask pattern table 606 may be formed by the ROM 202 illustrated in FIG. 5. A head interface (I/F) 607 and a recording head 608 respectively correspond to the head driver 208 and the recording head 7 illustrated in FIG. 5.

For example, the dot pattern (or bit map data) of the print data to be recorded on the recording medium 12 are stored at predetermined addresses within the recording buffer 602 in response to a print instruction, under the control of the CPU 201. The recording buffer 602 has a storage capacity sufficient to store the dot pattern amounting to one main scan in the main scan direction MS and an amount the recording medium 12 is transported in one sub scan in the sub scan direction SS. The recording buffer 602 may be formed by a first-in-first-out (FIFO) memory that forms a ring buffer in units of sub scans.

When the dot pattern amounting to one main scan is stored in the recording buffer 602, the CPU 201 starts a printer engine, reads the dot pattern from the recording buffer 602 depending on the position of each nozzle of the recording head 608, and inputs the read dot pattern to the pass number setting part 604. The printer engine includes the main scan motor 4, the sub scan motor 31, the charging roller 26 and the like described above. In addition, when the dot pattern of the next main scan is input, the CPU 201 controls the storage of the dot pattern of the next main scan so that the dot pattern is stored in a vacant region of the recording buffer 602 corresponding to the region that amounts to the amount the recording medium 12 is transported in one sub scan in the sub scan direction SS after the recording of the dot pattern amounting to one main scan in the main scan direction MS is completed.

The pass number setting part 604 determines a pass division number which indicates the number of passes to which the recording is divided based on the print instruction received by the print control unit 200. The pass division number set by the pass number setting part 604 is output to the mask processing part 605. The mask pattern table 606 prestores mask patterns for the 1-pass recording, 2-pass recording, 4-pass recording and 8-pass recording. The mask processing part 605 selects a mask pattern from the mask pattern table 606 depending on the pass division number. In this example, the mask processing part 605 selects a corresponding one of the mask patterns for the multi-pass recording. The mask processing part 605 performs a masking process to mask the dot pattern stored in the recording buffer 602 using the selected mask pattern, and outputs the masked bit pattern data to the head I/F 607. The head I/F 607 rearranges the masked dot pattern in an order in which the dots of the masked dot pattern is used by the recording head 608, and transfers the rearranged masked dot pattern to the recording head 608.

In the example illustrated in FIG. 12, the pass number setting part 604 and the mask processing part 605 may operate under the control of the CPU 201. However, at least a part of the functions of the pass number setting part 604 and the mask processing part 605 may be performed by at least one of the CPU 201 and the ASIC 205. Furthermore, the ROM 202 or the like may store a program which, when executed by a computer or processor such as the CPU 201, causes the computer (that is, CPU 201) to execute at least a part of the functions of the pass number setting part 604 and the mask processing part 605.

Of course, the program executed by the CPU 201 may include a portion of the functions of the printer driver within the host unit, in order to generate the dot pattern that is actually recorded on the recording medium 12 in response to the print instruction within the image forming apparatus.

By employing the multi-pass recording, it is possible to average the banding that may appear conspicuously in the case of the 1-pass recording and make the banding less conspicuous.

One method of increasing the recording speed (or printing speed) is to employ the 1-pass recording or to use a recording head having a size greater than or equal to the width of the recording medium 12 along the main scan direction MS as in the case of the line type printer. However, the banding caused by the error in the amount of transport of the recording medium 12 in the sub scan direction SS may occur in the case of the 1-pass recording, and the banding caused by the positional error at the joints of a plurality of heads arranged in the sub scan direction SS may occur in the case of the recording head having the plurality of heads in order to increase the length of a group of nozzles.

A part of the nozzles may overlap in order to suppress or minimize the banding. In this case, the dot pattern (or bit map data) is distributed to the nozzles in order to scatter the dot error by an overlap process.

An overlapping region on the recording medium 12 refers to a region in which one dot is recorded by multiple nozzles, which may be the same nozzle scanning multiple times or, different nozzles scanning one or multiple times. In other words, a dot is recorded by a single scan of multiple nozzles or by multiple scans of one or more nozzles in the overlapping region, and a dot is recorded by a single scan of a single nozzle in a non-overlapping region. Thus, the overlapping region may be caused by an overlap of two or more heads along the sub scan direction SS or, caused by multiple scans of one or more heads scanning with an overlap.

In the following description, the overlapping region and the non-overlapping region refer to the above described regions on the recording medium 12.

In the overlapping region, one dot of the dot pattern has at least two corresponding nozzles, and one dot may be formed by the ink drops jetted from the two corresponding nozzles if no measures are taken to control the amount of the jetted ink drops. The banding may occur if one dot in the overlapping region is formed by the ink drops jetted from the two corresponding nozzles, because this one dot may become too dark due to the excessive amount of ink drop.

Hence, in this embodiment, the driving waveform of the nozzles (or piezoelectric elements 121) that are driven at a predetermined driving frequency is designed so that the amount of jetted ink from the nozzles becomes a desired amount. But if the driving frequency of the nozzles changes, the amount of jetted ink from the nozzles also changes. For example, the driving frequency of the nozzles is reduced to one-half if the 1-pass recording is changed to the 2-pass recording.

Therefore, due to the above described frequency characteristics of the recording head 7, the banding may occur due to a change in the amount of jetted ink from the nozzles if the nozzles are driven at various driving frequencies within the overlapping region. In addition, the banding may occur due to differences generated between the driving frequency of the nozzles in the overlapping region and the driving frequency of the nozzles in the non-overlapping region.

Accordingly, this embodiment distributes the dot pattern to be recorded in the overlapping region to each of the nozzles so that the driving frequency of the nozzles in the overlapping region becomes approximately the same as the driving frequency of the nozzles in the non-overlapping region. Further, a group of dots formed by the dots consecutively recorded in the main scan direction MS within the overlapping region is distributed to the column of nozzles that are arranged in the sub scan direction SS so that the driving frequencies thereof become approximately the same. By taking such measures, it is possible to minimize the deviation in the amount of jetted ink from the nozzles, which is otherwise caused by the difference between the driving frequencies of the nozzles. In addition, by irregularly distributing the dot pattern to the nozzles in the overlapping region, it is possible to prevent a regular or systematic dot pattern from becoming conspicuous in the overlapping region, which is otherwise caused by the regular or systematic dot pattern that is fixedly distributed to the nozzles in the overlapping region.

Next, a description will be given of the frequency characteristics of the recording head 7 with respect to the driving frequency, by referring to FIG. 13. FIG. 13 is a diagram illustrating the amount of jetted ink drop from the nozzle for the driving frequencies of 5 kHz to 20 kHz. If the driving frequency of the nozzle is 20 kHz for the 1-pass recording, 10 kHz for the 2-pass recording, and 5 kHz for the 4-pass recording, it may be seen from FIG. 13 that the amount of jetted ink drop greatly deviates in a frequency range of 20 kHz to 10 kHz, but the amount of jetted ink drop does not show a large deviation in a frequency range of less than 10 kHz to 5 Hz.

Accordingly, it may be seen that the recording in the overlapping region is greatly affected by the frequency characteristics of the recording head 7 if the driving frequency in the overlapping region is one-half the driving frequency in the non-overlapping region for the 1-pass recording.

Figure 14:
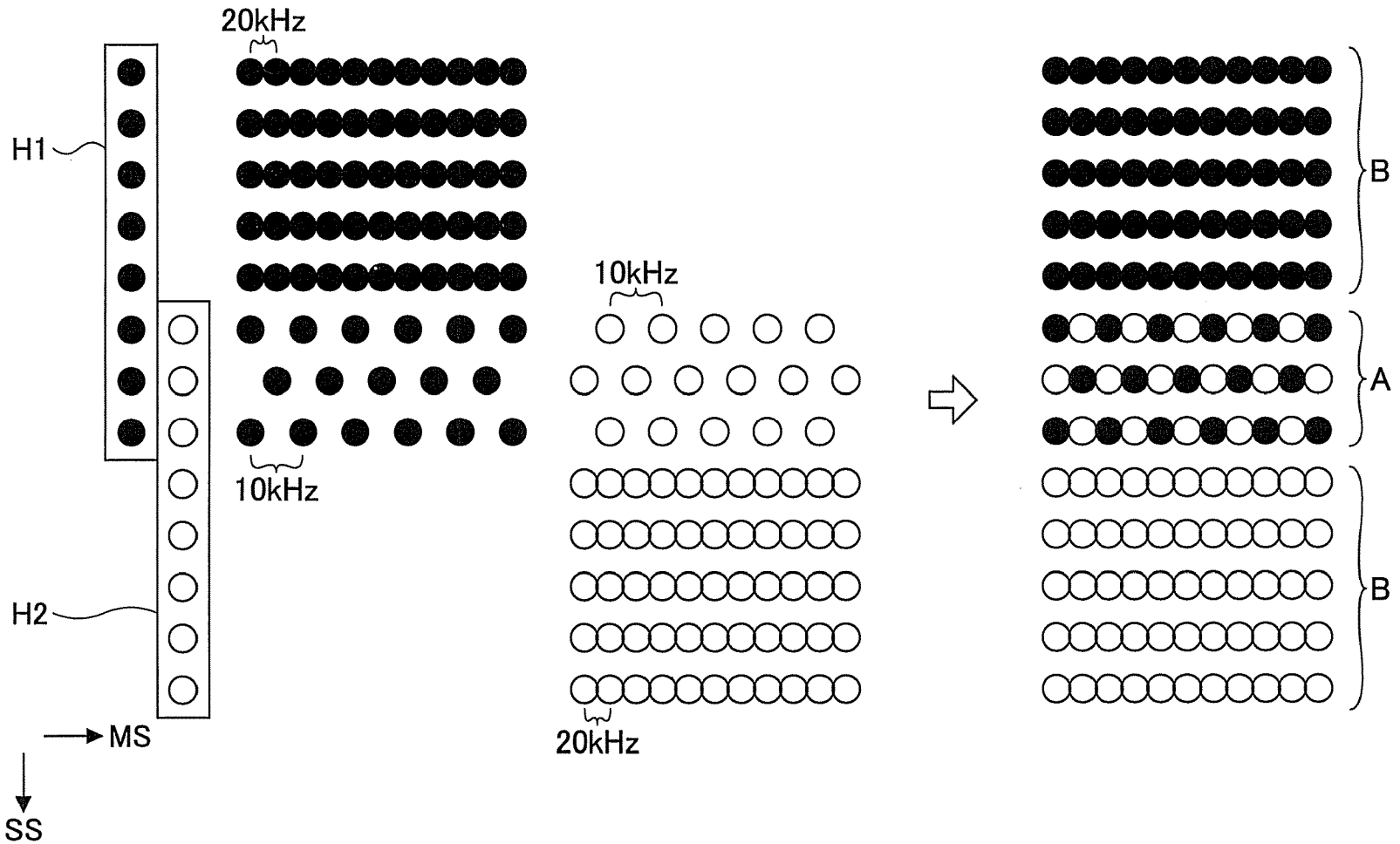
FIG. 14 is a diagram illustrating a first distribution example of the dot pattern for nozzles in an overlapping region.

FIG. 14 is a diagram illustrating a first distribution example of the dot pattern for nozzles in the overlapping region. In FIG. 14 and figures which follow, H1 and H2 denote heads forming the recording head 7, MS and SS respectively denote the main and sub scan directions, and it is assumed for the sake of convenience that a solid printing is performed to print the dots having the same dot size (that is, same ink drop size) at all pixel positions of the image to be printed unless otherwise indicated. However, the present invention is of course not limited to the solid printing. In addition, black circular marks within the head H1 denote positions of the nozzles, and black circular marks outside the head H1 denote dots recorded by the nozzles of the head H1. Similarly, white circular marks within the head H2 denote positions of the nozzles, and white circular marks outside the head H2 denote dots recorded by the nozzles of the head H2. As illustrated in FIG. 14, if the dots of the dot pattern in an overlapping region A are distributed to the nozzles of the heads H1 and H2 in a checker-board pattern, the driving frequency of the nozzles in the overlapping region A becomes 10 kHz if the driving frequency of the nozzles in a non-overlapping region B is 20 kHz. Hence, the recording within the overlapping region A is affected by the frequency characteristics of the recording head 7 described above. Of course, the higher driving frequency is not limited to 20 kHz.

For this reason, this embodiment distributes the dots of the dot pattern in the overlapping region A so that each of the heads H1 and H2 records consecutive dots at certain intervals and the driving frequencies of the nozzles in each of the heads H1 and H2 become approximately the same for the overlapping region A and the non-overlapping region B. Because the driving frequencies of the nozzles in each of the heads H1 and H2 can be made approximately the same for the overlapping region A and the non-overlapping region B by increasing the number of dots consecutively recorded by the heads H1 and H2 within the overlapping region A, the amount of ink drops jetted from the nozzles of the heads H1 and H2 within the overlapping region A becomes approximately the same as that within the non-overlapping region B. It is of course possible to provide an interval in which only one dot is recorded by the heads H1 and H2 within the overlapping region A as illustrated in FIG. 16 which will be described later, as long as the one-dot intervals do not become conspicuous within the overlapping region A.

Figure 15:
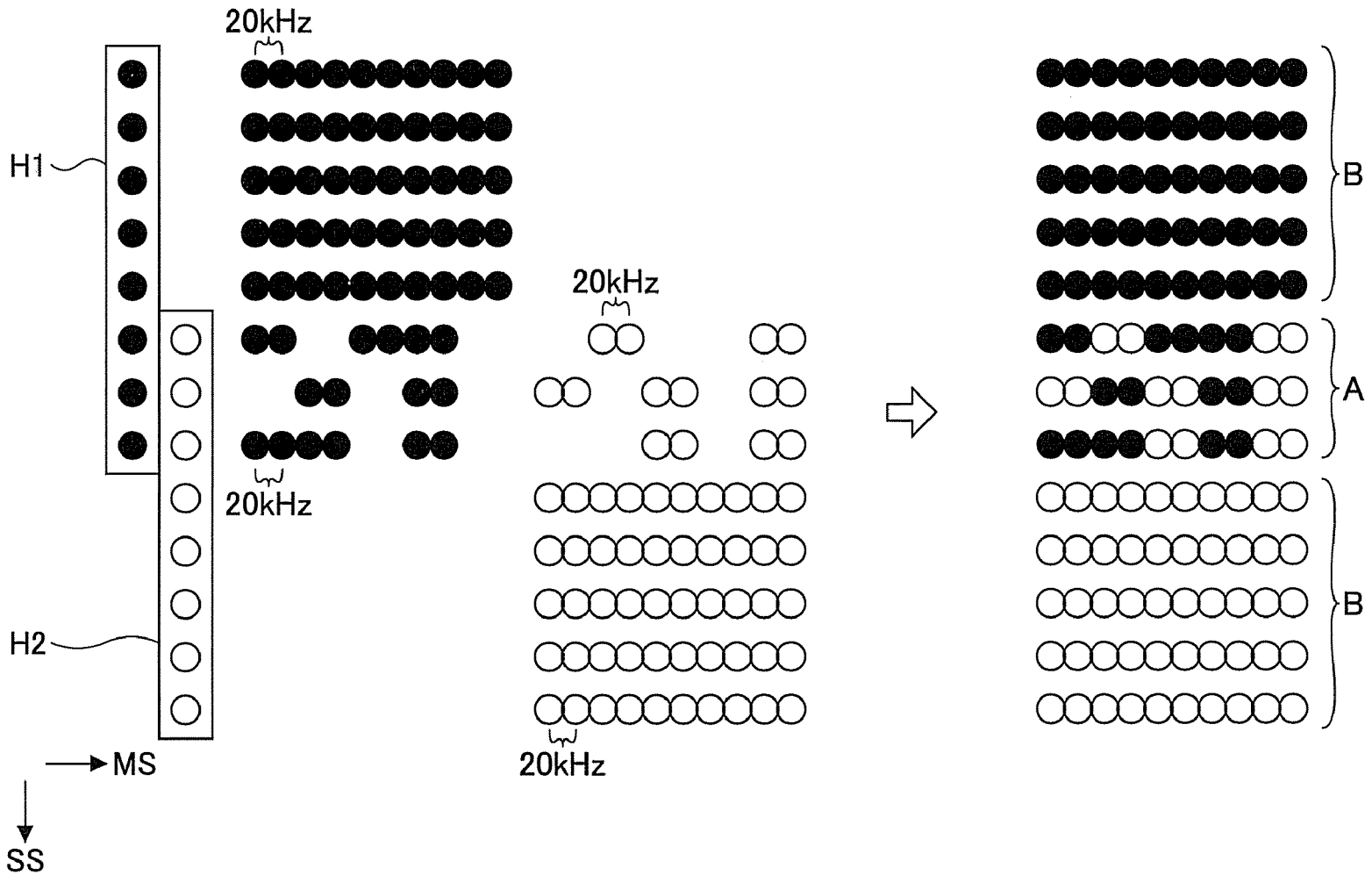
FIG. 15 is a diagram illustrating a second distribution example of the dot pattern for the nozzles in the overlapping region.

FIG. 15 is a diagram illustrating a second distribution example of the dot pattern for the nozzles in the overlapping region. In FIG. 15, this second distribution example distributes the dots of the dot pattern in the overlapping region A so that each of the heads H1 and H2 records two consecutive dots at certain intervals and the driving frequencies of the nozzles in each of the heads H1 and H2 become approximately the same for the overlapping region A and the non-overlapping region B. The recording of two consecutive dots by each of the heads H1 and H2 within the overlapping region A suppresses a decrease in the driving frequency of the nozzles. In addition, by determining the arrangement of the two consecutive dots to be recorded by each of the heads H1 and H2 based on a random number, it is possible to prevent each nozzle from recording a regular or systematic dot pattern.

Figure 16:
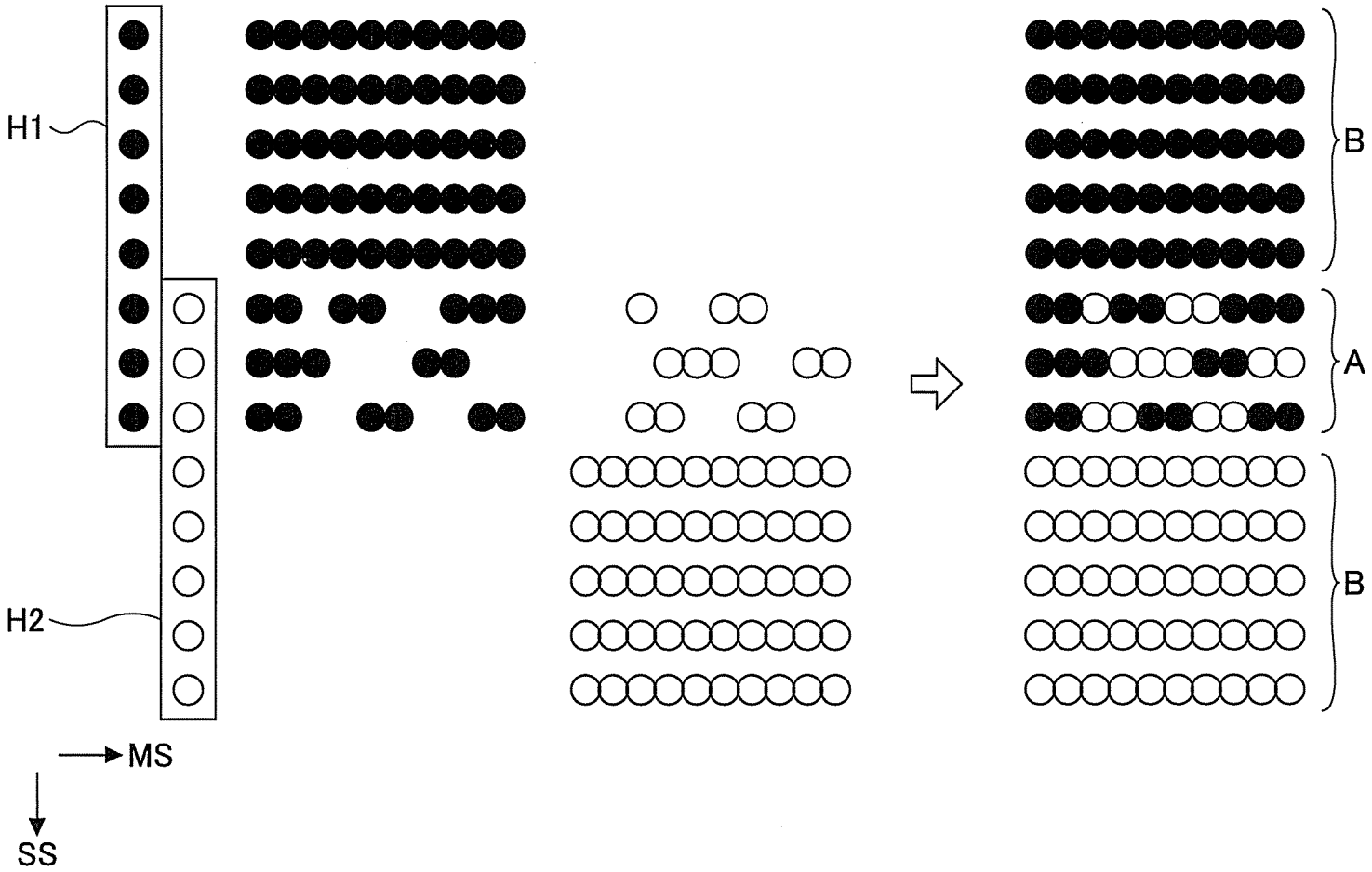
FIG. 16 is a diagram illustrating a third distribution example of the dot pattern for the nozzles in the overlapping region.

FIG. 16 is a diagram illustrating a third distribution example of the dot pattern for the nozzles in the overlapping region. In FIG. 16, this third distribution example distributes the dots of the dot pattern in the overlapping region A so that each of the heads H1 and H2 records two or three consecutive dots at certain intervals (with the exception of the uppermost line within the overlapping region A where the head H2 records only one dot at a starting portion) and the driving frequencies of the nozzles in each of the heads H1 and H2 become approximately the same for the overlapping region A and the non-overlapping region B. The recording of two or three consecutive dots by each of the heads H1 and H2 within the overlapping region A suppresses a decrease in the driving frequency of the nozzles. In addition, by determining the arrangement of the two consecutive dots to be recorded by each of the heads H1 and H2 based on a random number, it is possible to prevent each nozzle from recording a regular or systematic dot pattern.

FIG. 16 also illustrates an interval in which only one dot is recorded by the head H2 within the overlapping region A, but the distribution is designed so that this interval rarely occurs. For this reason, the driving frequencies of the nozzles in each of the heads H1 and H2 will not greatly differ between the overlapping region A and the non-overlapping region B.

In each of FIGS. 14, 15 and 16, the number of overlapping nozzles of the heads H1 and H2 in the sub scan direction SS is three. However, the number of overlapping nozzles of the heads H1 and H2 may be set to a value other than three.

The deviation in the amount of ink drops jetted from the nozzles depending on the frequency characteristics of the recording head 7 described above differs depending on the frequency range. In the example illustrated in FIG. 13, the amount of jetted ink drop greatly deviates in the frequency range of 20 kHz to 10 kHz compared to the frequency range of less than 10 kHz to 5 Hz. Accordingly, the distribution of the dot pattern for the nozzles in the overlapping region may be determined by taking into consideration the frequency range in which the nozzles are driven.

For example, in a shadow region, the dot recording density is relatively high and the driving frequency of the nozzles is relatively high, thereby causing a notable difference in the frequency characteristics of the recording head 7 between the overlapping region and the non-overlapping region. On the other hand, in a highlight region, the dot recording density is relatively low and the driving frequency of the nozzles is relatively low, thereby less likely causing a notable difference in the frequency characteristics of the recording head 7 between the overlapping region and the non-overlapping region.

Accordingly, the distribution of the dot pattern for the nozzles in the overlapping region A may be changed depending on the frequency characteristics of the recording head 7. For example, when recording the shadow region by the dot pattern of the overlapping region A, each nozzle may be driven to record at least two consecutive dots. On the other hand, when recording the highlight region by the dot pattern of the overlapping region A, each nozzle may be driven to record the dots in a scattered manner. In the case of the 2-pass recording, the number of dots that are consecutively recorded in the overlapping region A may be set relatively small, because the driving frequency of the nozzles is relatively low for the 2-pass recording.

The distribution of the dot pattern for the nozzles in the overlapping region A may be changed depending on the driving frequency of the nozzles of the recording head 7. For example, each nozzle may be driven to record at least two consecutive dots for the relatively high driving frequency because the dot recording density is relatively high for the relatively high driving frequency. On the other hand, each nozzle may be driven to record the dots in a scattered manner for the relatively low driving frequency because the dot recording density is relatively low for the relatively low driving frequency.

Next, a more detailed description will be given of a method of judging the driving frequency of the nozzles of the recording head 7 using the print data and the number of dots to be recorded within a judging window, by referring to FIG. 17.

Figure 17:
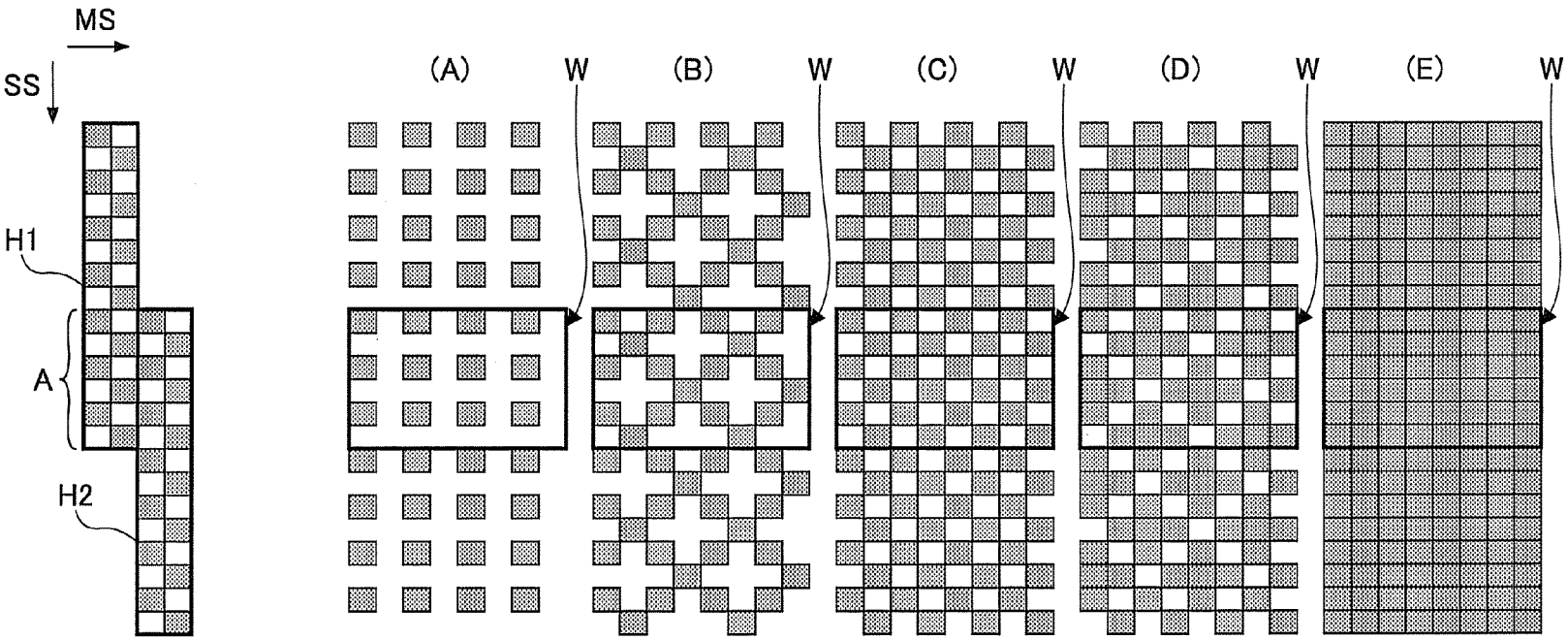
FIG. 17 is a diagram for explaining a method of judging a driving frequency of nozzles of the recording head.
Figure 18:
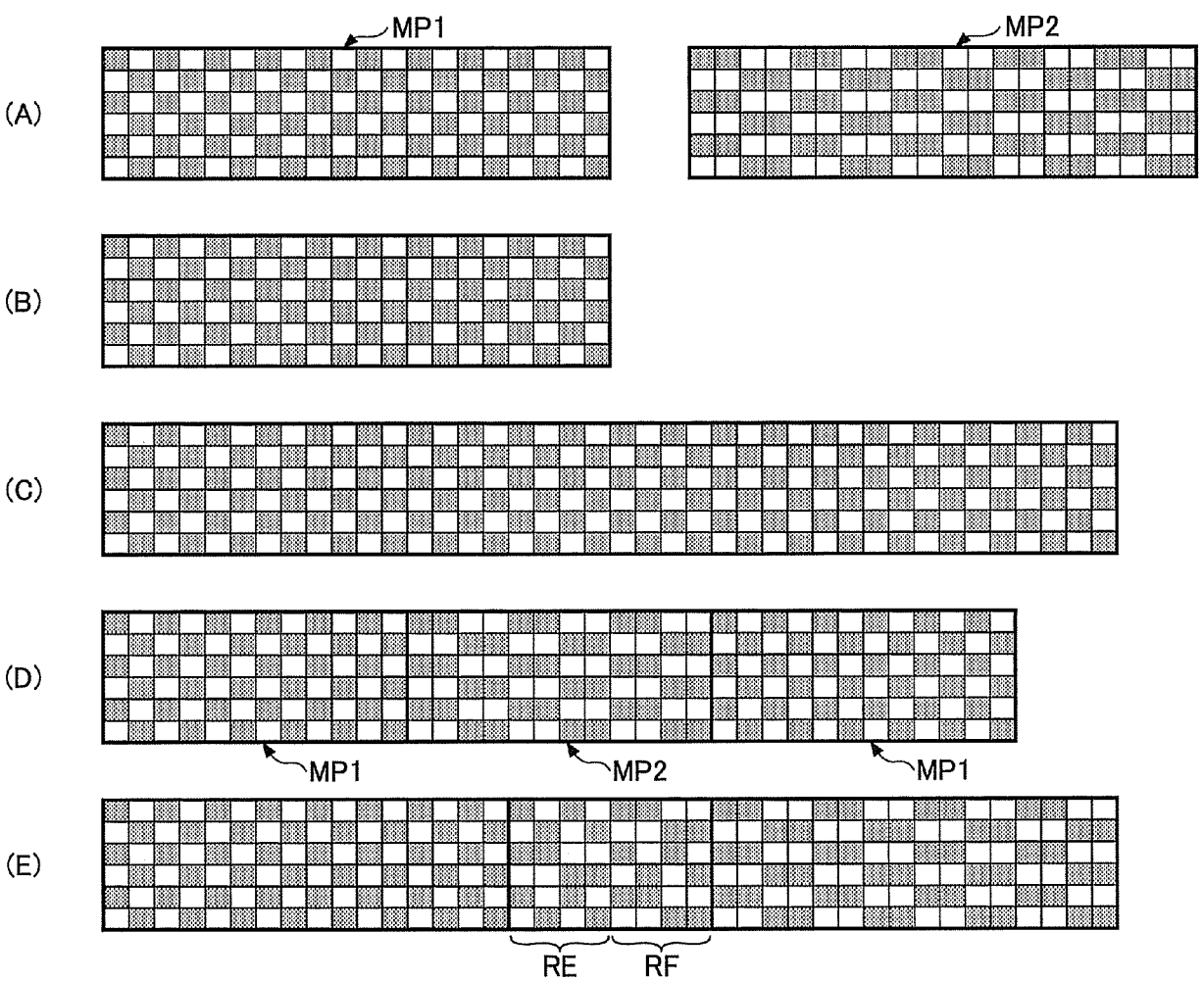
FIGS. 18(A) through 18(E) are diagrams for explaining an arrangement of dots after judging the driving frequency.

FIG. 17 is a diagram for explaining a method of judging the driving frequency of the nozzles of the recording head 7. The method described in conjunction with FIG. 17 uses a number of dots to be recorded within a judging window W on the recording medium 12 in order to judge the driving frequency of the nozzles of the recording head 7. The judging window W may have an arbitrary size and an arbitrary shape, but the judging window W is rectangular in this example with a size of 8 dots×6 dots in the horizontal and vertical directions in FIG. 17. In FIG. 17, the nozzles of each of the heads H1 and H2, indicated by shaded squares, are provided in a zigzag or checker-board pattern. In the piezoelectric head, for example, it may be difficult to arrange all of the nozzles in a single column due to structural or space limitations, and the nozzles are arranged in two columns, for example. FIG. 17 illustrates a case where the nozzles of each of the heads H1 and H2 are arranged in two columns. For the sake of convenience, patterns (A) through (E) of the dots to be recorded on the recording medium 12 are also indicated by shaded squares having the same size, and it is assumed that the judging window W is used to judge the number of dots to be recorded within a predetermined region or area. The pattern (E) corresponds to the solid printing. Furthermore, the "driving frequency" described in conjunction with FIGS. 17 and 18 refer to an average driving frequency of the nozzles of the heads H1 and H2 which record the dots on the recording medium 12.

The print control part 207 judges the driving frequency of the nozzles of the recording head 7 from the number of dots to be recorded within the judging window W. More particularly, the print control part 207 determines the number of dots to be recorded within the judging window W, and judges the driving frequency of the nozzles of the recording head 7 based on the number of dots to be recorded within the judging window W. The number of dots to be recorded within the judging window W may be determined by one of the following methods (i) through (v), for example.

According to the method (i), the print control part 207 counts the number of dots to be recorded in the main scan direction MS within the judging window W in the overlapping region A, based on the print data. The counted number of dots to be recorded within the judging window W (hereinafter simply referred to as the "counted number") is 12, 18, 24, 30 and 48 for the patterns (A) through (E), respectively, as indicated in a lower portion of FIG. 17. The print control part 207 judges that the driving frequency is relatively high if the counted number is greater than a threshold value, and judges that the driving frequency is relatively low if the counted number is less than or equal to the threshold value. The threshold value for the method (i) may be 24, for example.

According to the method (ii), the print control part 207 counts the number of dots to be recorded in the main scan direction MS within the judging window W in the overlapping region A, based on the print data, in a manner similar to the method (i) described above. In addition, the print control part 207 divides the counted number by the number of nozzles of each of the heads H1 and H2 that are to record the dots within the judging window W, in order to obtain an average number of dots to be recorded per nozzle within the judging window W (hereinafter simply referred to as the "average number"), by rounding off or rounding down the divided result if necessary. The average number per nozzle is 12/3=4 for the pattern (A) because three nozzles will record the dots within the judging window W. Hence, the average number per nozzle is 4, 3, 4, 5 and 8 for the patterns (A) through (E), respectively, as indicated in a lower portion of FIG. 17. The print control part 207 judges that the driving frequency is relatively high if the average number is greater than a threshold value, and judges that the driving frequency is relatively low if the average number is less than or equal to the threshold value. The threshold value for the method (ii) may be 5, for example.

According to the method (iii), the print control part 207 counts the number of blanks (or unrecorded dots) following one dot to be recorded in the main scan direction MS within the judging window W in the overlapping region A, based on the print data, except for the blanks in the leftmost column and the run of blanks from the leftmost column along the main scan direction MS within the judging window W in FIG. 17. The counted number of blanks within the judging window W (hereinafter simply referred to as the "counted blanks") is 12, 25, 21, 16 and 0 for the patterns (A) through (E), respectively, as indicated in a lower portion of FIG. 17. For example, for the pattern (A), the number of blanks is 4 for the first, third and fifth lines within the judging window W, and the number of blanks for the second, fourth and sixth lines within the judging window W is 0 because the blanks are not formed between two recorded dots. Similarly, for the pattern (B), the number of blanks is 4 for the first, third and fifth lines within the judging window W, the number of blanks is 5 for the second and sixth lines within the judging window W, and the number of blanks is 3 for the fourth line within the judging window W. The print control part 207 judges that the driving frequency is relatively high if the counted blanks is less than or equal to a threshold value, and judges that the driving frequency is relatively low if the counted blanks is greater than the threshold value. The threshold value for the method (iii) may be 21, for example.

According to the method (iv), the print control part 207 counts the number of blanks following one dot to be recorded in the main scan direction MS within the judging window W in the overlapping region A, based on the print data, in a manner similar to the method (iii) described above. In addition, the print control part 207 divides the counted blanks by the number of nozzles of each of the heads H1 and H2 that are to record the dots within the judging window W, in order to obtain an average number of blanks to be formed per nozzle within the judging window W (hereinafter simply referred to as the "average blank number"), by rounding off or rounding down the divided result if necessary. The average blank number is 12/3=4 for the pattern (A) because three nozzles will record the dots within the judging window W. Hence, the average blank number per nozzle is 4, 4, 4, 3 and 0 for the patterns (A) through (E), respectively, as indicated in a lower portion of FIG. 17. The print control part 207 judges that the driving frequency is relatively high if the average blank number is less than or equal to a threshold value, and judges that the driving frequency is relatively low if the average blank number is greater than or equal to the threshold value. The threshold value for the method (iv) may be 3, for example.

The methods (iii) and (iv) need only count the blanks in the main scan direction MS, because the effects of the driving frequency on the frequency characteristics of the recording head 7 are more conspicuous along the main scan direction.

According to the method (v), the print control part 207 counts the number of non-consecutive dots to be recorded within the judging window W in the overlapping region A, based on the print data. The counted number of non-consecutive dots to be recorded within the judging window W (hereinafter simply referred to as the "counted non-consecutive number") is 12, 18, 24, 19 and 6 for the patterns (A) through (E), respectively, as indicated in a lower portion of FIG. 17. In addition, the print control part 207 divides the counted non-consecutive number by the number of nozzles of each of the heads H1 and H2 that are to record the dots within the judging window W, in order to obtain an average counted non-consecutive number per nozzle within the judging window W (hereinafter simply referred to as the "average non-consecutive number"), by rounding off or rounding down the divided result if necessary. The average non-consecutive number is 12/3=4 for the pattern (A) because three nozzles will record the dots within the judging window W. The print control part 207 judges that the driving frequency is relatively high if the average non-consecutive number is less than or equal to a threshold value, and judges that the driving frequency is relatively low if the counted number of dots to be recorded is greater than or equal to the threshold value. The threshold value for the method (v) may be 3, for example.

According to the methods (i) and (iii), the number of dots to be recorded or, the number of blanks following the dot to be recorded, is counted within the judging window W. On the other hand, according to the methods (ii), (iv) and (v), the average of the number of dots to be recorded or, the number blanks or, the number of non-consecutive dots to be recorded, within the judging window W, is computed per nozzle that is to record the dots. The methods (ii), (iv) and (v) do not take into account the nozzles that will not record the dots within the judging window W.

For example, if the methods (i) through (v) are compared for the patterns (A) and (C) in FIG. 17, it may be seen that the methods (ii), (iv) and (v) show similar results that may be used effectively to judge the driving frequency of the nozzles of the recording head 7.

The methods (i) through (v) described above may also be used to judge the resolution of the image represented by the print data. For examine, the print control part 207 may judge that the resolution is relatively high if the driving frequency is relatively high, and judge that the resolution is relatively low if the driving frequency is relatively low.

In addition, the print control part 207 may judge the driving frequency of the nozzles of the recording head 7 based on the number of gradation levels of the print data. If the print instruction from the image processing apparatus 400 includes gradation information indicating the number of gradation levels represented by the print data, the print control part 207 may judge that the driving frequency is relatively high if the number of gradation levels indicated by the gradation information is greater than a threshold value, and judge that the driving frequency is relatively low if the number of gradation levels indicated by the gradation information is less than or equal to the threshold value. In addition, if the print data that has been subjected to the image processing includes RGB data, the print control part 208 may judge the driving frequency based on the number of gradation levels represented by the RGB data.

Further, the print control part 207 may judge the driving frequency based on the amount of ink to be jetted within the judging window W. The print control part 207 may judge that the driving frequency is relatively high if the amount of ink to be jetted within the judging window W is relatively large, and judge that the driving frequency is relatively low if the amount of ink to be jetted within the judging window is relatively small.

Next, a description will be given of the window size of the judging window W, by referring to FIGS. 18(A) through 18(E). If the window size of the judging window W is set to an integer multiple of the size of the mask pattern used in the mask process of the print control part 207 described above, it is possible to efficiently judge the driving frequency in units of the mask pattern size and switch the mask pattern to be used in the overlapping region A depending on the judged driving frequency.

FIGS. 18(A) through 18(E) are diagrams for explaining an arrangement of dots after judging the driving frequency. FIG. 18(A) illustrates a mask pattern MP1 and a mask pattern MP2 which may be used in the overlapping region A. The mask pattern MP1 masks the dots in units of one dot, while the mask pattern MP2 masks the dots in units of two dots (that is, run of two dots). Each of the mask patterns MP1 and MP2 has a size of 20 dots×6 dots in the horizontal and vertical directions in FIG. 18(A). FIGS. 18(B) through 18(E) illustrate distributions of the mask patterns MP1 and MP2 in the overlapping region A.

FIG. 18(B) illustrate an example where the window size of the judging window W is identical to that of the mask pattern MP1 in the overlapping region A, and the mask pattern MP1 is used because the print control part 207 judges from the print data using the judging window W that the driving frequency within the judging window W is relatively low. Of course, the mask pattern MP2 may be used if the print control part 207 judges that the driving frequency within the judging window W is relatively high.

FIG. 18(C) illustrate an example where the window size of the judging window W is an integer multiple of that of the mask pattern MP1 in the overlapping region A, and the mask pattern MP1 is used because the print control part 207 judges from the print data using the judging window W that the driving frequency within the entire judging window W is relatively low. In this example, the mask pattern MP1 is used two times.

FIG. 18(D) illustrate an example where the window size of the judging window W is not an integer multiple of that of the mask pattern MP1 in the overlapping region A. Hence, the judging window W in this example is equally divided into three regions, and the driving frequency is judged for each of the three regions. For example, if the driving frequency is low, high and low for the three regions from left to right in FIG. 18(D), the print control part 207 divides the mask patterns MP1 and MP2 to fit three regions of the judging window W, and applies the partial mask pattern MP1, the partial mask pattern MP2 and the partial mask pattern MP1 to the three regions in this sequence from the left to right. Hence, the print control part 207 can suitably switch the partial mask patterns MP1 and MP2 within the overlapping region A. Of course, the mask pattern may be switched within the overlapping region A in FIG. 18(C) described above, by using the mask pattern MP1 for the first half and the mask pattern MP2 for the second half of the judging window, for example.

FIG. 18(E) illustrates an example where partial mask patterns MP1 and MP2 coexist within a boundary region between two mask patterns MP1 and MP2. In this example, the mask pattern MP1, a mixed mask pattern, and the mask pattern MP2 are applied to the judging window W in this sequence. The mixed mask pattern has the pattern of the partial mask pattern MP1 in a first boundary region RE, and has the pattern of the partial mask pattern MP2 in a second boundary region RF. The mixed mask pattern prevents the boundary between the two mask patterns MP1 and MP2 from appearing conspicuous within the overlapping region A.

The frequency characteristics of the recording head 7 are also affected by the viscosity of the ink. For this reason, the distribution of the dot pattern for the nozzles in the overlapping region A may be changed depending on the ambient temperature of the image forming apparatus (that is, the temperature in a vicinity of the recording head 7) because the ink viscosity varies depending on the temperature.

Figure 19:
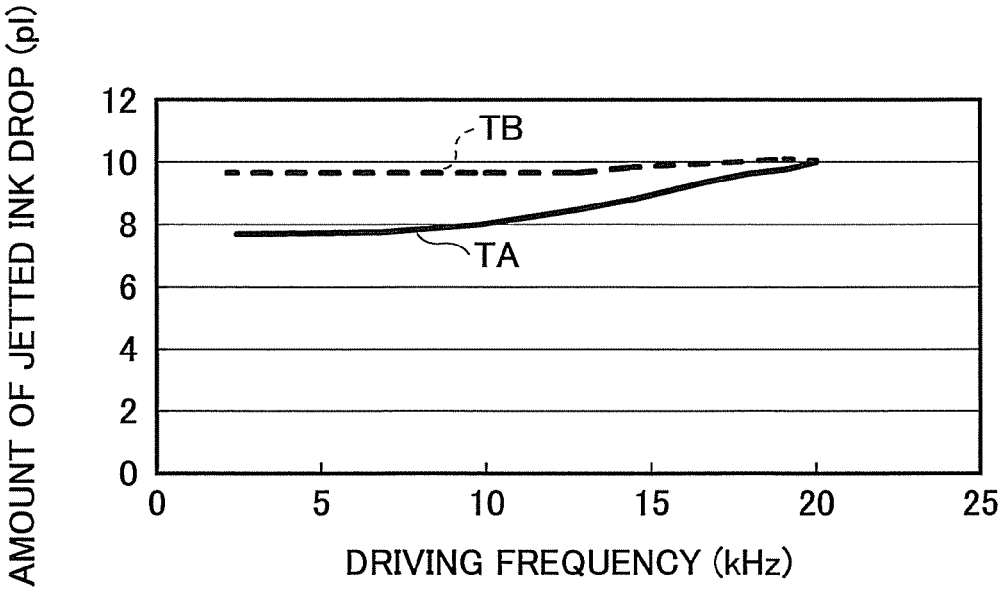
FIG. 19 is a diagram illustrating a change in the amount of jetted ink drop caused by different temperature conditions.

FIG. 19 is a diagram illustrating a change in the amount of jetted ink drop caused by different temperature conditions. FIG. 19 illustrates the frequency characteristics of the recording head 7 at a temperature TA and the frequency characteristics of the recording head 7 at a temperature TB, which differ. For example, the temperature TA is higher than the temperature TB. The change in the amount of jetted ink drop is relatively large for driving frequencies of 20 kHz to 10 kHz at the higher temperature TA, because the ink viscosity decreases at the higher temperature TA, to thereby cause the meniscus surface of the nozzle to become unstable. Furthermore, when the meniscus surface of the nozzle becomes unstable, the frequency characteristics of the recording head 7 become inconsistent among the individual recording heads 7 (or heads H1 and H2). Hence, each nozzle may be driven to record consecutive dots in the overlapping region A at the higher temperature TA. On the other hand, the amount of jetted ink drop is substantially constant regardless of the driving frequency at the lower temperature TB. Thus, each nozzle may be driven to record the dots in a scattered manner in the overlapping region A at the lower temperature TB.

The temperature detected by the temperature sensor 215 illustrated in FIG. 5 is notified to the print control part 207 via the I/O part 213. Accordingly, the print control part 207 may selectively use a mask pattern for recording consecutive dots in the overlapping region A if the detected temperature is higher than a threshold value, and selectively use a mask pattern for recording the dots in a scattered manner in the overlapping region A if the detected temperature is lower than or equal to the threshold value.

When distributing the dot pattern for the nozzles in the overlapping region A, each nozzle may be driven to record consecutive dots, that is a group of consecutive dots, only when the dot recording positions within the overlapping region A falls within a predetermined range from corresponding ideal landing positions of the ink drops. The undesirable effects of the change in the frequency characteristics of the recording head 7 are notable particularly when the actual dot recording positions within the overlapping region A slightly differ from the corresponding ideal landing positions of the ink drops. In other words, the image recorded within the overlapping region A should originally be similar in quality to the image recorded within the non-overlapping region B. However, the image quality deteriorates when the frequency characteristics of the recording head 7 change. For this reason, each nozzle may be driven to record consecutive dots, that is a group of consecutive dots, within the overlapping region A only when the actual dot recording positions within the overlapping region A slightly differ from the corresponding ideal landing positions of the ink drops. On the other hand, the dot recording positions within the overlapping region A may not fall within a predetermined range from corresponding ideal landing positions of the ink drops. Hence, when the actual dot recording positions within the overlapping region A greatly differ from the corresponding ideal landing positions of the ink drops, each nozzle may be driven to record the dots in a scattered manner.

A sensor (not illustrated) may be provided in the image forming apparatus 500 to detects actual positions of the dots recorded on the recording medium 12. In this case, an output detection signal of the sensor may be notified to the print control part 207, in order to determine whether the landing positions of the ink drops on the recording medium 12 falls within a predetermined range. In addition, it is possible to record a test image on the recording medium 12 using the overlapping region A, and visually check the test image actually recorded on the recording medium 12, in order to determine whether the landing positions of the ink drops on the recording medium 12 falls within a predetermined range. The result of the visual checking may be input to the print control part 207 from the operation panel 214, for example.

Accordingly, the print control part 207 may use the mask pattern to record consecutive dots if the landing positions of the ink drops on the recording medium 12 falls within a predetermined range, and use the mask pattern to record dots in a scattered manner if the landing positions of the ink drops on the recording medium 12 do not fall within the predetermined range.

In the image forming apparatus of this embodiment, the recording head 7 is formed by a piezoelectric head using piezoelectric elements 121. However, the recording head 7 may be formed by a thermal head using electro-thermal elements. The piezoelectric head enables jetting of the ink drops having different sizes depending on the driving waveform, and it is easy to record halftone images. On the other hand, the thermal head enables easy and high integration of the nozzles, and it is suited for recording images having a large number of gradation levels at a high recording speed.

Next, a description will be given of examples of the thermal head, by referring to FIGS. 20A, 20B and 21.

Figure 20A:
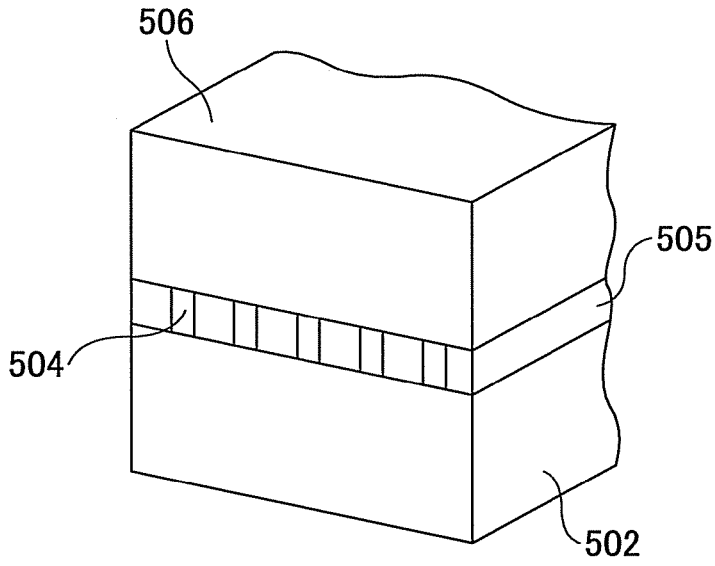
FIGS. 20A and 20B are diagrams illustrating an example of an edge shooter type head.
Figure 20B:
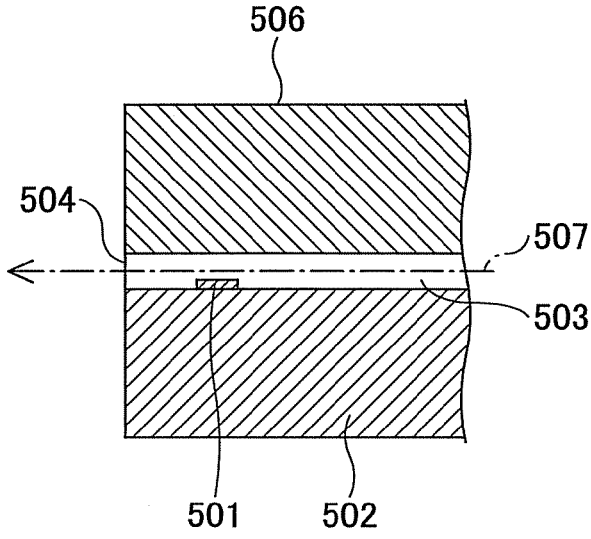

FIGS. 20A and 20B respectively are a perspective view and a cross sectional view illustrating an example of an edge shooter type head. As illustrated in FIGS. 20A and 20B, the edge shooter type head includes a jetting energy generator 501 provided on a substrate 502. In FIGS. 20A and 20B, the illustration of electrodes for applying a driving signal to the jetting energy generator 501 and a protection layer or the like provided on the jetting energy generator 501 is omitted for the sake of convenience. A wall member 505 and a top plate 506 are stacked on the substrate 502. A sidewall of a flow passage 503 and a nozzle 504 are formed by the wall member 505. The flow passage 503 is covered by the top plate 506.

As indicated by a one-dot chain line 507 in FIG. 20B, the ink from a ink chamber (not illustrated) flows in the flow passage 503 towards the nozzle 504, by applying the driving signal to the electrodes of the jetting energy generator 501 in a state where the ink from the ink chamber fills the flow passage 503. The jetting energy generated from the jetting energy generator 501 in response to the driving signal acts on the ink within the flow passage 503, in an energy acting region above the jetting energy generator 501. As a result, the ink is jetted from the ink nozzle 504 as ink drops.

The edge shooter type head is suited for mass production, and various parts including the nozzle may be formed at a high precision. In addition, the edge shooter type head enables small nozzles to be formed and a large number of nozzles to be formed with ease, thereby making it easy to reduce the size of the edge shooter type head.

Figure 21:
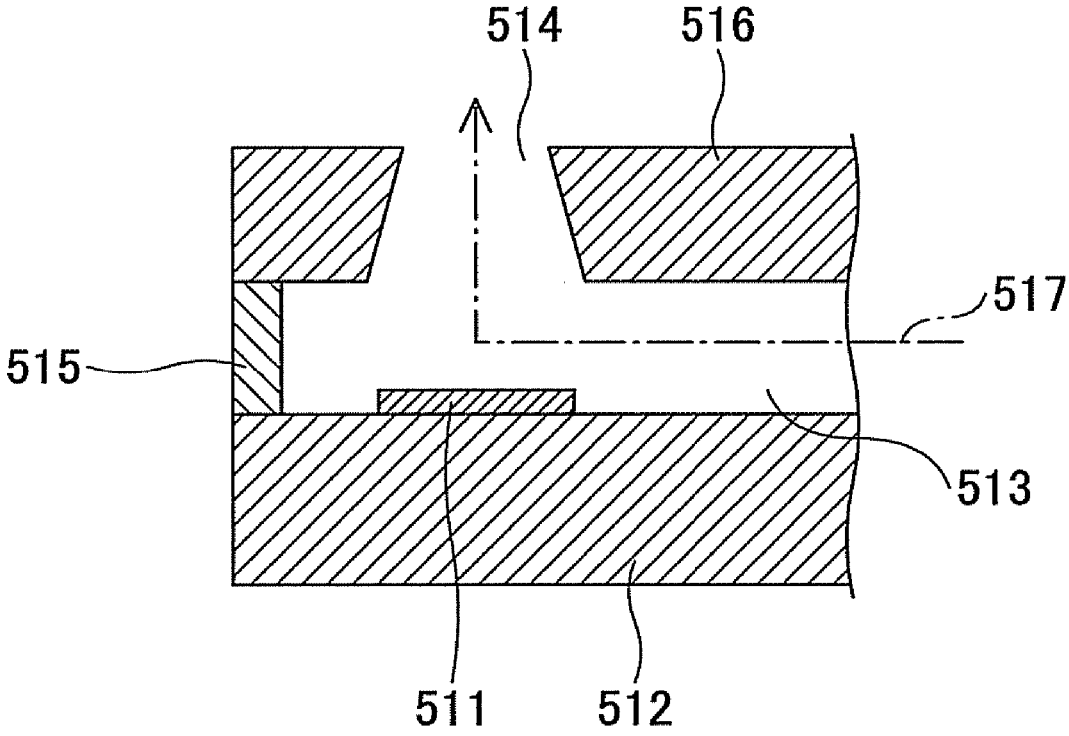
FIG. 21 is a diagram illustrating an example of a side shooter type head.

FIG. 21 is a cross sectional, view illustrating an example of a side shooter type head. As illustrated in FIG. 21, the side shooter type head includes a jetting energy generator 511 provided on a substrate 512. In FIG. 21, the illustration of electrodes for applying a driving signal to the jetting energy generator 511 and a protection layer or the like provided on the jetting energy generator 511 is omitted for the sake of convenience. A flow passage forming member 514 and a nozzle plate 516 are stacked on the substrate 512. A sidewall of a flow passage 513 is formed by the flow passage forming member 515. A nozzle 514 is formed in the nozzle plate 516.

As indicated by a one-dot chain line 517 in FIG. 21, a direction in which the ink within the flow passage 513 flows to the jetting energy generator 511 is perpendicular to an aperture center axis of the nozzle 514.

The side shooter type head efficiently converts the energy from the jetting energy generator 511 into kinetic energy for forming and jetting the ink drops. In addition, the restoration of the meniscus of the side shooter type head by the supply of ink is quick, and the side shooter type head is particularly effective when a heating element is used for the jetting energy generator 511.

In the case of the edge shooter type head, he so-called cavitation phenomenon occurs, in which the jetting energy generator 501 is gradually damaged by the impact of air or vapor bubbles that collapse. However, the side shooter type head can avoid the cavitation phenomenon because, when the air or vapor bubbles grow and reach the nozzle 514, the bubbles will reach the atmosphere and a contraction of the bubbles caused by a temperature decrease will not occur. Hence, the serviceable life of the side shooter type head is relatively long.

Next, a description will be given of the operation of the image forming apparatus of this embodiment, by referring to FIGS. 22 and 23. It is assumed for the sake of convenience that the distribution of the dot pattern for nozzles in the overlapping region A is determined depending on the driving frequency of the nozzles. However, as described above, the distribution of the dot pattern for the nozzles in the overlapping region A may be determined depending on conditions other than the driving frequency of the nozzles, such as the number of gradation levels of the print data and the ambient temperature of the image forming apparatus.

Figure 22:
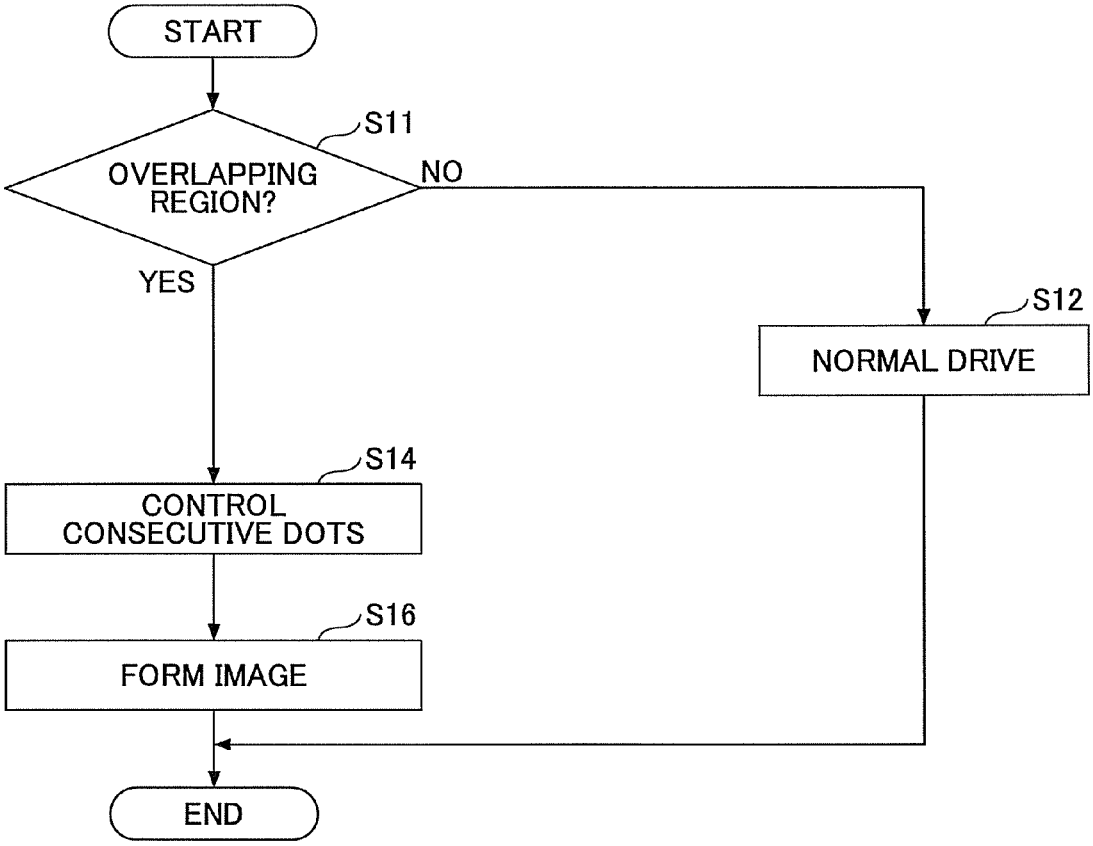
FIG. 22 is a flow chart for explaining an example of an image forming process.

FIG. 22 is a flow chart for explaining an example of an image forming process. It is assumed for the sake of convenience that the CPU 201 of the print control unit 200 illustrated in FIG. 5 performs the functions of the pass number setting part 604 and the mask processing part 605 illustrated in FIG. 12. However, the process may of course be performed by the print control part 207 or, by a combination of the CPU 201 and the print control part 207. In a step S11 illustrated in FIG. 22, the CPU 201 decides whether a region on the recording medium 12 to which the ink drops are jetted from the nozzles is the overlapping region A. The process advances to a step S12 if the decision result in the step S11 is NO, and the process advances to a step S14 if the decision result in the step S11 is YES.

In the step S12, the CPU 201 controls the print control part 207 to supply the driving signal to the head driver 208 in order to drive the nozzles of the recording head 7 in a normal manner and cause the ink drops to be jetted from the nozzles. Hence, the step S12 performs a normal recording process, and the process ends.

In the step S14, the CPU 201 controls the print control part 207 so that each nozzle of the recording head 7 is driven to record at least two consecutive dots within the overlapping region A. The process performed in the step S14 includes determining the pass division number based on the print instruction, selecting the mask pattern from the mask pattern table within the ROM 202 depending on the pass division number, and masking the dot pattern stored in the recording buffer formed by the RAM 203 using the selected mask pattern. In other words, the step S14 performs the functions of the pass number setting part 604 and the mask processing part 605 illustrated in FIG. 12.

The process advances to a step S16 after the step S14. In the step S16, the CPU 201 controls the print control part 207 to output the masked bit pattern data to the head driver 208, so that the overlapping region A is recorded with the distributed dot pattern determined by the step S14.

As a result, it is possible to reduce the difference of the head driving frequencies between the overlapping region A and the non-overlapping region B on the recording medium 12.

Figure 23:
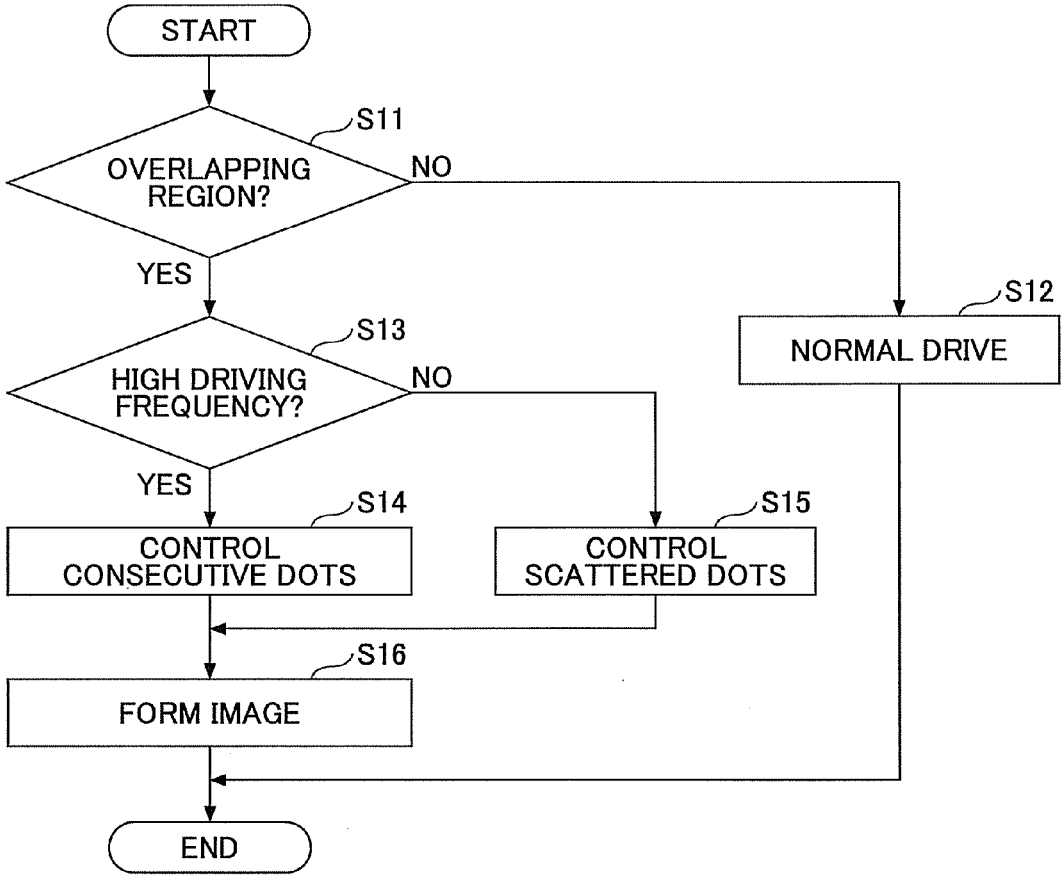
FIG. 23 is a flow chart for explaining another example of an image forming process.

FIG. 23 is a flow chart for explaining another example of the image forming process. In FIG. 23, those steps that are the same as those corresponding steps in FIG. 22 are designated by the same reference numerals, and a description thereof will be omitted. In FIG. 23, the process advances to a step S13 if the decision result in the step S11 is YES.

In the step S13, the CPU 201 decides whether an average driving frequency of the nozzles of the recording head 7 within the overlapping region A is higher than a predetermined frequency, using one of the methods (i) through (v) described above in conjunction with FIG. 17, for example. The process advances to the step S14 if the decision result in the step S13 is YES, and the process advances to a step S15 if the decision result in the step S13 is NO.

In the step S15, the CPU 201 controls the print control part 207 so that each nozzle of the recording head 7 is driven to record the dots in a scattered manner within the overlapping region A. The process performed in the step S15 includes determining the pass division number based on the print instruction, selecting the mask pattern from the mask pattern table within the ROM 202 depending on the pass division number, and masking the dot pattern stored in the recording buffer formed by the RAM 203 using the selected mask pattern. In other words, the step S15 performs the functions of the pass number setting part 604 and the mask processing part 605 illustrated in FIG. 12. The process advances to the step S16 after the step S14 or S15.

The step S13 may of course decide whether the average driving frequency of the nozzles of the recording head 7 within the overlapping region A is higher than the predetermined frequency, using methods other than the methods (i) through (v), such as method using other parameters such as the number of gradation levels of the print data, and the amount of ink jetted to be jetted onto the recording medium 12.

As a result, it is possible to reduce the difference of the driving frequencies between the overlapping region A and the non-overlapping region B on the recording medium 12, and minimize the deviation in the jetting of the ink within the overlapping region A in relation to the non-overlapping region B. Consequently, it is possible to suppress the banding from being generated within the overlapping region A.

Second Embodiment

Next, a description will be given of the image forming apparatus in a second embodiment of the present invention. In this second embodiment, the recording rate of the dots within the overlapping region A is set smaller towards one end (or boundary) of the overlapping region A along the sub scan direction SS. In addition, the number of consecutive dots recorded in the main scan direction MS within the overlapping region A is set smaller towards one end (or boundary) of the overlapping region A along the sub scan direction SS. The sub scan direction SS matches a longitudinal direction of the recording head 7 in which the nozzles are arranged.

Figure 24A:
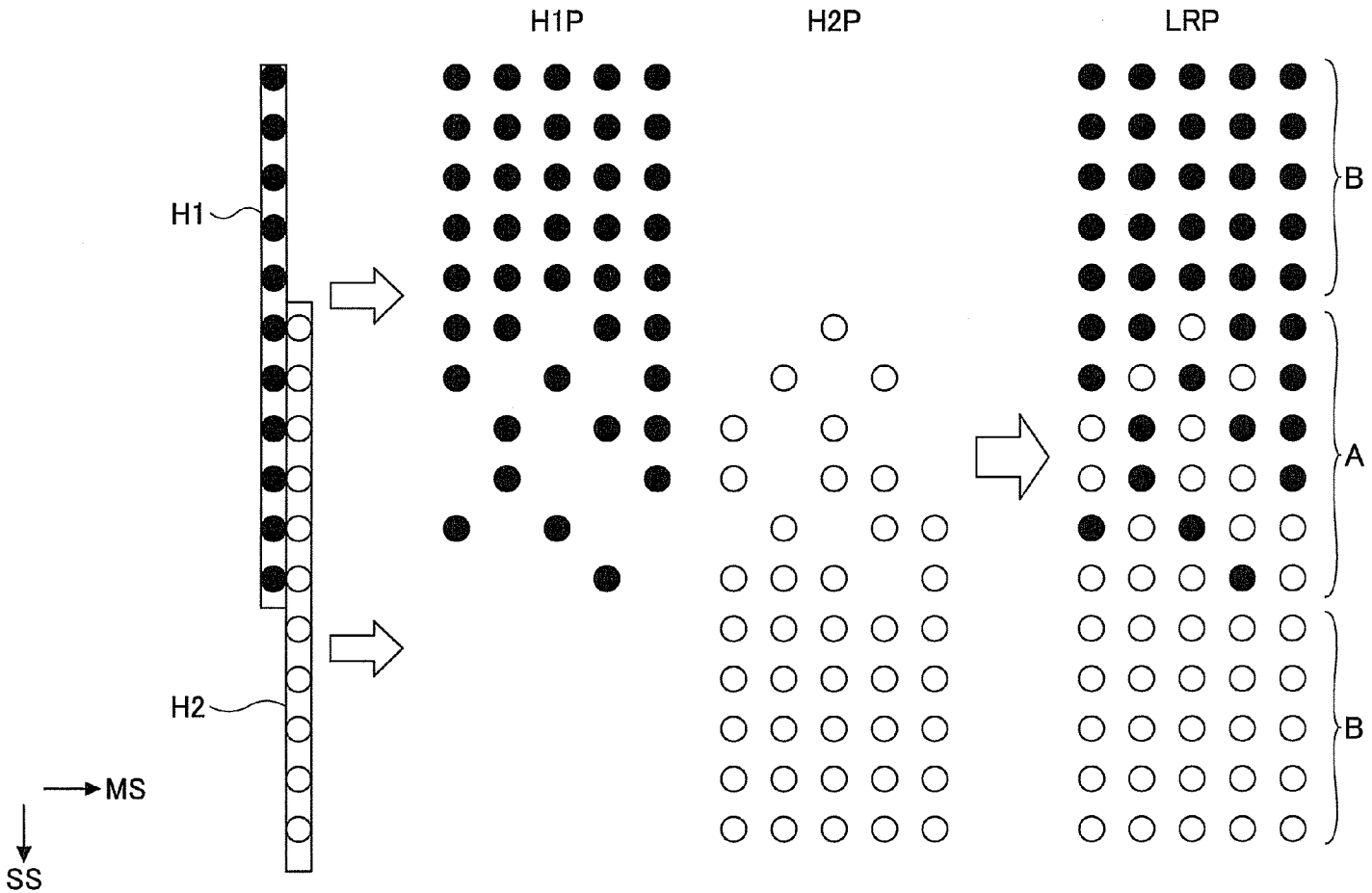
FIGS. 24A and 24B are diagrams illustrating examples in which a dot recording rate decreases towards an end in a sub scan direction.
Figure 24B:
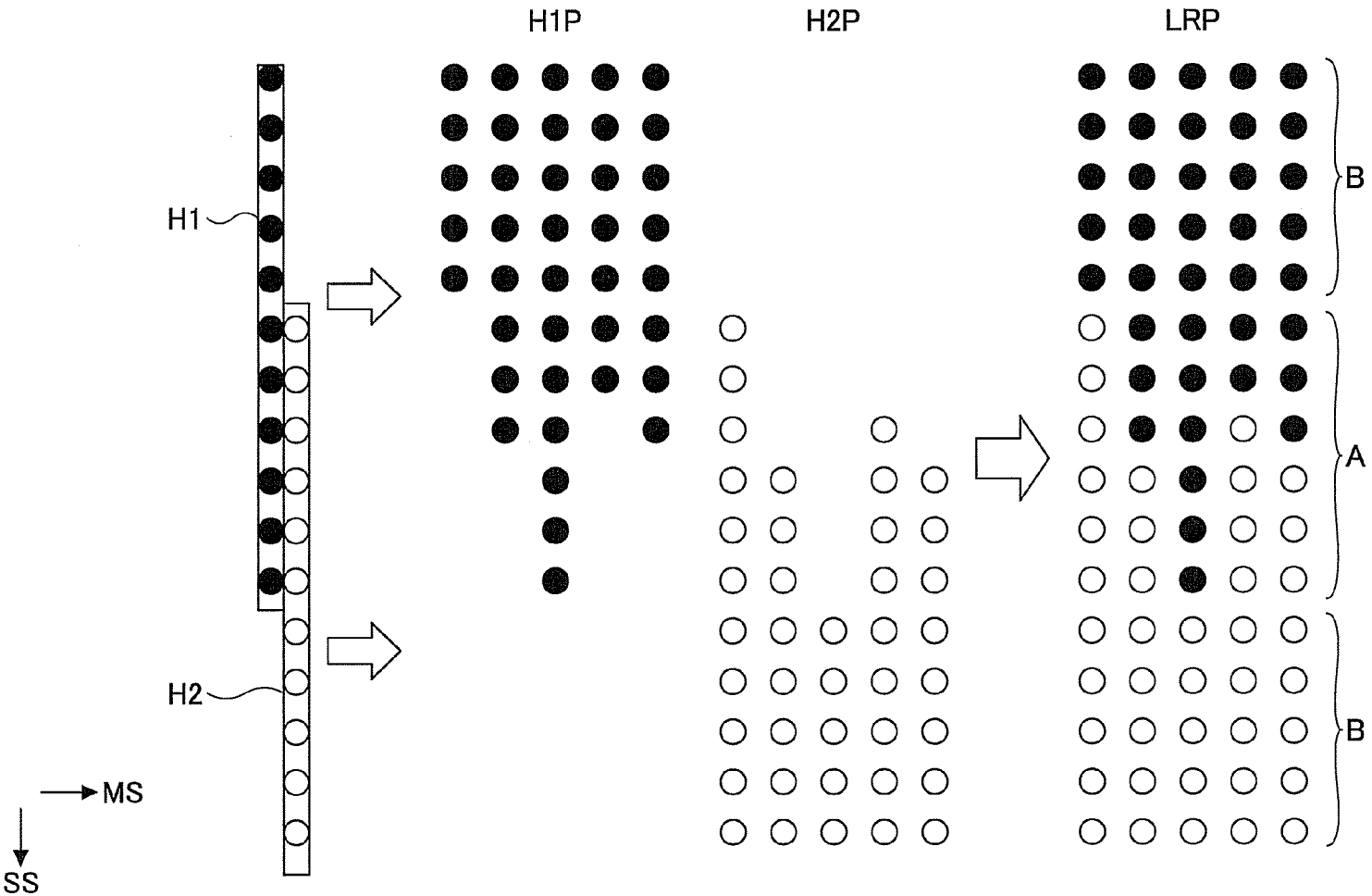

FIGS. 24A and 248 is a diagram illustrating examples in which the dot recording rate decreases towards one end in the sub scan direction SS. In FIGS. 24A and 248, H1P denotes the dots recorded on the recording medium 12 by the head H1, H2P denotes the dots recorded on the recording medium 12 by the head H2, and LRP denotes the landing positions of the dots recorded by the heads H1 and H2 in the overlapping region A and the non-overlapping region B. In FIGS. 24A and 24B, the recording rate of the dots within the overlapping region A for the head H1 is set smaller towards the lower end (or lower boundary) of the overlapping region A along the sub scan direction SS, and the number of consecutive dots recorded in the main scan direction MS within the overlapping region A for the head H1 is set smaller towards the lower end (or lower boundary) of the overlapping region A along the sub scan direction SS. On the other hand, the recording rate of the dots within the overlapping region A for the head H2 is set smaller towards the upper end (or upper boundary) of the overlapping region A along the sub scan direction SS, and the number of consecutive dots recorded in the main scan direction MS within the overlapping region A for the head H2 is set smaller towards the upper end (or upper boundary) of the overlapping region A along the sub scan direction SS.

As the length of the overlapping region A along the sub scan direction SS increases, it becomes possible to more gradually change the frequency characteristics of the heads H1 and H2 which overlap along the sub scan direction SS, to thereby enable effective suppression of the banding. On the other hand, if the length of the overlapping region A along the sub scan direction SS is excessively increased, the overlapping region A extends over the region that is affected by the difference of the head driving frequencies between the overlapping region A and the non-overlapping region B, and a deviation in the dot recording density (or tone) may be generated within a relatively large region. Consequently, the overlapping region A itself may become recognized as a line or band having a certain width if the length of the overlapping region A along the sub scan direction SS is excessively increased.

Figure 25B:
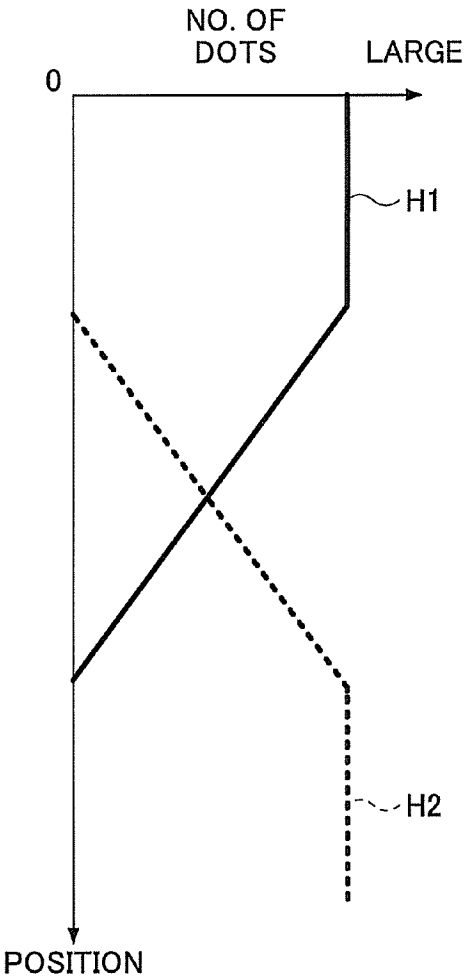
FIGS. 25A and 25B are diagrams for explaining an example of an overlap process in a second embodiment of the present invention.
Figure 25A:
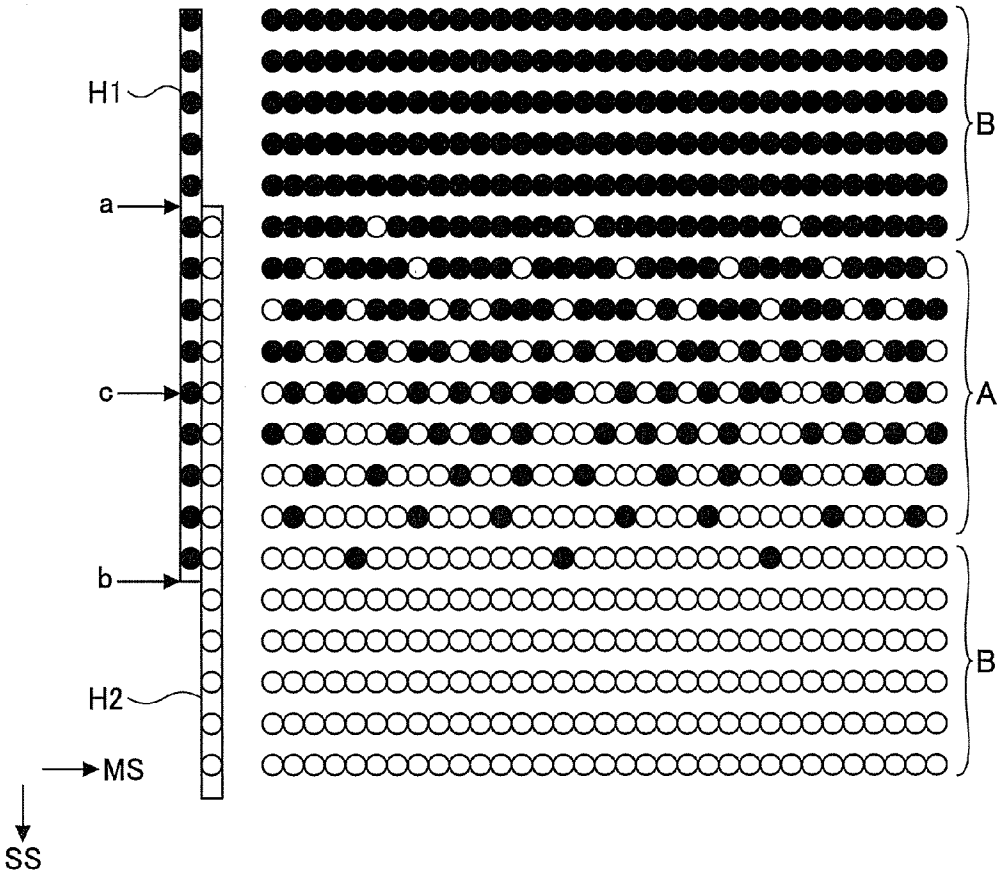

FIGS. 25A and 25B are diagrams for explaining an example of an overlap process of this second embodiment of the present invention, which determines how the dots are to be recorded by the nozzles in an overlapping part of the heads. In FIG. 25A, those parts that are the same as those corresponding parts in FIGS. 24A and 24B are designated by the same reference numerals, and a description thereof will be omitted. In FIG. 25A, "a" denotes the upper end (or upper boundary) between the upper non-overlapping region B and the overlapping region A, and "b" denotes the lower end (or lower boundary) between the overlapping region A and the lower non-overlapping region B.

As illustrated in FIG. 25A, the recording rate of the dots within the overlapping region A for the head H1 is set smaller towards the lower end (or lower boundary) "b" of the overlapping region A along the sub scan direction SS, and the number of consecutive dots recorded in the main scan direction MS within the overlapping region A for the head H1 is set smaller towards the lower end (or lower boundary) "b" of the overlapping region A along the sub scan direction SS. On the other hand, the recording rate of the dots within the overlapping region A for the head H2 is set smaller towards the upper end (or upper boundary) "b" of the overlapping region A along the sub scan direction SS, and the number of consecutive dots recorded in the main scan direction MS within the overlapping region A for the head H2 is set smaller towards the upper end (or upper boundary) "b" of the overlapping region A along the sub scan direction SS.

FIG. 25B illustrates the number of dots recorded by the head H1 per unit time by a solid line, and the number of dots recorded by the head H2 per unit time by a dotted line. In FIG. 25B, the abscissa denotes the number of dots recorded in arbitrary units, and the ordinate denotes the position of the recording dots along the sub scan direction SS. As may be seen from FIG. 25B, the number of dots recorded by the head H1 decreases towards the lower end "b", while the number of dots recorded by the head H2 decreases towards the upper end "a". However, in regions in the vicinity of the upper and lower ends "a" and "b", the number of times the head that is to record the dots is switched from the one head to the other is lower than that in a region in a vicinity of a center "c" of the overlapping region A. As a result, a deviation in the dot recording density (or tone) is uneasily generated within the overlapping region A by the difference of the head driving frequencies between the overlapping region A and the non-overlapping region B.

Therefore, in a region in the vicinity of the center "c" of the overlapping region A relative to the ends "a" and "b", each of the heads H1 and H2 record consecutive dots in order to prevent the driving frequency from decreasing. On the other hand, in the regions in the vicinities of the ends "a" and "b" of the overlapping region A, where the effects of the difference of the head driving frequencies between the overlapping region A and the non-overlapping region B is small, each of the heads H1 and H2 record the dots in a scattered manner in order to improve the effects of suppressing the generation of banding. In other words, the recording in the region in the vicinity of the center "c" of the overlapping region A is performed by placing emphasis on the succession or continuity of the dots and minimizing the switching of the head that is to record the dots, while the recording in the regions in the vicinities of the ends "a" and "b" is performed by placing emphasis on the scattering of the dots.

Of course, the number of overlapping nozzles of the heads H1 and H2 in the sub scan direction SS is not limited to six as illustrated in FIGS. 24A and 24B or nine as illustrated in FIG. 25A. In other words, the number of overlapping nozzles of the heads H1 and H2 may be set to an arbitrary value to suit the purpose.

Figure 26A:
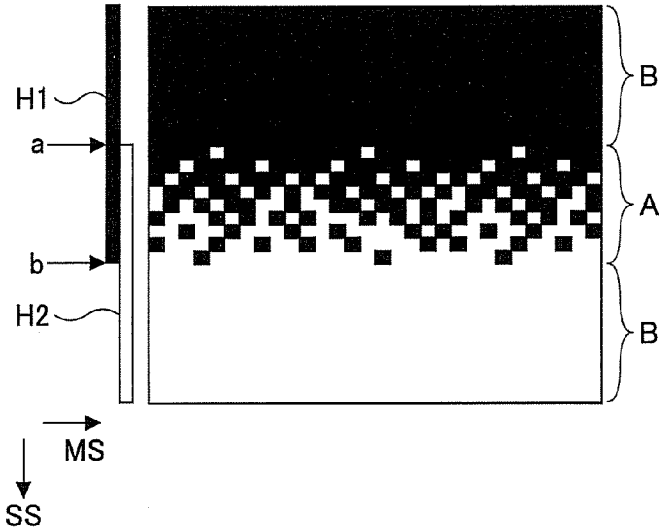
FIGS. 26A through 26D are diagrams illustrating first examples of a digital arrangement of the dots recorded by the overlap process.

FIGS. 26A through 26D are diagrams illustrating first examples of a digital arrangement of the dots (represented by squares) recorded by the overlap process. The illustration of the heads H1 and H2 and the scan directions MS and SS is omitted in FIGS. 26B through 26D, and similar omissions are made in FIGS. 27B and 30B which will be described later. FIG. 26A illustrates an example of the overlap process which reduces the dot recording rate of the head H1 at random towards the end "b", and reduces the dot recording rate of the head H2 at random towards the end "a". It is difficult to see the effects of the driving frequency in the digital arrangement of the dots recorded in the overlapping region A, however, a deviation in the dot recording density (or tone) may be generated within the overlapping region A, as described above.

Figure 26B:
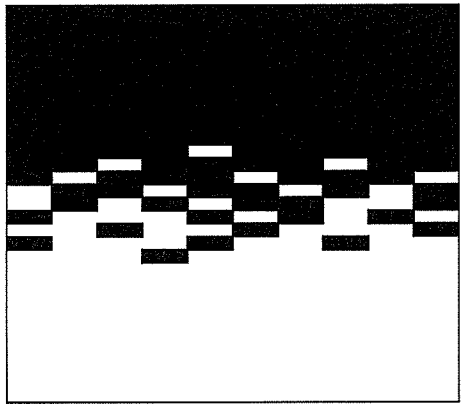

FIG. 26B illustrates an example of the overlap process which consecutively records the dots in the main scan direction MS by the heads H1 and H2, in a manner similar to the first embodiment described above. In this example, it is possible to reduce the deviation in the dot recording density (or tone) caused by the difference of the head driving frequencies between the overlapping region A and the non-overlapping region B.

Figure 26C:
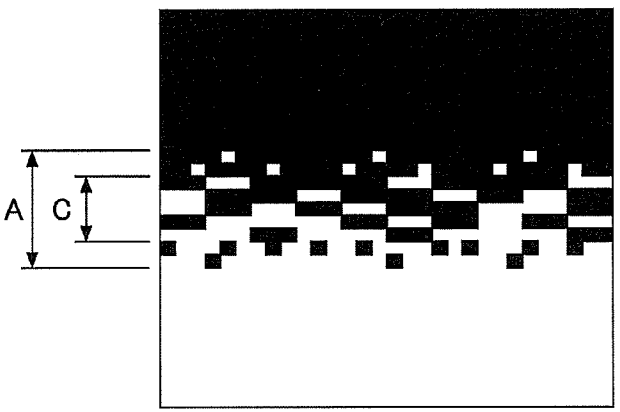

FIG. 26C illustrates an example of the overlap process which records the dots in a central region C of the overlapping region A by the heads H1 and H2 in a manner different from the manner in which the dots are recorded in other regions (that is, both end regions) of the overlapping region A. More particularly, the recording in the central region C of the overlapping region A is performed by placing emphasis on the succession or continuity of the dots, while the recording in the end regions of the overlapping region A is performed in units of one dot by placing emphasis on the scattering of the dots.

Figure 26D:
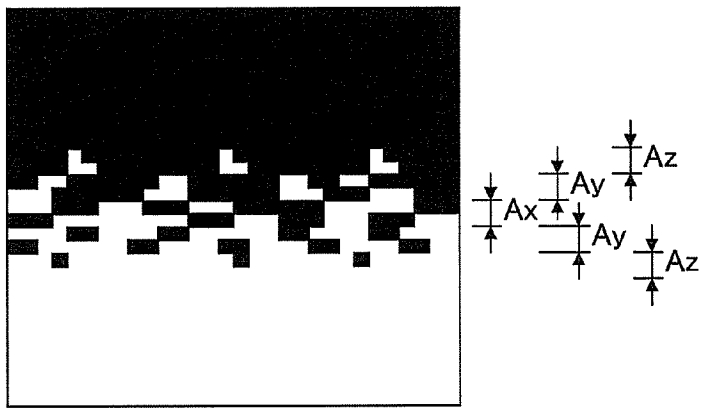

FIG. 26D illustrates an example of the overlap process which changes the manner in which the dots are recorded by the heads H1 and H2 in steps, from a center region Ax, to a first end region Ay, and then to a second end region Az. The recording in the center region Ax and the recording in the first end region Ay are performed by placing emphasis on the succession or continuity of the dots, while the recording in the second end region Az is performed in units of one dot by placing emphasis on the scattering of the dots. The recording in the center region Ax is performed by recording consecutive dots in units of three dots by each of the heads H1 and H2, and the recording in the first end region Ay is performed by recording consecutive dots in units of two dots by a corresponding one of the heads H1 and H2. The recording in the second end region Az is performed in units of one dot by a corresponding one of the heads H1 and H2.

The number of dots to be consecutively recorded when placing emphasis on the succession or continuity of the dots is not limited to a particular value. Basically, the larger the number of dots consecutively recorded, the less likely the deviation is generated in the dot recording density (or tone) within the overlapping region A by the difference of the head driving frequencies between the overlapping region A and the non-overlapping region B. This is because the driving frequency decreases at a boundary where the manner in which the dots are recorded changes (or switches), and the number of boundaries decreases if the number of consecutively recorded dots increases. On the other hand, the boundary is where the recording of the dots switches from one head to the other head in the overlapping region A. If the number of consecutively recorded dots becomes excessively large, the scattering of the dots in the overlapping region A decreases, to thereby reduce the effects of suppressing the generation of the banding.

The number of dots to be consecutively recorded in the overlapping region A may differ depending on the frequency characteristics of the recording head 7, the resolution at which the image is to be recorded on the recording medium 12, and the properties of the ink such as bleeding. The frequency characteristics of the recording head 7 determine the deviation in the dot recording density (or tone) generated within the overlapping region A by the difference of the head driving frequencies between the overlapping region A and the non-overlapping region B. Preferably, the number of dots to be consecutively recorded in the overlapping region A is determined or estimated based on experiments. The present inventors have conducted experiments for this second embodiment under conditions where the resolution is 600×300 dpi in the main and sub scan directions MS and SS, and the volumes of the large, medium and small ink drops jetted from the nozzles respectively are 21 pl, 9 pl and 3 pl. It was confirmed from the experiments that, at the lowest driving frequency of 12 kHz, the number of dots to be consecutively recorded in the overlapping region A is approximately three in order to reduce the undesirable effects of the frequency characteristics of the recording head 7, and that this number is preferable from the point of both reducing the effects of the driving frequency and achieving the effects of reducing the banding.

The central region C in FIG. 26C and the center region Ax and the first end region Ay in FIG. 26D are examples where a minimum unit of dots to be consecutively recorded, such as one set of three consecutive dots, is determined. In these examples, the dot pattern in which the dots are recorded in units of one dot may be used as a base dot pattern to easily create the dot pattern in which the dots are consecutively recorded with the minimum unit of the dots by modifying the base dot pattern. The modifying of the base dot pattern may simply multiply each dot by a natural number greater than or equal to two so that each dot in the base dot pattern is modified into two consecutive dots in the modified dot pattern, for example.

Figure 27B:
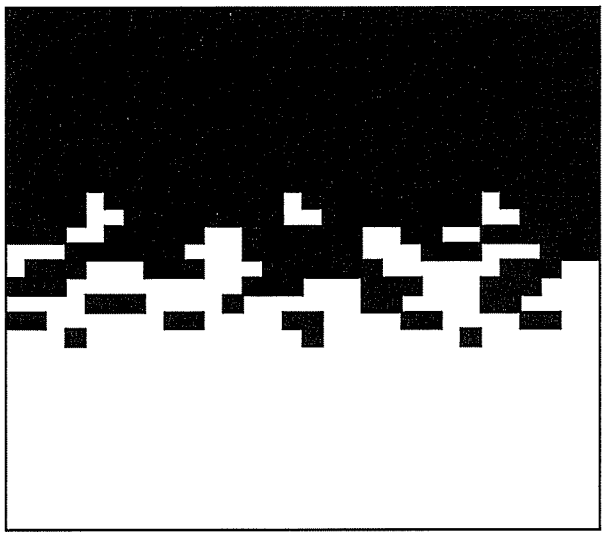
FIGS. 27A and 27B are diagrams illustrating second examples of the digital arrangement of the dots recorded by the overlap process.
Figure 27A:
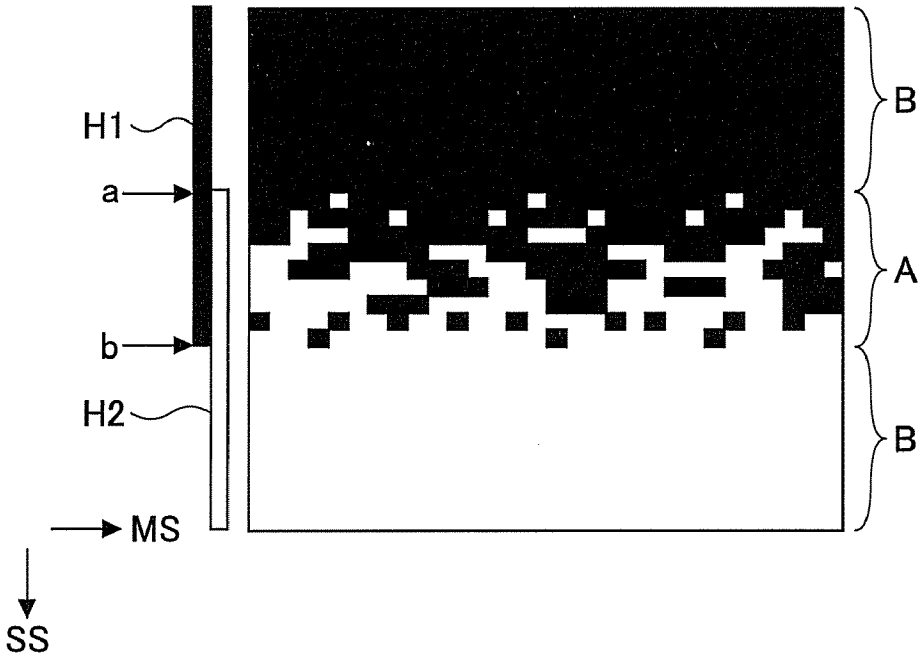

FIGS. 27A and 27B are diagrams illustrating second examples of the digital arrangement of the dots recorded by the overlap process.

When the base dot pattern is modified through multiplication as described above, it may cause switching points where the switching of the manner of recording the consecutive dots within the overlapping region A occurs to become regular or periodic. For this reason, the switching points within the overlapping region A may be arranged in order not to become regular or periodic, as illustrated in FIG. 27A. FIG. 27A illustrates an example in which the switching points within the overlapping region A are arranged in order not to become regular or periodic. In this case, it is possible to improve the scattering of the recorded dots within the overlapping region A.

On the other hand, when the minimum unit of the dots to be consecutively recorded is determined, the unit with which the dots are consecutively recorded becomes the natural number multiple of the minimum unit, to thereby deteriorate the scattering of the recorded dots within the overlapping region A.

Thus, instead of consecutively recording the dots with the minimum unit within the overlapping region A as illustrated in FIG. 27B, dot groups each made up of a plurality of consecutively recorded dots along the main scan direction MS within the overlapping region A may be made up of different numbers of consecutively recorded dots in each line. FIG. 27B illustrates the example in which the dot groups in each line within the overlapping region A are made up of different numbers of consecutively recorded dots, in order to further improve the scattering of the recorded dots within the overlapping region A.

The driving frequency decreases when the manner in which the dots are consecutively recorded switches at the switching points within the overlapping region A and the recording of the dots within the overlapping region A starts. However, if the decrease in the driving frequency is adjusted to become approximately the same for each line within the overlapping region A, the effects of the driving frequency becomes approximately the same for each line.

In addition, if the number of switching points within the overlapping region A, where the manner in which the dots are consecutively recorded switches, is less than or equal to a reference value, the number of switching points within the overlapping region A may be increased to improve the scattering of the recorded dots within the overlapping region A. On the other hand, if the number of switching points within the overlapping region A is greater than the reference value, the number of switching points within the overlapping region A may be decreased by increasing the number of dots that are consecutively recorded, for example.

Figure 28:
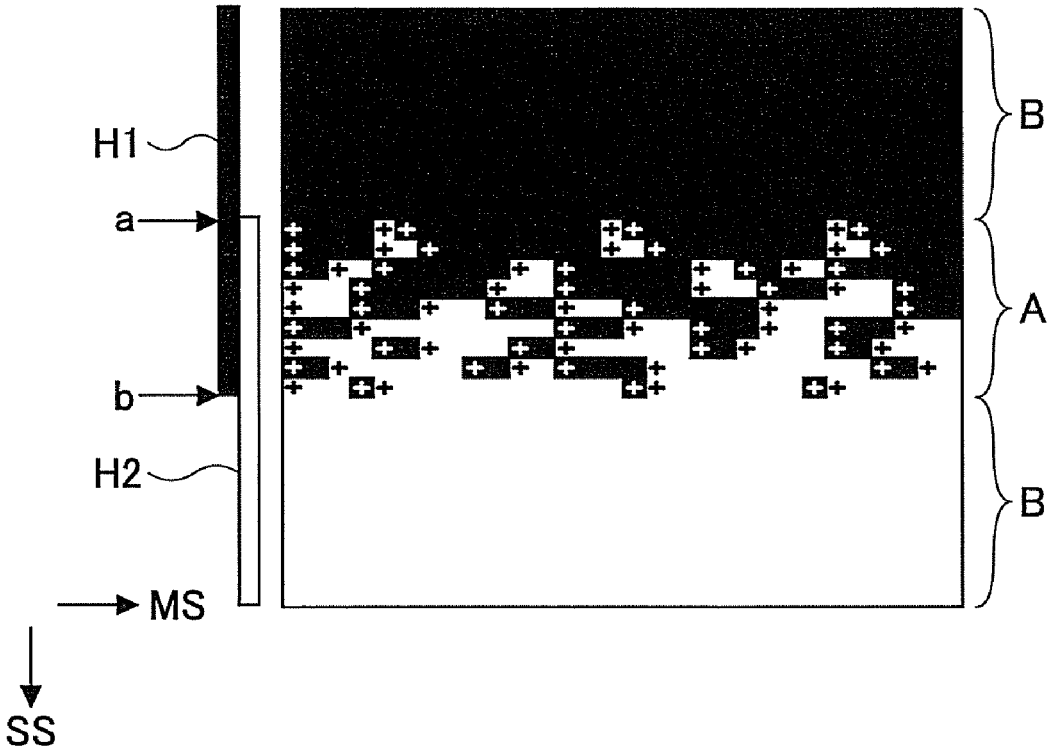
FIG. 28 is a diagram illustrating an example of the digital arrangement that takes into consideration a number of switching points within the overlapping region.

FIG. 28 is a diagram illustrating an example of the digital arrangement that takes into consideration the number of switching points within the overlapping region A. In FIG. 28, the dots are recorded in the main scan direction MS from the left to right, and the switching points are indicated by a symbol "+". The jetting of the ink drops starts from the switching point "+", and thus, the driving frequency decreases at this switching point "+". The effects of the driving frequency can be made approximately the same for each line by controlling the jetting of the ink drops so that the number of switching points "+" becomes approximately the same for each line. In the example illustrated in FIG. 28, the number of switching points "+" in each line is 8±1. In other words, the recording is controlled so that the number of switching points "+" in each line is within a predetermined range of 7 to 9 in the example illustrated in FIG. 28. The recording may be controlled by the CPU 201 or, the print control part 207 or, a combination of the CPU 201 and the print control part 207, by performing a masking process similar to the masking process of the first embodiment described above.

Figure 29:
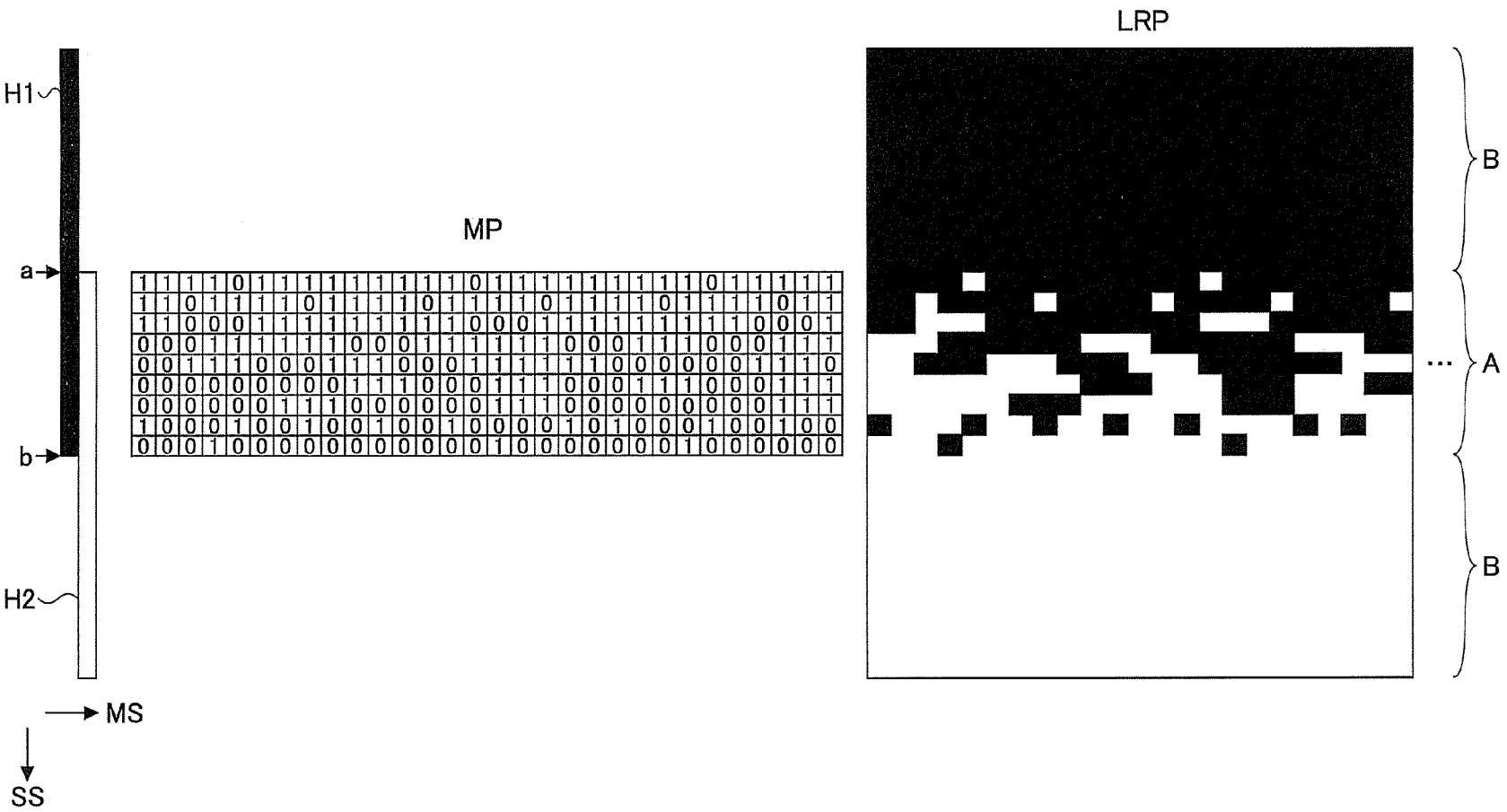
FIG. 29 is a diagram illustrating an example of the overlap process using a mask pattern.

Next, a description will be given of a particular example of the overlap process in which the manner of recording the consecutive dots is switched, by referring to FIG. 29. FIG. 29 is a diagram illustrating an example of the overlap process using a mask pattern. In FIG. 29, MP denotes a mask pattern for the head H1, and LRP denotes the landing positions of the dots recorded by the heads H1 and H2 in the overlapping region A and the non-overlapping region B. For the sake of convenience, the landing positions LRP correspond only to a portion of the mask pattern MP. In the mask pattern MP, a value "1" indicates jetting of the ink drop from the head H1 to land on the recording medium 12, and a value "0" indicates no jetting of the ink drop from the head H1 to land on the recording medium 12. As may be seen from FIG. 29, the values "1"s and "0"s in the mask pattern MP for the head H1 in the overlapping region A have an exclusive relationship to each other. For example, a mask pattern (not illustrated) for the head H2 may be formed in a complementary manner to the mask pattern MP.

The mask pattern MP may be stored in the mask pattern table 606 illustrated in FIG. 12, and the mask pattern table 606 may be formed by the ROM 202 illustrated in FIG. 5, as described above in conjunction with the first embodiment. The mask pattern MP determines the dot pattern to be recorded by the head H1, including the number of consecutive dots to be recorded, the switching points, the changes in the dot recording rate, and the like.

Figure 30B:
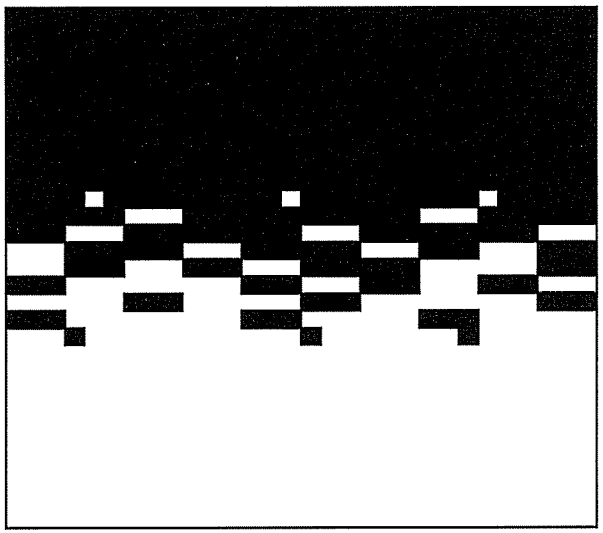
FIGS. 30A and 30B are diagrams illustrating third examples of the digital arrangement of the dots recorded by the overlap process.
Figure 30A:
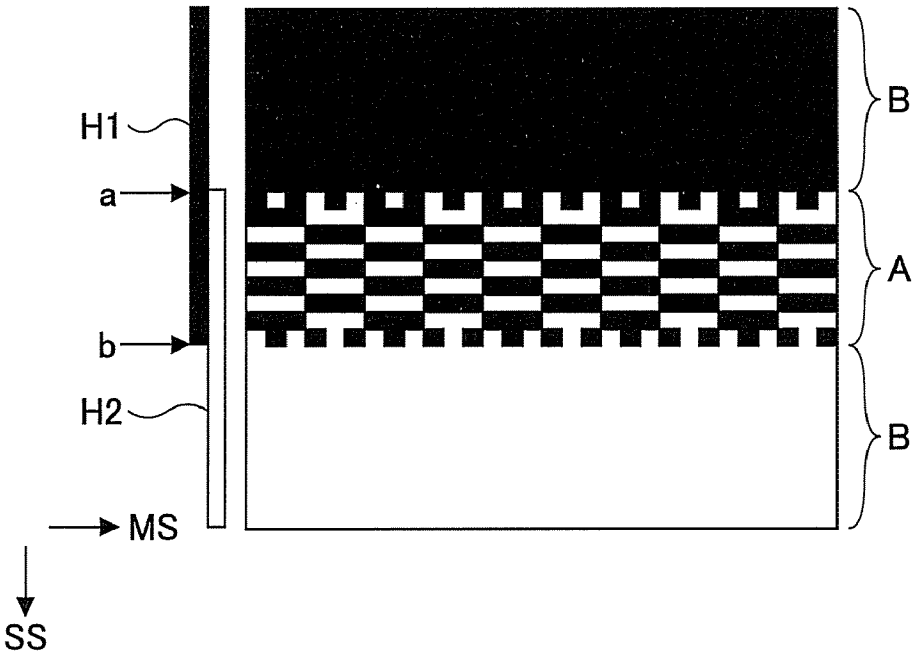

FIGS. 30A and 30B are diagrams illustrating third examples of the digital arrangement of the dots recorded by the overlap process.

The dot recording rate within the overlapping region A is preferably the same for the two heads H1 and H2 of the recording head 7. However, the same dot recording rate for the two heads H1 and H2 may cause the recording to be more easily affected by the frequency characteristics of the recording head 7. On the other hand, at the lines within the overlapping region A adjacent to the boundaries with the non-overlapping regions B, it is preferable to avoid a considerable change in the dot recording rate. Hence, at the lines within the overlapping region A adjacent to the boundaries with the non-overlapping regions B in FIG. 30A, the dots are recorded by each of the heads H1 and H2 in units of one dot intervals, for example, by placing more emphasis on the scattering of the recorded dots. At other lines within the overlapping region A, the dots are recorded by each of the heads H1 and H2 in units of three consecutive dots at intervals of three dots. Accordingly, the dot recording rate within the overlapping region A is the same for the two heads H1 and H2.

On the other hand, when varying the dot recording rate within the overlapping region A, it is possible to improve the effects of suppressing the generation of the banding by increasing the amount of overlap. However, if the amount of overlap between the heads H1 and H2 increases, a recording region on the recording medium 12 that can be recorded in one pass (or scan) is reduced, to thereby deteriorate the productivity and may generate a situation where the recording region having a desired width along the sub scan direction SS cannot be recorded in one pass (or scan).

Further, if the amount of overlap between the heads H1 and H2 decreases, it may not be possible to sufficiently vary the dot recording rate within the overlapping region A. Hence, at the lines within the overlapping region A adjacent to the boundaries with the non-overlapping regions B in FIG. 30A, the dots are recorded by each of the heads H1 and H2 in a scattered manner. At other lines within the overlapping region A, consecutive dots are recorded by each of the heads H1 and H2 at random, that is, based on a random number. Accordingly, even if the length of the overlapping region A along the sub scan direction SS is relatively short, it is possible to suppress the generation of the banding while varying the dot recording rate within the overlapping region A. Moreover, although the lines within the overlapping region A adjacent to the boundaries with the non-overlapping regions B are more easily affected by the frequency characteristics of the recording head 7 than the other lines within the overlapping region A, it is possible to adjust the amount the recording medium 12 is transported in the sub scan direction SS after the recording of each line in a direction that suppresses the generation of the banding caused by the frequency characteristics of the recording head 7.

In the case of the recording head 7 having the frequency characteristics such that the amount of ink jetted from the recording head 7 decreases as the driving frequency thereof decreases, the tone becomes reduced. For this reason, by intentionally adjusting the amount the recording medium 12 is transported in the sub scan direction SS after the recording of each line in a direction which increases the possibility of generating a black banding (or black line), it becomes possible to suppress the generation of the banding together with the effects of the frequency characteristics of the recording head 7.

On the other hand, in the case of the recording head 7 having an opposite frequency characteristics such that the amount of ink jetted from the recording head 7 increases, the amount of the recording medium 12 transported in the sub scan direction SS after the recording of each line may be intentionally adjusted in a direction which increases the possibility of generating a white banding (or white line), in order to suppress the generation of the banding together with the effects of the frequency characteristics of the recording head 7.

Of course, this second embodiment may use the judging window W described above in conjunction with FIG. 17 to judge the driving frequency of the nozzles of the recording head 7. Further, this second embodiment may also employ the mask patterns MP1 and MP2 and appropriately fit the mask patterns or partial mask patterns into the judging window W within the overlapping region A, described above in conjunction with FIGS. 18(A) through 18(E)

Figure 31C:
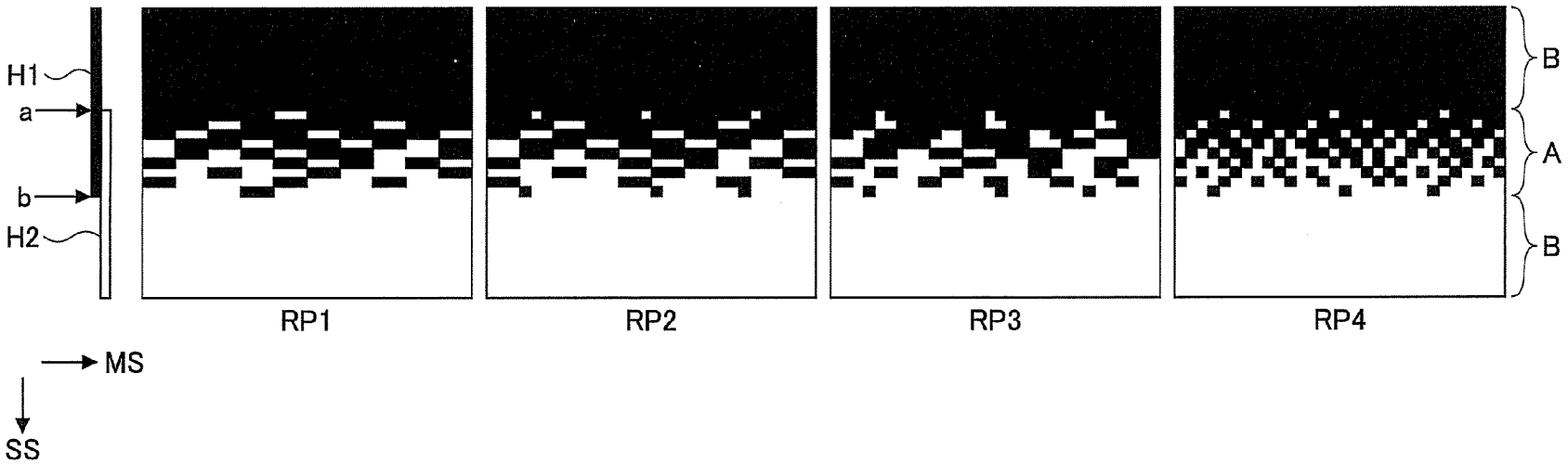

FIGS. 31A through 31C are diagrams illustrating examples of the switching of the overlap process depending on various conditions.

For example, the difference of the head driving frequencies between the overlapping region A and the non-overlapping region B may be less conspicuous in a first recording mode and more conspicuous in a second recording mode, where the first and second recording modes are determined by the recording method such as the 1-pass recording and the 2-pass recording and the resolution with which the recording is performed. In this case, it is preferable to record the dots in the scattered manner for the first recording mode, and to record a plurality of dots consecutively in the second recording mode. In addition, the conspicuousness of the consecutive dots differ depending on the resolution, and the run of three consecutive dots along the main scan direction MS for the resolution of 300 dpi in the main scan direction MS is two times that for the resolution of 600 dpi in the main scan direction MS, for example.

On the other hand, the dot recording density differs depending on the positional error of the recording head 7. If the positional error of the recording head 7 causes the white banding, the dot recording density tends to decrease in a vicinity of the overlapping region A, and thus, it is preferable in this case to record a plurality of dots consecutively to avoid the dot recording density from further decreasing due to the effects of the difference of the head driving frequencies between the overlapping region A and the non-overlapping region B. In addition, if the positional error of the recording head 7 causes the black banding, the dot recording density tends to increase in a vicinity of the overlapping region A, and thus, it is preferable in this case to record the dots in a scattered manner to avoid the dot recording density from further increasing due to the effects of the difference of the head driving frequencies between the overlapping region A and the non-overlapping region B.

Furthermore, the ink viscosity differs depending on the environment in which the recording is made on the recording medium 12, and the effects of the difference of the head driving frequencies between the overlapping region A and the non-overlapping region B may vary depending on the environment. Hence, it is preferable to vary the manner in which the dots are recorded, that is, to record the dots consecutively or in a scattered manner, depending on whether the environment causes the effects of the difference of the head driving frequencies between the overlapping region A and the non-overlapping region B to become more conspicuous.

Therefore, the mask pattern described above, which determines the manner in which the dots are recorded in the overlapping region A, may be determined by taking the above conditions or parameters into consideration.

FIG. 31A illustrates the mask patterns that are determined from the positional error of the recording head 7, the recording mode, the ambient temperature and the humidity which may be obtained from the printer driver, sensors and the like, and the determined mask pattern may be used to switch the manner in which the dots are recorded in the overlapping region A. This example illustrates the mask patterns for the positional errors of ±20 μm, ±15 μm, and ±10 μm. For example, if the positional error of the recording head is ±15 μm, the recording mode is the 1-pass recording using the resolution of 600 dpi×300 dpi in the main and sub scan directions MS and SS, the temperature and humidity are low, a mask pattern RP3 illustrated in FIG. 31C is used.

FIG. 31B illustrates the mask patterns that are determined from the positional error of the recording head 7, the recording mode, the ambient temperature and the humidity which may be obtained from the printer driver, sensors and the like, and the determined mask pattern may be used to switch the manner in which the dots are recorded in the overlapping region A. This example illustrates the mask patterns for the positional error of −10 μm to −30 μm which tend to cause the black banding, the positional error of ±10 μm, and the positional error of +10 μm to +30 μm which tend to cause the white banding. For example, if the positional error of the recording head is −10 μm to −30 μm which tend to cause the black banding, the recording mode is the 2-pass recording using the resolution of 600 dpi×600 dpi in the main and sub scan directions MS and SS, and the temperature and humidity are high, a mask pattern RP4 illustrated in FIG. 31C is used.

In FIG. 31C, a mask pattern RP1 causes the dots to be recorded as illustrated in FIG. 265, a mask pattern. RP2 causes the dots to be recorded as illustrated in FIG. 30B, the mask pattern RP3 causes the dots to be recorded as illustrated in FIG. 26D, and a mask pattern RP4 causes the dots to be recorded as illustrated in FIG. 26A.

In this example, one of the mask patterns RP1 through RP4 is determined depending on the conditions such as the positional error of the recording head 7, the recording mode, the temperature and the humidity.

Accordingly, the mask pattern which determines the distribution of the dots to be recorded by each of the nozzles of the recording head 7 within the overlapping region A, may be determined based on information indicating at least one of the recording mode, the positional error of the recording head 7, the ambient temperature and humidity. However, the distribution of the dots to be recorded by each of the nozzles of the recording head 7 within the overlapping region A may be determined by any suitable method other than the method that uses the mask pattern.

For example, the mask patterns may be optimized by recording test charts of different batches by the overlap process described above using various mask patterns, and obtaining the mask pattern which minimizes the banding for the test charts.

The length of the overlapping region A along the sub scan direction SS, in which the scans of the heads H1 and H2 overlap, may be controlled by varying the overlapping nozzles of the heads H1 and H2, by controlling the amount the recording medium 12 is transported in the sub scan direction SS after recording each line in the main scan direction. Hence, the length of the overlapping region A along the sub scan direction SS and the manner in which the dots are to be recorded within the overlapping region A may be determined based on the productivity to be achieved by the image forming apparatus. For example, the length of the overlapping region A along the sub scan direction SS may be set relatively long if the image quality is to have priority over the productivity, and the length of the overlapping region A along the sub scan direction SS may be set relatively short if the productivity is to have priority over the image quality.

Moreover, the manner in which the dots are recorded within the overlapping region A, that is, the mask patterns to be used in the example described above, may be determined depending on the length of the overlapping region A along the sub scan direction SS. For example, it is possible to create a mask pattern for a maximum length of the overlapping region A along the sub scan direction SS, and to create mask patterns for other lengths of the overlapping region A along the sub scan direction SS by extracting portions of the mask pattern created for the maximum length.

Of course, the manner in which the dots are recorded within the overlapping region A may be the same regardless of the length of the overlapping region A along the sub scan direction SS. However, as described above, the manner in which the dots are recorded within the overlapping region A may be changed in steps as illustrated in FIG. 26D when length of the overlapping region A along the sub scan direction SS is relatively long or, may be changed only in the vicinity of the boundary between the non-overlapping region B and the overlapping region A when length of the overlapping region A along the sub scan direction SS is relatively short.

Therefore, according to this second embodiment, it is possible to perform the overlap process that is effective in reducing the banding while taking into consideration the effects of the driving frequency. Hence, the productivity of the image forming apparatus can be improved, and the blur in the recorded image can be reduced.

Of course, each of the embodiments described above may be applied to a color image forming apparatus, by employing the above described arrangement of the heads and distributing the dots to be recorded by each of the nozzles within the overlapping region A in the above described manner, for each of the color used for the color recording. In this case, the productivity of the color image forming apparatus can be improved, and the blur or color registration error in the recorded image can be reduced.

Figure 32A:
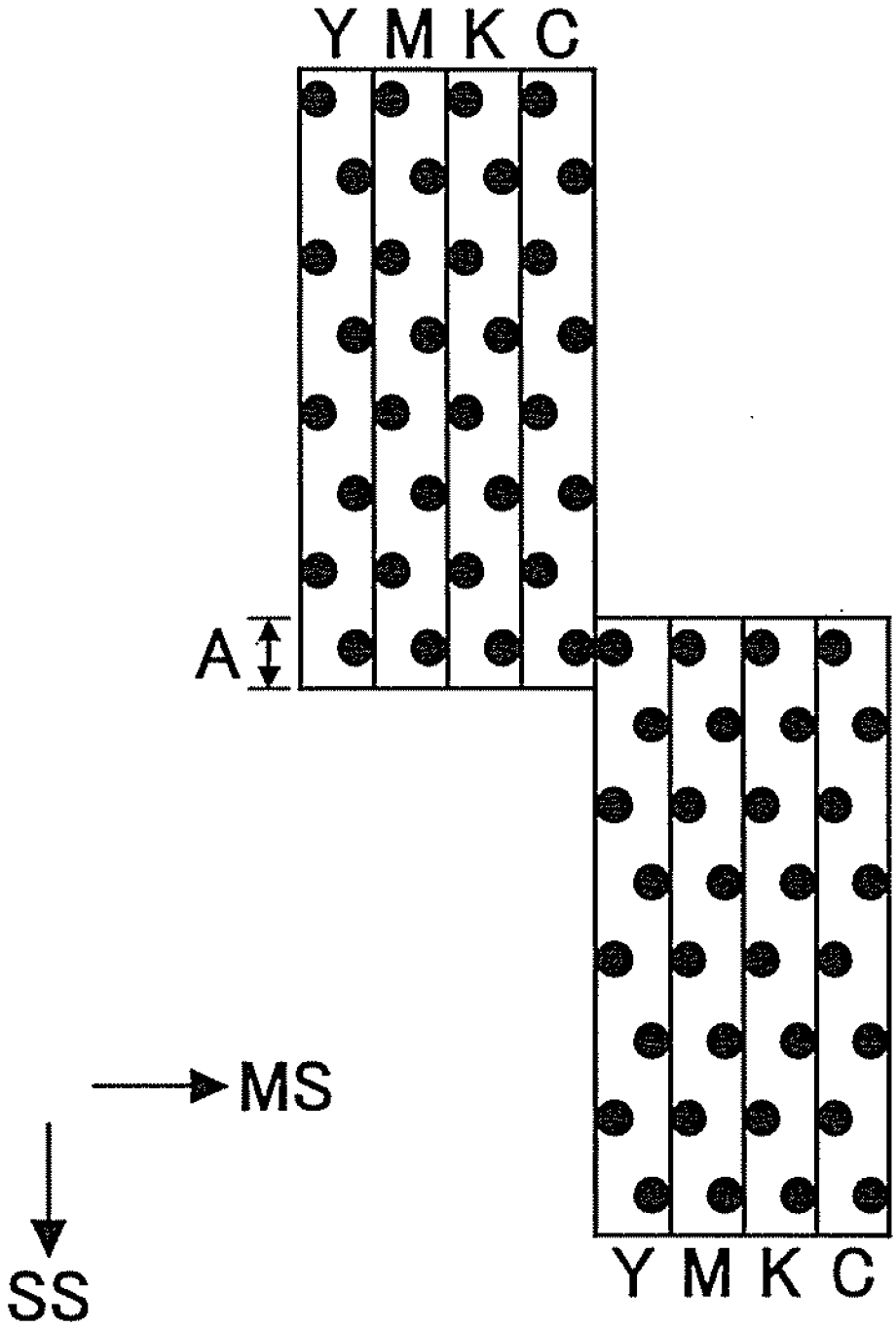
FIGS. 32A through 32E are diagrams illustrating examples of the recording head.
Figure 32B:
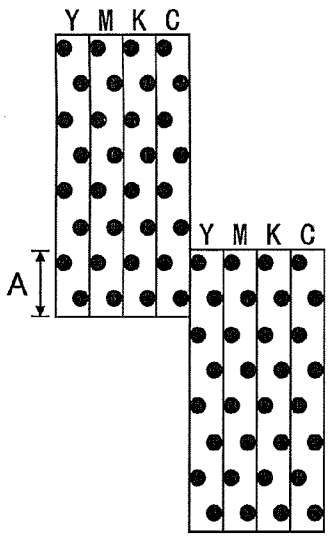
Figure 32C:
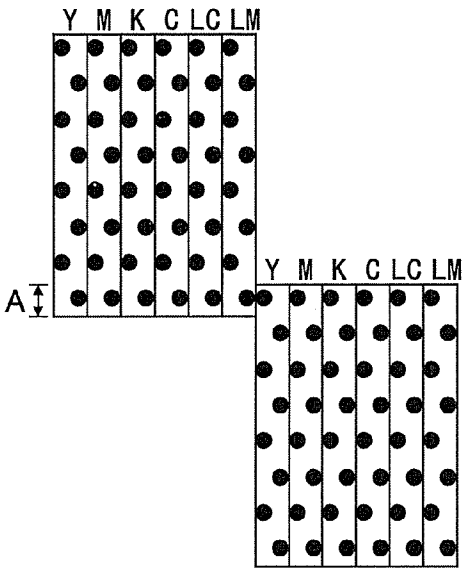
Figure 32D:
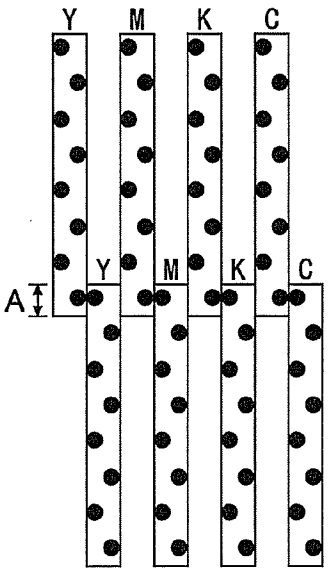
Figure 32E:
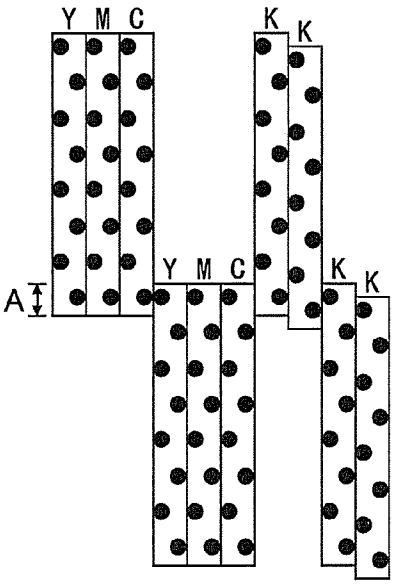

In addition, each of the embodiments described above is applied to the serial type ink-jet printer which performs the overlap process within the overlapping region A generated by the overlapping portions of the scans made by the heads H1 and H2. However, the present invention is similarly applicable to image forming apparatuses having more than two heads that are arranged along the main scan direction and scan with an overlap, including color image forming apparatuses and line type image forming apparatuses FIGS. 32A through 32E are diagrams illustrating examples of the recording head 7. In FIGS. 32A through 32E, Y, M, K and C respectively denote heads for recording with yellow, magenta, black and cyan inks. In addition, black circular dots denote nozzles of the heads Y, M, K and C. In each head, such as the head Y, the nozzles are arranged in a zigzag manner along the sub scan direction SS, however, the nozzle arrangement within each head is not limited to such, and for example, the nozzles may be arranged linearly along the sub scan direction SS as in the embodiments described above. The overlapping region A amounts to one dot along the sub scan direction for the recording heads 7 illustrated in FIGS. 32A, 32C and 32D. The overlapping region A amounts to two dots along the sub scan direction for the recording head 7 illustrated in FIG. 325. FIG. 32C illustrates heads LC and LM which record using inks having cyan and magenta inks that are different from the cyan and magenta inks used by the heads C and M. In FIGS. 32A, 32B and 32C, a first group of nozzles of a first group of heads Y, M, K and C (and LC and LM) are provided adjacent to each other to form a set which is adjacent to a set formed by a second group of nozzles of a second group of heads Y, M, K and C (and LC and LM) that are provided adjacent to each other. FIG. 32D illustrates heads Y, M, K and C that are arranged in an order different from that of FIG. 32A, for example. FIG. 32E illustrates the heads Y, M, C and K, including two pairs of heads K that enable recording at different resolutions, by having one of two adjacent heads K shifted in the sub scan direction SS by a distance amounting to less than one dot relative to the other of the two adjacent heads K in each pair of heads K.

Because the banding within the overlapping region A becomes more conspicuous as the number of heads forming the recording head 7 increases, the masking process of the print control part 207 is particularly effective in the case of color recording heads.

Figure 33:
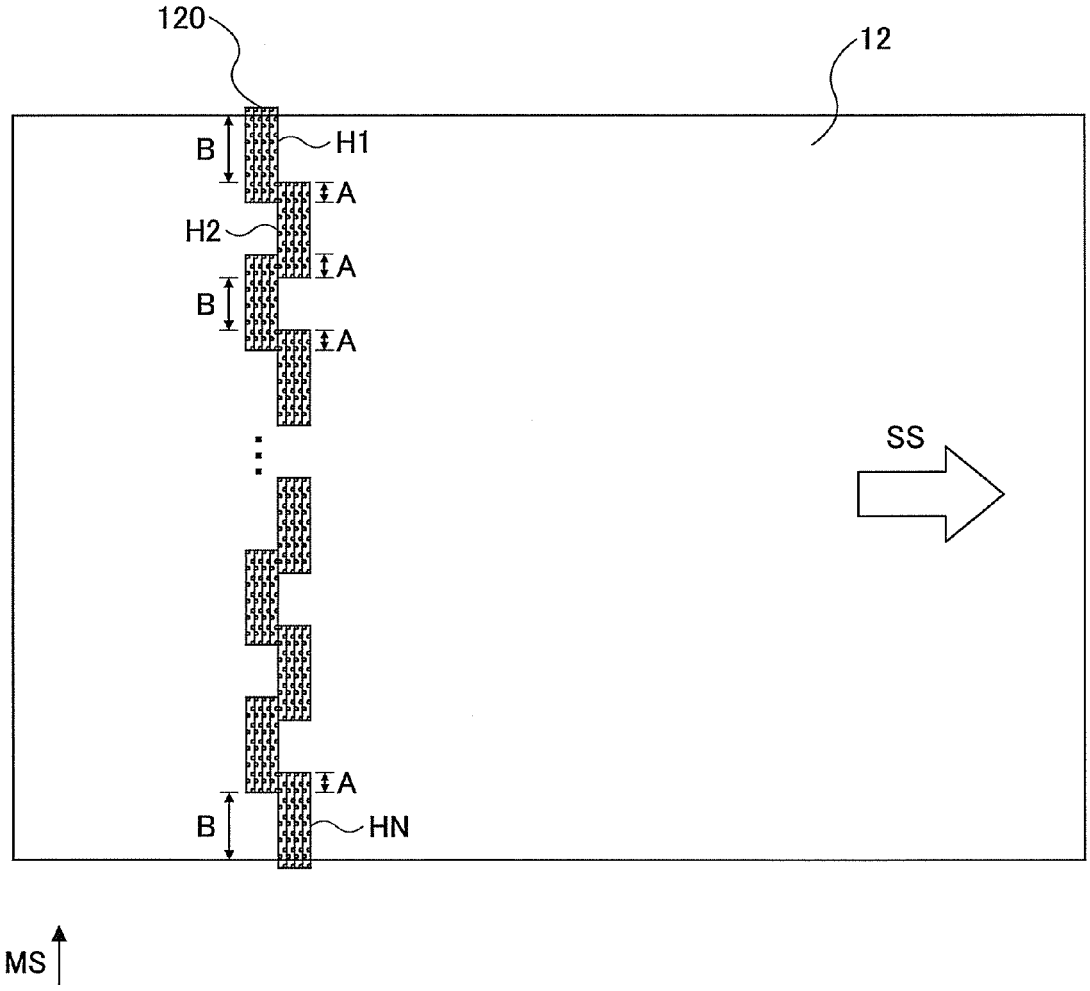
FIG. 33 is a diagram illustrating an example of a line type recording head.

FIG. 33 is a diagram illustrating an example of a line type recording head. A line type recording head 120 is mounted on a fixed carriage (not illustrated), for example, and is stationary with respect to the recording medium 12 which is transported in a first direction SS. The line type recording head 120 includes N heads H1, H2, . . . , and HN which are connected in a second direction MS with an overlap corresponding to the overlapping region A, where N is a natural number greater than or equal to two. The total length of the line type recording head 120 along the second direction MS is greater than or equal to a width of the recording medium 12 along the second direction MS. In this example, each of the heads H1 through HN has the structure illustrated in FIG. 32B, for example. Any one of the overlap processes described above may be applied to each of the overlapping regions A on the recording medium 12 when performing the 1-pass recording. In this example, it is possible to reduce the effects of the positional error caused by a mounting or assembling error of the heads H1 through HN, to thereby suppress the banding generated by the positional error.

The image forming apparatus itself employing a line type recording head is known, and thus, a detailed description on the structure and operation thereof will be omitted in this specification.

Of course, the line type recording head 120 may be transported in the first direction SS in a state where the recording medium 12 is stationary when recording the image on the recording medium 12. In other words, at least one of the line type recording head 120 and the recording medium 12 may be moved relative to the other in the first direction SS when recording the image on the recording medium 12. Hence, the recording employing the overlap process described above may be performed by controlling the relative scan of the line type recording head 120 with respect to the recording medium 12 in the first direction SS.

On the other hand, the recording employing the overlap process described above may be performed by controlling the relative scan of the recording head 7 with respect to the recording medium 12 in the second direction MS, in the case of the recording head 7 such as those of the first and second embodiments, in which the total length of the recording head 7 along the second direction MS is less than the width of the recording medium 12 along the second direction MS.

A computer-readable storage medium which stores the program which, when executed by a computer such as the CPU 201, causes the computer to perform the image forming method of any one of the embodiments described above, is of course not limited to the ROM 202, the RAM 203 and the NVRAM 204 illustrated in FIG. 5. The computer-readable storage medium may be formed by any suitable medium capable of storing the program in a computer-readable manner, such as disks including magneto-optical disk, CD-ROMs, DVD-ROMs and Floppy Disks (FDs), and semiconductor memory devices including flash memories, memory cards and memory sticks.

Further, the present invention is not limited to these embodiments, but various variations and modifications may be made without departing from the scope of the present invention.

What is claimed is:

1. An image forming apparatus comprising:

a recording head, including a first group of nozzles arranged in a first direction and a second group of nozzles arranged in the first direction and provided adjacent to the first group of nozzles in a second direction that is perpendicular to the first direction, and configured to record dots on a recording medium by jetting ink drops thereon from the nozzles; and a print control unit configured to control a relative scan of the recording head with respect to the recording medium in the second direction so that a first non-overlapping region on the recording medium is scanned by at least one first nozzle of the first nozzle group, an overlapping region on the recording medium is scanned by at least three second nozzles of the first nozzle group, other than the first nozzle, and at least three third nozzles of the second nozzle group, and a second non-overlapping region on the recording medium is scanned by at least one fourth nozzle of the second nozzle group, other than the third nozzles, wherein the print control unit controls a recording density of the dots and a number of consecutive dots recorded by the at least three second nozzles in the second direction within the overlapping region to decrease from a first boundary between the overlapping region and the first non-overlapping region towards a second boundary between the overlapping region and the second non-overlapping region, and a recording density of the dots and a number of consecutive dots recorded by the at least three third nozzles in the second direction within the overlapping region to decrease from the second boundary towards the first boundary.

2. The image forming apparatus as claimed in claim 1, wherein the number of consecutive dots recorded by each of the second and third nozzles in the second direction within the overlapping region falls within a predetermined range.

3. The image forming apparatus as claimed in claim 1, wherein the number of dots recorded by the at least three second nozzles and the number of dots recorded by the at least three third nozzles are approximately the same within the overlapping region.

4. The image forming apparatus as claimed in claim 1, further comprising:

a memory configured to store mask patterns which determine the recording density of the dots and the number of consecutive dots to be recorded by each of the second and third nozzles within the overlapping region, wherein the print control unit masks a dot pattern of print data to be recorded within the overlapping region using one of the mask patterns stored in the memory.

5. The image forming apparatus as claimed in claim 4, wherein the print control unit selects said one of the mask patterns depending on at least one of a driving frequency at which the nozzles of the recording head are driven, a recording mode which is determined by a recording method including a single-pass recording and a multi-pass recording and a resolution with which the recording is performed, a positional error of the recording head, and ambient temperature and humidity of the image forming apparatus.

6. The image forming apparatus as claimed in claim 1, wherein the print control unit determines the recording density of the dots and the number of consecutive dots to be recorded by each of the second and third nozzles within the overlapping region, depending on at least one of a driving frequency at which the nozzles of the recording head are driven, a recording mode which is determined by a recording method including a single-pass recording and a multi-pass recording and a resolution with which the recording is performed, a positional error of the recording head, and ambient temperature and humidity of the image forming apparatus.

7. The image forming apparatus as claimed in claim 1, further comprising:

a mechanism configured to transport the recording medium in the first direction, wherein a combined length of the first and second groups of nozzles of the recording head along the first direction is less than a width of the recording medium along the first direction, and the recording head performs a multi-pass of the recording medium in the second direction.

8. The image forming apparatus as claimed in claim 1, further comprising:

a mechanism configured to transport the recording medium in the second direction, wherein a combined length of the first and second groups of nozzles of the recording head along the first direction is greater than or equal to a width of the recording medium along the first direction, and the recording head performs a single-pass of the recording medium in the second direction.

9. The image forming apparatus as claimed in claim 1, wherein the recording head includes the first and second groups of nozzles with respect to each of a plurality of color inks to be jetted therefrom to form a color image on the recording medium.

10. The image forming apparatus as claimed in claim 9, wherein the first group of nozzles for each of the plurality of color inks are provided adjacent to each other to form a set which is adjacent to a set formed by the second group of nozzles for each of the plurality of color inks.

11. An image forming method for recording dots on a recording medium using a recording head, including a first group of nozzles arranged in a first direction and a second group of nozzles arranged in the first direction and provided adjacent to the first group of nozzles in a second direction that is perpendicular to the first direction, and configured to record dots on a recording medium by jetting ink drops thereon from the nozzles, said image forming method comprising:

controlling a relative scan of the recording head with respect to the recording medium in the second direction so that a first non-overlapping region on the recording medium is scanned by at least one first nozzle of the first nozzle group, an overlapping region on the recording medium is scanned by at least three second nozzles of the first nozzle group, other than the first nozzle, and at least three third nozzles of the second nozzle group, and a second non-overlapping region on the recording medium is scanned by at least one fourth nozzle of the second nozzle group, other than the third nozzles; and determining a recording density of the dots and a number of consecutive dots recorded by the at least three second nozzles in the second direction within the overlapping region to decrease from a first boundary between the overlapping region and the first non-overlapping region towards a second boundary between the overlapping region and the second non-overlapping region, and a recording density of the dots and a number of consecutive dots recorded by the at least three third nozzles in the second direction within the overlapping region to decrease from the second boundary towards the first boundary.

12. The image forming method as claimed in claim 11, wherein the number of consecutive dots recorded by each of the second and third nozzles in the second direction within the overlapping region falls within a predetermined range.

13. The image forming method as claimed in claim 11, wherein the number of dots recorded by the at least three second nozzles and the number of dots recorded by the at least three third nozzles are approximately the same within the overlapping region.

14. The image forming method as claimed in claim 11, further comprising:

prestoring, in a memory, mask patterns which determine the recording density of the dots and the number of consecutive dots to be recorded by each of the second and third nozzles within the overlapping region, wherein said determining masks a dot pattern of print data to be recorded within the overlapping region using one of the mask patterns stored in the memory.

15. The image forming method as claimed in claim 14, wherein said determining selects said one of the mask patterns depending on at least one of a driving frequency at which the nozzles of the recording head are driven, a recording mode which is determined by a recording method including a single-pass recording and a multi-pass recording and a resolution with which the recording is performed, a positional error of the recording head, and ambient temperature and humidity of the image forming apparatus.

16. The image forming method as claimed in claim 11, wherein said determining determines the recording density of the dots and the number of consecutive dots to be recorded by each of the second and third nozzles within the overlapping region, depending on at least one of a driving frequency at which the nozzles of the recording head are driven, a recording mode which is determined by a recording method including a single-pass recording and a multi-pass recording and a resolution with which the recording is performed, a positional error of the recording head, and ambient temperature and humidity of the image forming apparatus.

17. The image forming method as claimed in claim 11, further comprising:

transporting the recording medium in the first direction by a transport mechanism;

wherein a combined length of the first and second groups of nozzles of the recording head along the first direction is less than a width of the recording medium along the first direction; and moving the recording head to perform a multi-pass of the recording medium in the second direction.

18. The image forming method as claimed in claim 11, further comprising:

transporting the recording medium in the second direction by a transport mechanism;

wherein a combined length of the first and second groups of nozzles of the recording head along the first direction is greater than or equal to a width of the recording medium along the first direction; and performing a single-pass of the recording medium in the second direction by the recording head.

19. The image forming method as claimed in claim 11, wherein the recording head includes the first and second groups of nozzles with respect to each of a plurality of color inks to be jetted therefrom to form a color image on the recording medium.

20. A non-transitory computer-readable storage medium that stores a program which, when executed by a computer, causes the computer to record dots on a recording medium using a recording head, including a first group of nozzles arranged in a first direction and a second group of nozzles arranged in the first direction and provided adjacent to the first group of nozzles in a second direction that is perpendicular to the first direction, and configured to record dots on a recording medium by jetting ink drops thereon from the nozzles, said program comprising:

a controlling procedure causing the computer to control a relative scan of the recording head with respect to the recording medium in the second direction so that a first non-overlapping region on the recording medium is scanned by at least one first nozzle of the first nozzle group, an overlapping region on the recording medium is scanned by at least three second nozzles of the first nozzle group, other than the first nozzle, and at least three third nozzles of the second nozzle group, and a second non-overlapping region on the recording medium is scanned by at least one fourth nozzle of the second nozzle group, other than the third nozzles; and a determining procedure causing the computer to determine a recording density of the dots and a number of consecutive dots recorded by the at least three second nozzles in the second direction within the overlapping region to decrease from a first boundary between the overlapping region and the first non-overlapping region towards a second boundary between the overlapping region and the second non-overlapping region, and a recording density of the dots and a number of consecutive dots recorded by the at least three third nozzles in the second direction within the overlapping region to decrease from the second boundary towards the first boundary.

* * * * *